US005761871A

United States Patent [19]

Atake

[11] Patent Number: 5,761,871

[45] Date of Patent: Jun. 9, 1998

[54] FRAMEWORK STRUCTURE

[75] Inventor: Katsuhito Atake, Nagoya, Japan

[73] Assignee: Aleph Co., Ltd., Aichi, Japan

[21] Appl. No.: 687,323

[22] PCT Filed: Sep. 9, 1994

[86] PCT No.: PCT/JP94/01498

§ 371 Date: Aug. 5, 1996

§ 102(e) Date: Aug. 5, 1996

[87] PCT Pub. No.: WO95/21351

PCT Pub. Date: Aug. 10, 1995

[30] Foreign Application Priority Data

Feb. 7, 1994 [JP] Japan ..... 00184

[51] Int. Cl.[6] ..... E04B 1/52

[52] U.S. Cl. ..... 52/653.1; 52/109; 52/645; 52/81.3

[58] Field of Search ..... 52/653.1, 109, 52/645, 81.3

[56] References Cited

U.S. PATENT DOCUMENTS

| | | | |
|---|---|---|---|
| 1,546,698 | 7/1925 | Zoll et al. | 52/109 X |
| 3,877,544 | 4/1975 | McCollum | 52/109 X |
| 4,557,083 | 12/1985 | Zanardo | 52/109 |
| 4,779,635 | 10/1988 | Lynch | 52/109 X |
| 4,791,761 | 12/1988 | Goudie | 52/109 |
| 4,942,700 | 7/1990 | Hoberman | 52/109 X |
| 5,038,532 | 8/1991 | Shahinpoor | 52/109 |
| 5,125,205 | 6/1992 | Wichman | 52/109 X |
| 5,203,134 | 4/1993 | Sorenson et al. | 52/109 X |
| 5,275,188 | 1/1994 | Tsai | 52/109 X |

FOREIGN PATENT DOCUMENTS

| | | |
|---|---|---|
| 53-7912 | 1/1978 | Japan . |
| 53-18815 | 6/1978 | Japan . |
| 57-192700 | 11/1982 | Japan . |
| 58-44721 | 10/1983 | Japan . |
| 63-255435 | 10/1988 | Japan . |

*Primary Examiner*—Wynn E. Wood

*Attorney, Agent, or Firm*—Dennison, Meserole, Pollack & Scheiner

[57] ABSTRACT

A framework structure comprises three or more primary constituent units each including two rigid diagonal members constituting the diagonals of a quadrangular lateral face of a solid and coupled together for relative rotation about a first rotation axis passing through the intersection of the diagonals. The primary constituent units are coupled to one another via second and third rotation axes into a ring-like form. A more complicated framework structure can be obtained by using a plurality of these framework structures as secondary constituent units which are coupled to one another with a coupler or a primary constituent unit used in common between adjacent ones of the secondary constituent units. The framework structure can provide one which is capable of being expanded and contracted in three-dimensional directions and which has rigidity in any directions.

29 Claims, 70 Drawing Sheets

SECONDARY CONSTITUENT UNIT OF TYPE 2

SECONDARY CONSTITUENT UNIT OF TYPE 3

SECONDARY CONSTITUENT UNIT OF TYPE 4

SECONDARY CONSTITUENT UNIT OF TYPE 5

FRAMEWORK STRUCTURE

TECHNICAL FIELD

This invention relates to framework structures which can be utilized for antennas, power transmission line poles, net support poles, illumination towers, advertisement towers and other poles and towers; building structures, furniture, tents, space structures and like structures, and temporary construction works therefore; bridges and like structures, and temporary construction works therefore; and various toys.

PRIOR ART

Prior art structures which are capable of being expanded and contracted include the following structures (a) to (f):

(a) Telescopes and the like, formed with cylindrical members telescopically coupled together;

(b) Foldable knives and the like, which can be pivotally folded and unfolded;

(c) Umbrellas and the like, which have frameworks capable of being radially expanded from a point;

(d) Balloons and the like, which use a combination of a filmy inflatable element and an inflating fluid supplied into and discharged from the inflatable element for their inflating and shrinking;

(e) Inclined pivotal lattice structures utilized for magic hands, gate doors, hangers, etc.; and (f) Structures which are obtained by juxtaposing the structures in (d) and utilized for foldable chairs, jacks, etc.

PROBLEMS IN THE PRIOR ART

The above prior art structures, however, have the following drawbacks. The structures in (a) are capable of being only telescoped, i.e., developed form only uni-dimensionally. The structures in (b) cannot readily transmit a moment via a hinge. Besides, theoretically they are readily subject to buckling when they experience compressive forces.

The structures in (c) are capable of being changed in form from a uni-dimensional one to a three-dimensional one. However, they are subject to concentration of exerted force at their radial center. This means that they cannot readily transmit moment as a framework.

The structures in (d) are capable of being inflated and shrunk three-dimensionally and have high degree of freedom of inflating and shrinkage. However, they are scarcely rigid because they have resort to fluid for their inflating and shrinkage. The structures in (e) are for two-dimensional development, and their rotary parts are weak to stresses applied thereto from different planes. Therefore, the scope of their utility is limited.

The structures in (f) use structures in (e) limitatively in side-by-side stationary arrangements in such a manner that they are three-dimensionally rigid. Thus, they are applicable to jacks, chairs, etc. which can withstand three-dimensionally exerted loads. Theoretically, however, they cannot be pin-coupled structures in the direction of the side-by-side arrangement. Therefore, they are only rigid for moment transmission. In other words, the degree of freedom of their development is low, and they can only be brought from a two-dimensional form to a three-dimensional one and vice versa.

It can be summarized that the above prior art structures permit only uni-dimensional or two-dimensional form changes except for the structures utilizing fluid, and they are weak to forces exerted thereto from different planes. It may be desired to reinforce rigidity in an out-of-plane direction. Such an arrangement, however, results in a sacrifice that folding is impossible in that direction. Generally, it has been impossible to satisfy both the rigidity or mechanical strength and the degree of freedom of expansion and contraction.

OBJECTS OF THE INVENTION

The invention seeks to overcome the drawbacks discussed above in the prior art structures in (e) and (f) by permitting three-dimensional development. Specifically, it is an object of the invention to provide a framework structure which is capable of being expanded and contracted from a uni-dimensional one to a two-dimensional or three-dimensional one and vice versa, which provides high mechanical strength as a three-dimensional torus framework structure with suitable provision of tension elements, and which has high degree of freedom of development, such as expansion and contraction, and in which a plurality of basic structural units are combined such that it can undergo a uni-dimensional or two-dimensional development to a tower-like, vault-like or dome-like intermediate form without loss of rigidity.

DISCLOSURE OF THE INVENTION

A framework structure according to the invention comprises a plurality of primary constituent units each including two rigid diagonal members constituting the diagonals of a quadrangular lateral face of a solid, at least one of two opposed side pairs of the quadrangular lateral face being parallel, the two diagonal members being coupled together for relative rotation about a first rotation axis passing through the intersection of the diagonals, the primary constituent units being coupled to one another in a ring-like fashion by coupling an end of each diagonal member in each primary constituent unit by a coupler to an associated end of a diagonal member of an adjacent primary constituent unit, wherein the coupler has a plurality of coupling members coupled together for relative rotation about a second rotation axis, an end of one of the diagonal members being coupled to each of the coupling members for rotation about a third rotation axis parallel to the first rotation axis, adjacent ones of the primary constituent units being thereby coupled together about the second rotation axis.

Specifically, according to the invention each of the primary constituent units includes two diagonal members constituting the diagonals of a square or rectangular lateral face of a solid, and the first rotation axis of each primary constituent unit divides the segment of each of its diagonal members between the two third rotation axes with a ratio of 1:1. In addition, each of the primary constituent units includes two diagonal members constituting the diagonals of an isosceles trapezoidal lateral face of a solid, and the first rotation axis of each primary constituent unit divides the segment of each of its diagonal members between the two third rotation axes with an equal ratio, the large and the small parts of the division ratio being disposed in the same orientation. Further, each of the primary constituent units includes two diagonal members constituting the diagonals of an isosceles trapezoidal lateral face of a solid, and the first rotation axis of each primary constituent unit divides the segment of each of its diagonal members between the two third rotation axes with an equal ratio, the large and the small parts of the division ratio being disposed in the reverse orientation, alternately. Furthermore, each of the primary constituent units includes two diagonal members constituting the diagonals of an isosceles trapezoidal lateral face of a solid, and the first rotation axis of each primary constituent unit divides the segment of each of its diagonal members between the two third rotation axes with two different ratios, the primary constituent unit with the two different ratios of division being coupled together alternately.

A framework structure according to the invention comprises a plurality of secondary constituent units each constituted by one framework structure the secondary constituent units being coupled together in the direction of an axis passing through the center thereof or in the direction perpendicular to an axis passing through the center thereof or in both of these directions with couplers used in common or with a primary constituent unit used in common between adjacent ones of the secondary constituent units.

A framework structure according to the invention comprises four different kinds of secondary constituent units constituted by respective framework structures the secondary constituent units of a plurality of selected kinds among the four different kinds being coupled to one another in the direction of an axis passing through the center thereof or in the direction perpendicular to an axis passing through the center thereof with couplers used in common or with a primary constituent unit used in common between adjacent ones of the secondary constituent units.

A framework structure according to the invention comprises four different kinds of secondary constituent units constituted by respective framework structures adjacent ones of the secondary constituent units of a selected kind or a plurality of selected kinds among the four different kinds being coupled together via a pair of couplers coupled together for relative rotation about a fourth rotation axis perpendicular to second rotation axes of the pair couplers, adjacent primary constituent units being disposed between the two adjacent secondary constituent units and coupled together for relative rotation about the fourth rotation axis.

A framework structure according to the invention comprises a polyhedron with all or some of lateral faces thereof each constituted by a framework structure, the framework structures being disposed with their bases aligned with each other, adjacent ones of the framework structures being coupled together via adjacent couplers coupled together for relative rotation about a fifth rotation axis.

A framework structure according to the invention comprises a plurality of primary constituent units each including two rigid diagonal members constituting the diagonals of a quadrangular lateral face of a solid, at least one of two opposed side pairs of the quadrangular lateral face being parallel, the two diagonal members being coupled together for relative rotation about a first rotation axis passing through the intersection of the diagonals, the primary constituent units being coupled to one another in a ring-like fashion by coupling an end of each diagonal member in each primary constituent unit by a coupler to an associated end of a diagonal member of an adjacent primary constituent unit, wherein some of the couplers each include a first coupling member coupled to the associated diagonal member for relative rotation about a seventh rotation axis extending in the axial direction of the associated diagonal member and a second coupling member coupled to the first coupling member for rotation about a sixth rotation axis perpendicular to the seventh rotation axis.

A framework structure according to the invention comprises a plurality of secondary constituent units each constituted by a framework structure, the secondary constituent units being coupled together with a plurality of primary constituent units used in common between adjacent ones of them, the secondary constituent units each disposed on each or some lateral faces of a polyhedron in a developed form of the framework structure.

A framework structure according to the invention, includes an additional feature in the framework structure wherein a tension element is passed between mated ends of the two diagonal members of each primary constituent units such as to prevent relative rotation of the two diagonal members when an external force is exerted to the structure, thus making the structure rigid.

A framework structure according to the invention as set forth in any one of claims 1 to 24, wherein a wire is passed as a tension element around wire passing members provided on mated ends of the two diagonal members of a primary constituent unit or on two coupling members, the wire being capable of being secured at its trailing end to a diagonal member or to a coupling member while its leading end is secured in a pulled state to prevent relative rotation of the two diagonal members or the two coupling members when an external force is exerted to the structure, thus making the structure rigid A framework structure according to the invention comprises the framework structure wherein at least two wires are passed as tension elements around wire passing members provided on mated ends of the two diagonal members of a primary constituent unit or on two couplers such that one of the wires is led along a route for expansion and that another one of the wires is led along a route for contraction, the structure being expanded into a two-dimensional form by pulling the wire led along the route for expansion, the structure being contracted into a uni-dimensional form by pulling the wire led along the route for contraction.

A framework structure according to the invention comprises a framework structure wherein the diagonal members in each primary constituent unit are made from pipes, the wire or wires being led through the pipes.

PRINCIPLES UNDERLYING THE INVENTION

The framework structure according to the invention comprises a plurality of primary constituent elements or units U each, as shown in FIGS. 48(A) to 48(D), including two bar-like rigid diagonal members constituting the diagonals of a quadrangular lateral face of a solid such as a prism and a pyramid frustum, in which at least one of two opposed side pairs of the lateral face are parallel. In each primary constituent unit U of the framework structure, the pair diagonal members u of each lateral face are coupled together for relative rotation in the form of letter X at the intersection of the diagonals. The diagonal members u may be made of metals, wood, resins, glass, and like materials. The intersection of diagonals noted above is hereinafter referred to as "first rotation axis P1" of the primary constituent unit U.

According, to the invention, in the case of a triangular prism or a triangular pyramid frustum, three primary constituent units U are coupled to one another in a ring-like fashion such that each unit U is located on each lateral face. In the case of a quadrangular prism or a quadrangular pyramid frustum, four primary constituent units U are coupled to one another likewise. In these framework structures, adjacent primary constituent units U, i.e., the associated ends of the diagonal members u of the adjacent primary constituent units U, are coupled to one another by couplers J as shown in a developed form in FIG. 49.

FIG. 48(A) shows a triangular prism. FIG. 48(B) shows a quadrangular prism. FIG. 48(C) shows a triangular pyramid frustum. FIG. 48(D) shows a quadrangular pyramid frustum. A prism or a pyramid frustum having three base angles is advantageous from a dynamic point of view. However, the invention is applicable to a prism or a pyramid frustum having four or more base angles as well. That is, the prism or pyramid frustum may be quadrangular, pentangular, and further multangular with greater numbers of base angles as well.

Generally, a prism is a polyhedron with a top and a base lying in parallel planes and with all the lateral faces being parallelograms (including squares and rectangles, the same being applied hereinafter). According to the invention, however, the term "prism" has a broader meaning; it covers a solid having non-parallel base a and top b and quadrangular (i.e., trapezoidal) lateral faces with only one of the two opposed side pairs being parallel, as shown in FIG. 47(A).

Generally and also according to the invention, the pyramid frustum is a solid which is obtained by cutting away a top portion of a prism along a plane parallel to the base a, as shown in FIG. 47(B). In other words, the base a of the pyramid frustum and the cut face (top) b thereof are parallel and similar to each other. Again in this case, the lateral faces are each quadrangular, i.e., trapezoidal, with only one of the two opposed side pairs being parallel. In a pyramid frustum in which the base a and the top b are not parallel, none of opposed sides are parallel. This case of solid is outside the subject matter of the invention.

From the foregoing, it can be appreciated that the solids that belong to the subject matter of the invention are required to have quadrangular lateral faces with at least one of the two opposed side pairs being parallel, i.e., have trapezoidal lateral faces (with one parallel opposed side pair) or parallelogrammic lateral faces (with two parallel opposed side pairs).

As an example of solid which is relatively easy to understand, a triangular pyramid frustum as shown in FIG. 50, will now be considered, which has parallel equilateral triangular bases, or base and top, with the circumcircle centers thereof connected to each other by a perpendicular line. In this case, the three lateral faces are congruent isosceles trapezoids as mentioned before.

A structure A is formed by three primary constituent units U1, U2 and U3 provided respectively on the three lateral faces of the above triangular pyramid frustum. The primary constituent units U1, U2 and U3 include diagonal members u1, u2 and u3 which constitute the diagonals of the isosceles trapezoids and thus have the same length. The pair diagonal members are coupled together for relative rotation at the intersection of the diagonals, i.e., about a first rotation axis P1, in the form of letter X.

The three primary constituent units U1, U2 and U3 are coupled to one another by couplers J into a ring-like form. More specifically, as shown in the drawing, the primary constituent units U1 and U2 are coupled together by couplers J12, the primary constituent units U2 and U3 are coupled together by couplers J23, and the primary constituent units U3 and U1 are coupled together by couplers J31. The six couplers J (J12, J23 and J31) have the same structure. Specifically, as shown in FIG. 52, each coupler J (i.e., J12, J23 or J31) has two coupling parts Ja which overlap adjacent lateral faces of the triangular pyramid frustum and which are coupled together for relative rotation about a second rotation axis P2. Here, the second rotation axis P2 is considered as conforming to each of the intersections L12, L23 and L31 of adjacent lateral faces. An end of each of the diagonal members u1, u2 and u3 of the primary constituent units U1, U2 and U3 is pin-coupled for rotation to each of the coupling parts Ja of the coupler J. The rotation axis of the end of the diagonal member u (i.e., the center of the pin-coupling) is hereinafter referred to as "third rotation axis P3". The third rotation axis P3 are parallel to the first rotation axes P1.

As described above, the structure A comprises three primary constituent units U1, U2 and U3 coupled to one another by the couplers J into a ring-like form, the primary constituent units each including the pair rigid diagonal members u constituting the diagonals of the isosceles trapezoidal lateral face of the triangular pyramid frustum and coupled together by pin-coupling for relative rotation about the first rotation axis P1 (i.e., passing through the diagonal intersection). Each coupler J has a total of three rotation axes, i.e., one second rotation axis P2 and two third rotation axes P3. Two adjacent primary constituent units U are coupled together for relative rotation about a second rotation axis P2. Each diagonal member u has each end pin-coupled about a third rotation axis P3 to the corresponding lateral face of the triangular pyramid frustum. The structure A thus constitutes a three-dimensional torus which is formed by coupling the primary constituent units U to one another by pin-coupling about the second and third rotation axes P2 and P3, the primary constituent units U each being formed by coupling the pair diagonal members u together by pin-coupling for relative rotation about the first rotation axis P1.

The motion of the structure A will now be considered.

As shown in FIG. 51, in the case where the length ratio of the upper side ab to the lower side cd of the isosceles trapezoid abcd of the triangular pyramid frustum is μ, i.e., with lcd : lab=1:μ, each of the pair diagonal members u always divides the length of the other in a ratio of 1:μ. In other words, in each primary constituent unit U, the first rotation axis P1 divides the length of each of the two diagonal members u in a ratio of 1:μ. This ratio is hereinafter referred to as "division ratio μ of diagonal member u". This means that with each diagonal member, a relation lD:lU=1:μ is satisfied, where lD is the length of the segment between the first rotation axis P1 and the lower third rotation axis P3, and lU is the length of the segment between the first rotation axis P1 and the upper third rotation axis P3.

Assuming lD=1 (that is, lu=μ) and the intersection angle between the two diagonal members u to be θ, the height h of the trapezoid and the lengths lac and lbd of the non-parallel sides ac and bd are given as:

$$h=(1+\mu)\sin(\theta/2)$$

$$lcd=2\cos(\theta/2)$$

$$lab=\mu\cdot lcd=2\mu\cos(\theta/2)$$

$$lac=lbd=\mathrm{SQR}[\{(1+\mu)\sin(\theta/2)\}^2+\{(1-\mu)\cos(\theta/2)\}^2].$$

Assuming one half the internal angle of the equilateral triangular bases of the triangular pyramid frustum to be η(=30°) the height H of the triangular pyramid frustum can be expressed as follows:

$$H=\mathrm{SQR}[\{(1+\mu)\sin(\theta/2)\}^2-\{(1-\mu)\cos(\theta/2)\tan\eta\}^2].$$

When the structure A assumes a two-dimensional expanded form, H=0. Then, from the above equation, the following equation can be obtained:

$$\tan(\theta/2)=(1-\mu)/(1+\mu)\cdot\tan\eta$$

Thus, assuming the mutual division ratio of the diagonal members u to be μ=0.5, the intersection angle θ is about 21.8° from the above equations. This mathematically means that when the intersection angle θ between the two diagonal members u becomes about 21.8°, the structure A assumes a two-dimensionally expanded form, that is, it is folded into a planar form with the base, top and three lateral faces of the triangular pyramid frustum lying in the same plane. This form of the structure will be hereinafter referred to as the "most expanded form".

When the intersection angle θ becomes 180°, the structure A assumes a uni-dimensionally contracted form in which the distance between the base and top of the triangular pyramid frustum is maximum, that is, it is contracted to a substantially straight form. This uni-dimensionally contracted form of the structure A is hereinafter referred to as the "most contracted form".

As described above the structure A is in the two-dimensional form when the intersection angle θ in the primary constituent units U satisfies the above relations, and is brought to the uni-dimensional form when θ becomes 180°. The structure can three-dimensionally undergo continuous expansion and contraction as the intersection angle θ between the two extremes changes.

In the case where a compressive force, for instance a gravitational force, may be exerted to the top and/or the base of the above framework structure having the diagonal members coupled together in a ring-like form, a tension element is effectively provided to the top and/or the base of the structure for the stabilization thereof. In the converse case where a tensile force is exerted to the top and/or the base of the framework structure, or where compressive forces are exerted to the lateral faces thereof, tension elements are effectively provided such that they extend in the edge directions of the structure. In the case where compressive or tensile forces may be exerted in any of the above directions, tension elements are effectively provided with respect to both the top/bottom direction and the edge direction. In the case where a vertical compressive force is exerted to the base or the bottom as shown in FIGS. 48(A) and 48(B), tension elements may suitably be provided along the sides indicated by triangle marks for the stabilization purpose. In the case where a vertical tensile force may be exerted to the base and the top, tension elements are effectively provided along the sides indicated by circle marks for the same purpose. The tension elements may be iron bars, wires, guts, glass fibers, panel glass, films, springs, electromagnetic forces, etc. Any of the framework structures with the above tension elements provided in the above ways, constitutes a three-dimensional torus which is highly rigid and which has high mechanical strength. For the stabilization purpose, action of rigid members may further be provided on the localities as indicated by the triangle marks. This arrangement permits stabilization of the structure against both the tensile and compressive forces.

The features of the invention as described above are obtainable not only with the structure A which comprises the three primary constituent units U1, U2 and U3 constituting the lateral faces of a triangular pyramid frustum, but also with prisms and pyramid frustums having greater base angle numbers. This is true not only with prisms and pyramid frustums but also with solids of other shapes, such as those shown in FIGS. 53(A) to 53(D) obtained by cutting away a top portion of a wedge-shaped solid or an obelisk along a plane parallel to the base, so long as the quadrangular lateral faces each have at least one parallel opposed side pair.

By coupling together four isosceles trapezoids into a ring-like form with the short and the long sides all disposed in the same orientation at the top and the bottom, respectively, a quadrangular pyramid frustum can be obtained. However, by coupling together the trapezoids such that the short and the long sides thereof are disposed in the reverse orientation at the top and the bottom, alternately, a shape as shown in FIG. 53(A) is formed. This shape corresponds to a solid obtained by cutting away a top portion of a wedge-like solid, and it can provide higher mechanical strength than a pyramid frustum. In this case, the base angle number is even. At any rate, it is possible to provide a structure which, with the same angle number, is less subject to deformation and more rigid than a pyramid frustum.

In the case of an isosceles trapezoid (which may be a rectangle or a square) with diagonals having the same length, the length ratio μ between the upper and lower sides may be varied by varying the division ratio μ of the diagonal members u, i.e., by varying the position of the first rotation axis P1 (or diagonal intersection point). By coupling four primary constituent units U to one another such that the two opposed units U have the same division ratio μ of the diagonal members u and that two different division ratios μ occur alternately, a shape corresponding to a solid as shown in FIG. 53(B) is obtained, in which a top portion of an obelisk is cut away.

A solid shown in FIG. 53(C) has a hexagonal base, and is obtained by coupling together six trapezoidal faces with the short and the long sides thereof disposed in the reverse orientation at the top and the bottom, alternately. This solid is a modification of the solid shown in FIG. 53(A). A solid shown in FIG. 53(D) again has a hexagonal base, but is obtained by coupling together, into a ring-like form of circle symmetry, six primary constituent units U having different member division ratios μ. This solid is a modification of the solid shown in FIG. 53(B). Generally, a solid which is constituted by primary constituent units U with diagonal members u constituting diagonals, may be other than a prism or a pyramid frustum so long as each of the lateral faces of the solid is a quadrangle with at least one parallel opposite side pair.

Japanese Patent Publication No. 53-18815, Japanese Laid-Open Patent Publication No. 57-192700, Japanese Laid-Open Patent Publication No. 53-7912 and Japanese Laid-Open Patent Publication No. 63-255435, for instance, show techniques which are seemingly similar to the present invention. These prior art techniques, however, are quite irrelevant to the present invention in purpose, constitution, function and effect, and a person having an ordinary knowledge in the art cannot be readily obtain the invention from these prior art techniques. This is so because primarily the prior art techniques are irrelevant to any torus structure capable of being expanded or contracted. It is thus impossible to provide any structure to which mechanical strength as torus can be given in any intermediate or final stage of expansion or contraction. Besides, it is impossible to provide any structure which is capable of being developed into a variety of forms. More specifically, the technique disclosed in Japanese Patent Publication No. 53-18815 is irrelevant to any structure which is a prerequisite element of the present invention, that is, a structure with two rigid diagonal members coupled together as a pair for relative rotation about a first rotation axis. In other words, the disclosed technique is irrelevant to any torus structure (without any member rigid in any direction). Therefore, the disclosed technique cannot provide a mechanical strength sufficient to apply to large-scale building structures or the like. The publication neither shows nor suggests this prerequisite element of the invention. Japanese Laid-Open Patent Publication No. 57-192700 does not show any second rotation axis as another prerequisite element of the present invention. Although pair diagonals are shown, their intersection point is limited to their center (division ratio of $\mu=1$). This means that it is impossible to provide a structure which can be brought to various forms, such as dome-like forms, while ensuring sufficient mechanical strength. Japanese Laid-Open Patent Publication No. 53-7912 is irrelevant to any torus structure. This technique does not have any second and fourth rotation axes disclosed in the present invention, so that the development is limited only to cylindrical forms and vice versa. Japanese Laid-Open Patent Publication No. 63-255435 discloses a technique concerning plate structures. This technique, however, is irrelevant to any structure capable of being folded into a uni-dimensional structure. Besides, the technique is irrelevant to any torus structure.

BRIEF DESCRIPTION OF THE DRAWINGS

FIGS. 47(A) and 47(B) are perspective views showing examples of the solid which is the subject of the invention, in which FIG. 47(A) shows a solid obtained by cutting out a top portion of a triangular prism along a plane not parallel to the base, and FIG. 47(B) shows a solid obtained by cutting out a top portion of a triangular pyramid along a plane parallel to the base;

FIGS. 48(A) to 48(D) are perspective views showing primary constituent units constituting various solids, in which FIG. 48(A) shows primary constituent units constituting a triangular prism, FIG. 48(B) shows primary constituent units constituting a quadrangular prism, FIG. 48(C) shows primary constituent units constituting a triangular pyramid frustum, and FIG. 48(D) shows primary constituent units constituting a quadrangular pyramid frustum;

FIGS . 53(A) to 53(D) are perspective views showing other examples of the pyramid frustum and the prism, in which

FIGS. 63(A) and 63(B) show the structure of the 15th embodiment in the most contracted form, in which FIG. 63(A) is a perspective view, and FIG. 63(B) is a schematic view;

DESCRIPTION OF PREFERRED EMBODIMENTS

Figure 43:
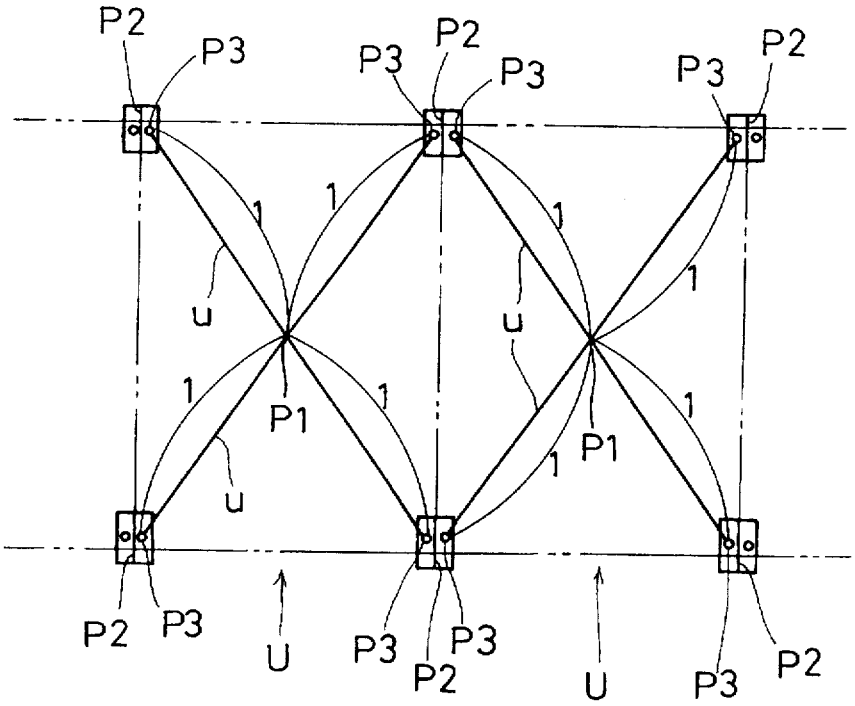
FIG. 43 is a development view showing secondary constituent units of type 2 in a structure according to the invention.

FIGS. 43 to 46 are schematic developed views showing framework structures (hereinafter referred to merely as structures) FIG. 43 shows an example of a structure comprising a plurality of primary constituent units U each including pair diagonal members u constituting the diagonals of a rectangular lateral face of a polygonal prism and pin-coupled together for relative rotation about a first rotation axis P1 passing through the intersection of diagonals. The first rotation axis P1 in each primary constituent unit U thus divides each of the diagonal members u with a ratio of 1:1 (division ratio:$\mu$=1). This structure will hereinafter be referred to as "secondary constituent unit of type 2".

Figure 44:
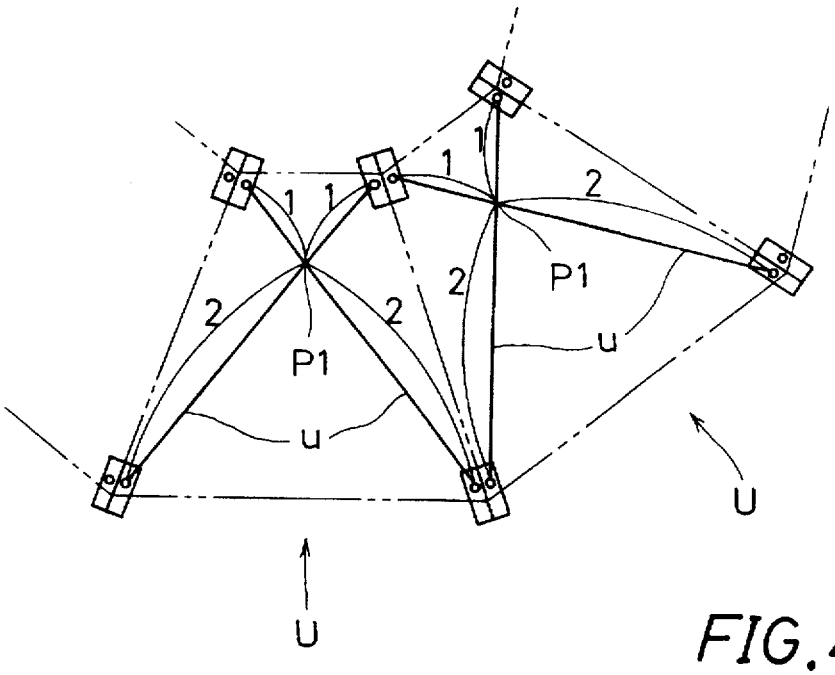
FIG. 44 is a development view showing secondary constituent units of type 3 in a structure according to the invention.

FIG. 44 partly shows an example of a structure comprising a plurality of primary constituent units U each including pair diagonal members u constituting the diagonals of an isosceles trapezoid lateral face of a solid and pin-coupled together for relative rotation about a first rotation axis P1 passing through the intersection of diagonals. The first rotation axis P1 of each primary constituent unit U thus divides each diagonal member u not with a ratio of 1:1 but with a ratio of, for instance, 2:1 (μ=0.5) as shown. This structure will be hereinafter referred to as "secondary constituent unit of type 3".

Figure 45:
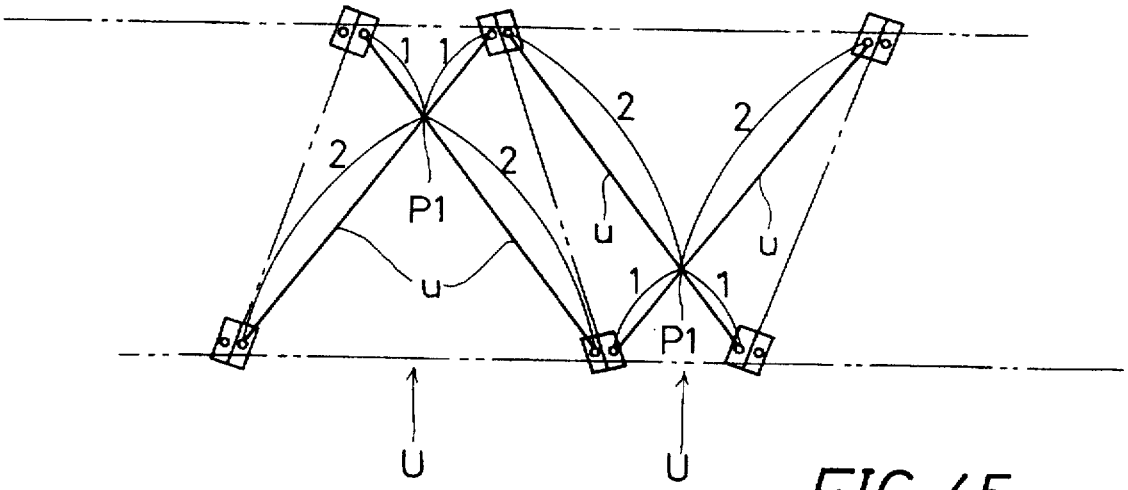
FIG. 45 is a development view showing secondary constituent units of type 4 in a structure according to the invention.

FIG. 45 partly shows an example of a structure like the secondary constituent unit of type 2, this structure comprises a plurality of primary constituent units U each including pair diagonal members constituting the diagonals of an isosceles trapezoidal lateral face of a solid. In this case, however, the short and the long sides of the trapezoidal lateral faces are disposed in the reverse orientation at the top and the bottom, alternately. That is, when the ratio of division by the first rotation axis P1 in the left one of two adjacent primary constituent units U shown in the drawing is 2:1 (μ=0.5), the ratio of division by the first rotation axis P1 in the right primary constituent unit U is conversely 1:2 (μ=2). This structure will be hereinafter referred to as "secondary constituent unit of type 4".

Figure 46:
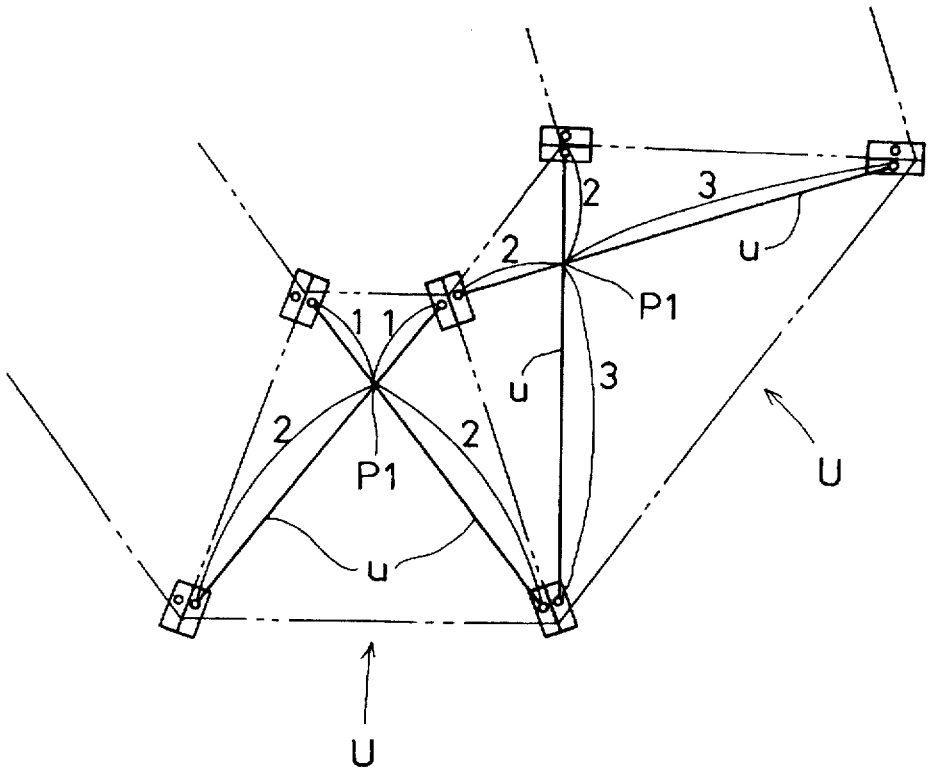
FIG. 46 is a development view showing secondary constituent units of type 5 in a structure according to the invention.
Figure 47A:
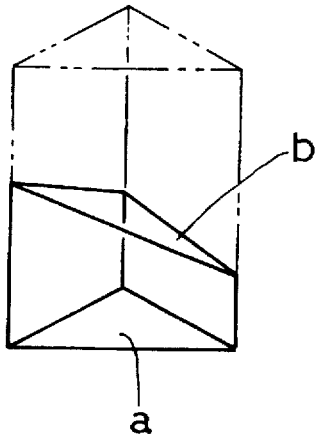
Figure 47B:
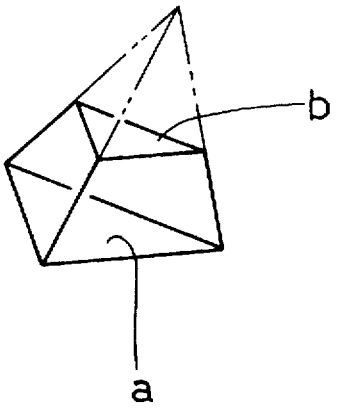

FIG. 46 partly shows an example of a structure like the secondary constituent units of types 3 and 4, this structure constitutes a solid with isosceles trapezoidal lateral faces. In this case, however, adjacent isosceles trapezoidal lateral faces have different upper or lower side lengths. In other words, like the secondary constituent unit of type 4, adjacent primary constituent units have different division ratios; for example, when the left one of two adjacent primary constituent units U shown in the drawing has a division ratio of 2:1 (μ=0.5), the right primary constituent unit U has a division ratio of 3:2 (μ=2/3). This structure will be hereinafter referred to as "secondary constituent unit of type 5". In FIG. 46, the ratios of 2:1 and 3:2 are shown as independent ratios for each of the primary constituent units.

Hereinafter, some preferred embodiments of the invention will be described, which are based on the above structures of the four different types (i.e., secondary constituent units of types 2 to 5).

First Embodiment

A first embodiment of the invention will now be described with reference to FIGS. 1 to 4.

A structure 1 of this embodiment comprises three primary constituent units U1 each including two diagonal members u constituting the diagonals of an isosceles trapezoidal lateral face of a triangular pyramid frustum. The diagonal members u in each primary constituent unit U1 are pin-coupled together in the form of letter X for relative rotation about a first rotation axis P1 passing through the intersection of diagonals. The diagonal members u are rigid bar-like members having the same dimensions. The structure 1 is thus a secondary constituent unit of type 3.

Figure 1:
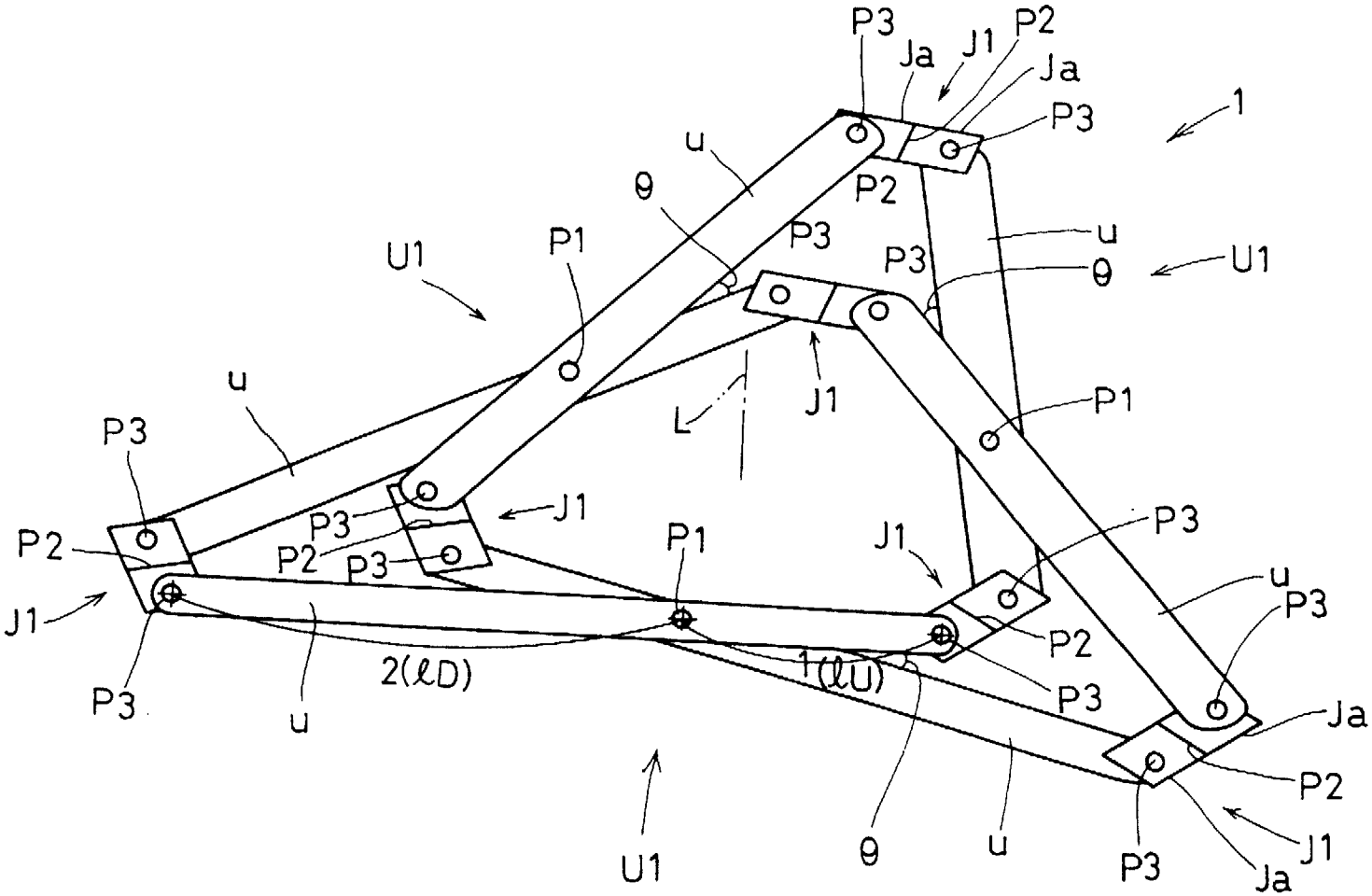
FIG. 1 is a perspective view showing a structure according to a first embodiment of the invention in the most expanded form.

The three primary constituent units U1 are coupled to one another by couplers J into a ring-like form about an axis L shown in FIG. 1. The axis L will also be referred to as an "axis L of the structure (or secondary constituent unit to be described later". The direction along the axis L is referred to merely as "height direction". Particularly, in each embodiment to be described hereinunder, when the axis L is thought to be Z axis of a three-dimensional rectangular coordinates, the X- and Y-axis directions perpendicular to the Z axis are referred to as "transversal direction" and "longitudinal direction", respectively.

The couplers J are all the same. An end of a diagonal member u in each primary constituent unit U1 is coupled by each coupler J to the associated end of a diagonal member u in an adjacent primary constituent unit U1.

Figure 2:
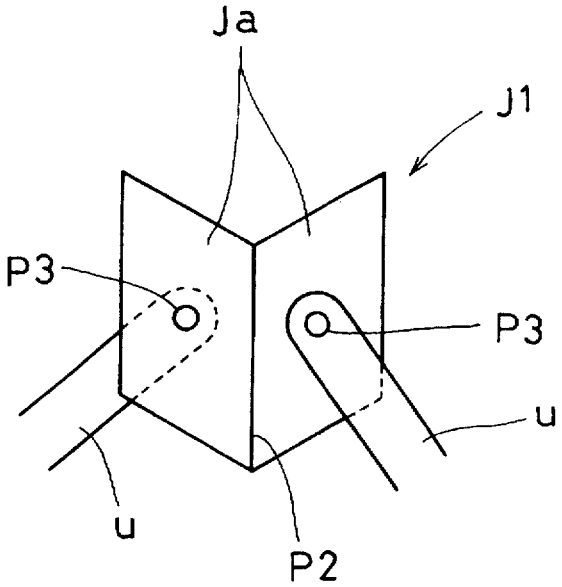
FIG. 2 is a perspective view showing a coupler of type 1.

As shown in FIG. 2, the coupler J has two coupling members Ja which are pin-coupled together for relative rotation about a second rotation axis P2. It is assumed as mentioned before that the second rotation axis P1 is coincident with a side common to adjacent lateral faces, or the intersection of the two faces, of a solid (triangular pyramid frustum). This is true as well in each of the following embodiments. In practical structures, however, the second rotation axis P2 may not be coincident with the intersection of adjacent lateral faces. This will be described later in detail.

The coupler J has a third rotation axis P3 perpendicular to each of the coupling members Ja, and each diagonal member u in each primary constituent unit U1 has each end pin-coupled to each coupling member Ja for relative rotation about each third rotation axis P3. Thus, the third rotation axis P3 is parallel to the first rotation axis P1. The coupler J which has the two coupling members Ja will be hereinafter referred to as "coupler J of type 1". Two adjacent diagonal members u are coupled together by this coupler J1 of type 1.

Here, one diagonal member u in a certain primary constituent unit U1 will be considered. Denoting the length of the segment between the third rotation axis P3 on one end side (i.e., base side of the triangular pyramid frustum) and the first rotation axis P1 by lD and the length of the segment between the third rotation axis P3 on the other end side (i.e., the top side of the triangular pyramid frustum) and the first rotation axis P1 by lU, the ratio μ of division of the diagonal members u is lU/lD. In this embodiment, μ=0.5 (lD:lU=2:1). In other words, the first rotation axis P1 in each primary constituent unit U1 divides the segment of each diagonal member u between the opposite end third rotation axes P3 with a ratio of 2:1.

In the structure 1 having the above construction, of each of the diagonal members u in each primary constituent unit U1 that constitute the diagonals of each trapezoidal lateral face of the triangular pyramid frustum, the segment between the opposite end third rotation axes P3 is divided by the first rotation axis P1 to 2:1 (division ratio:μ=0.5). Thus, when the intersection angle θ between the diagonal members u in each primary constituent unit U1 becomes about 21.8°, the structure 1 is in a two-dimensionally developed form, and each of the primary constituent units U1 lie in the same plane. This form is shown in FIG. 1.

In this specification, the intersection angle θ between the two diagonal members u does not refer to the angle between the like segments lU (or lD) of the two diagonal members u but refers to the angle between the segment lU of one diagonal member u and the unlike segment lD of the other diagonal member u. Thus, when the structure is in a two-dimensionally developed form with the minimum diagonal intersection angle θ, that is, when it is most contracted in the direction of the axis L, it is referred to be in the "most expanded form". Conversely, when it is in a form with the maximum diagonal intersection angle θ (i.e., in the form in which it is most contracted to be straight in the direction of the axis L), it is referred to be in the "most contracted form". The above is true in the following embodiments as well.

Figure 3:
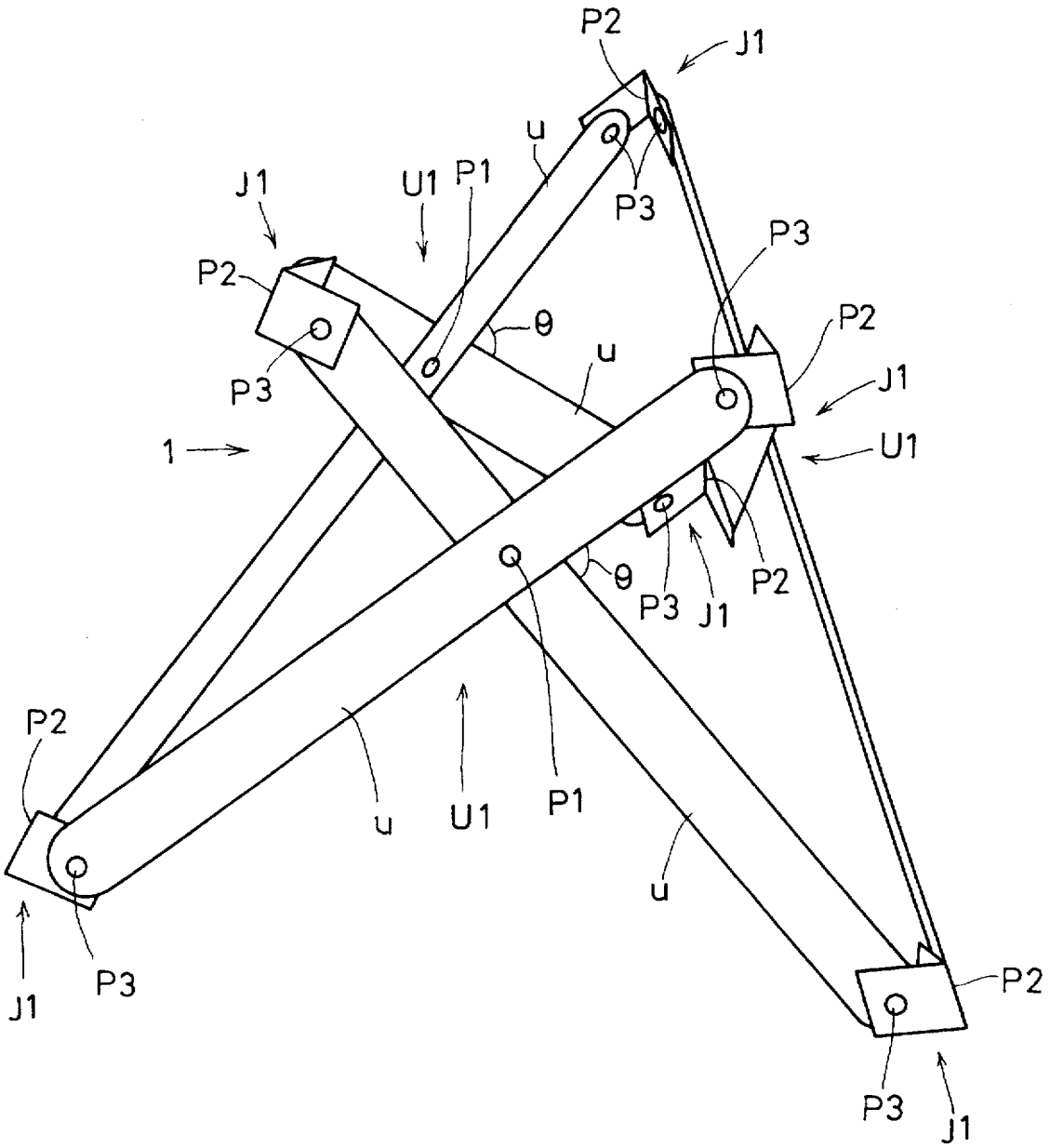
FIG. 3 is a perspective view showing the structure of the first embodiment in an intermediate expanded or contracted form.
Figure 4:
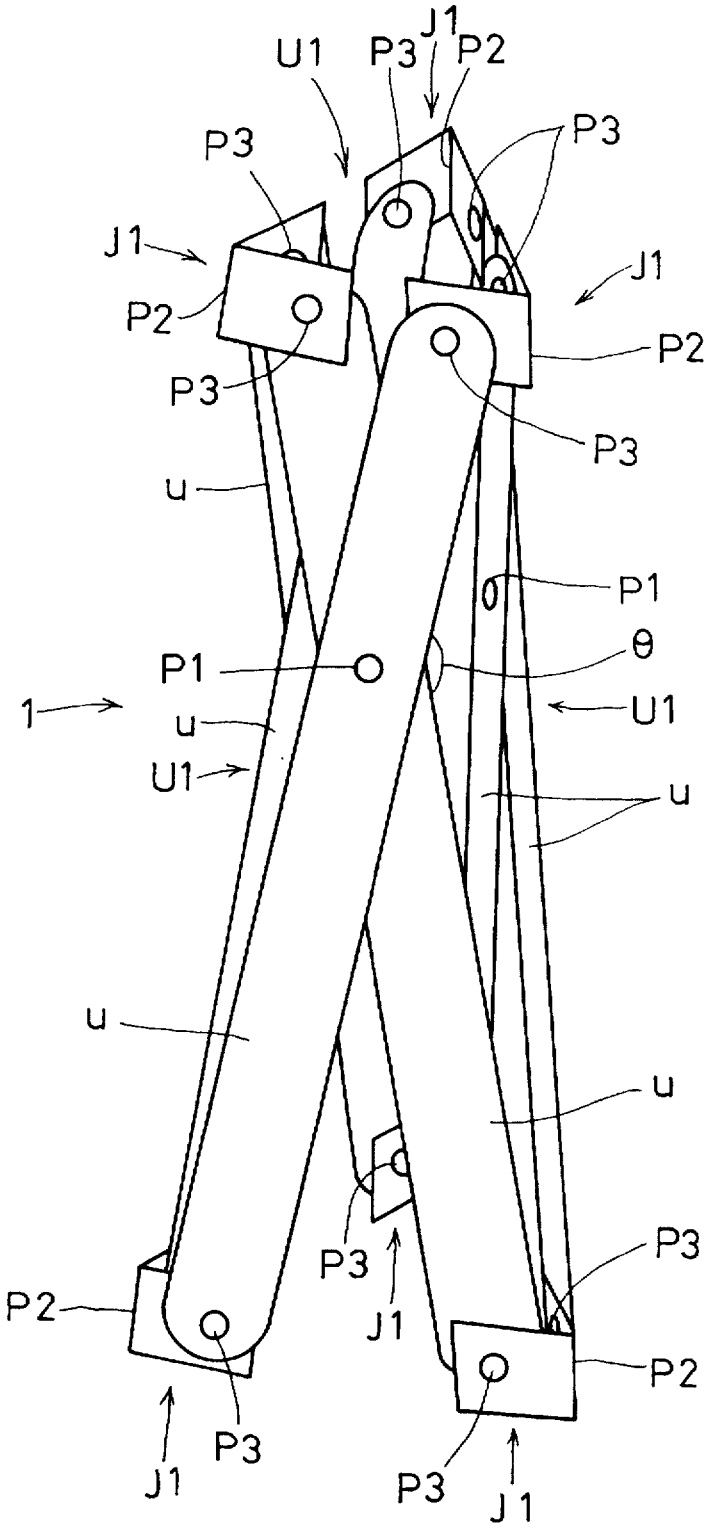
FIG. 4 is a perspective view showing the structure of the first embodiment in the most contracted form.

As the diagonal intersection angle θ is increased, each primary constituent unit U1 is contracted in a rising fashion toward a straight or uni-dimensional form, that is, the structure 1 is contracted from the most expanded form shown in FIG. 1 three-dimensionally in the axis L direction. In other words, this results in an increase of the height H of the triangular pyramid frustum. When the diagonal intersection angle θ in each primary constituent unit U1 approaches maximum 180°, each primary constituent unit U1 is most expanded, that is, the structure 1 assumes the most expanded form as shown in FIG. 4. FIG. 3 shows the structure 1 in an intermediate form between the two extreme forms.

If the third rotation axes P3 on the same side of the two diagonal members u in each primary constituent unit U1 become perfectly coincident, the diagonal intersection angle θ becomes 180°. Mathematically, this form is the perfectly uni-dimensionally contracted form. However, the couplers J1 are ultimately brought into contact with each other. Therefore, the diagonal intersection angle does not actually become 180°, that is, the structure is not perfectly uni-dimensionally contracted.

The structure 1 of the first embodiment (i.e., secondary constituent unit of type 3) is a basic one of the structures of various types according to the invention.

Second Embodiment

Figure 6:
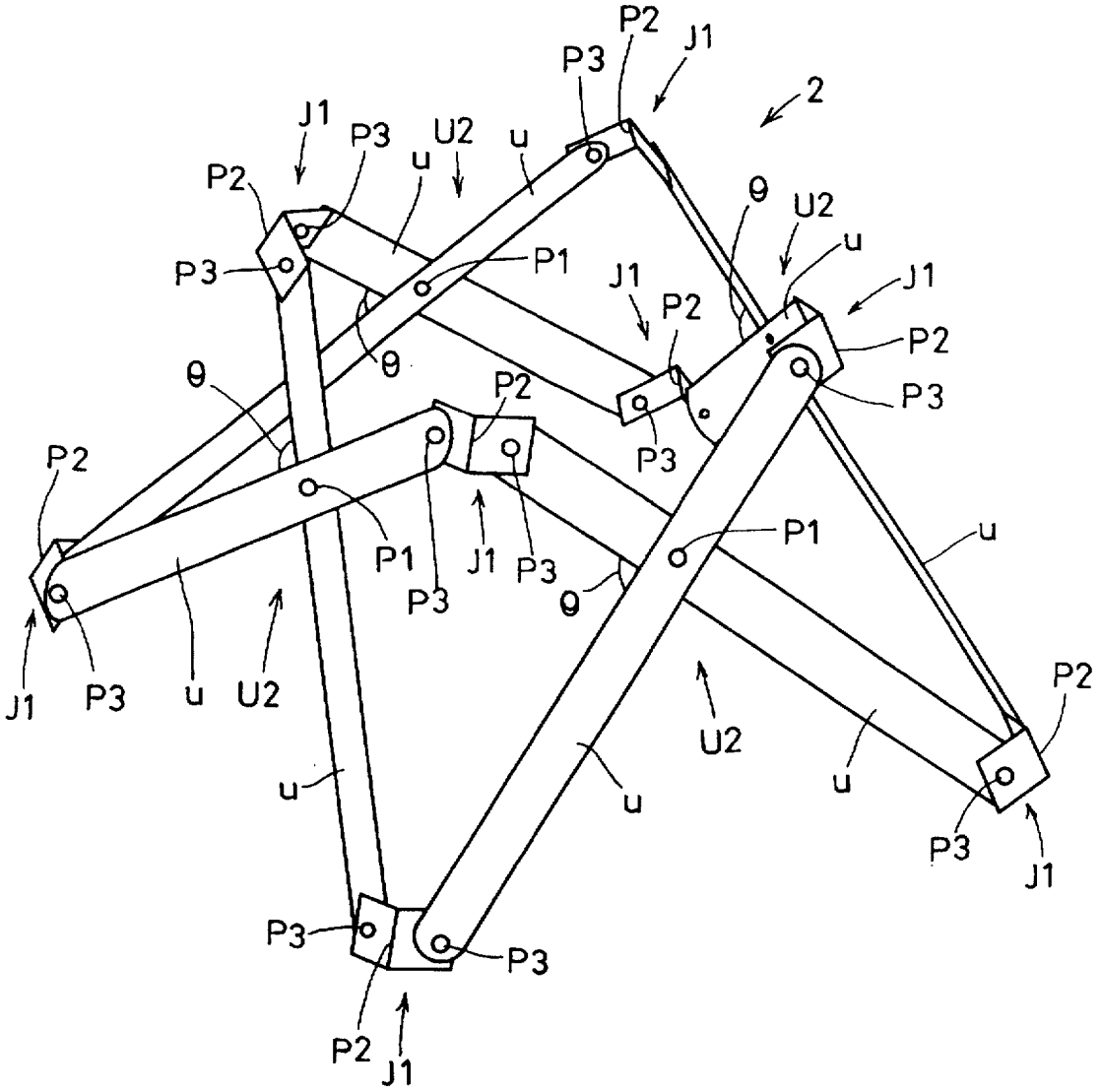
FIG. 6 is a perspective view showing the structure of the second embodiment in an intermediate expanded or contracted form.
Figure 7:
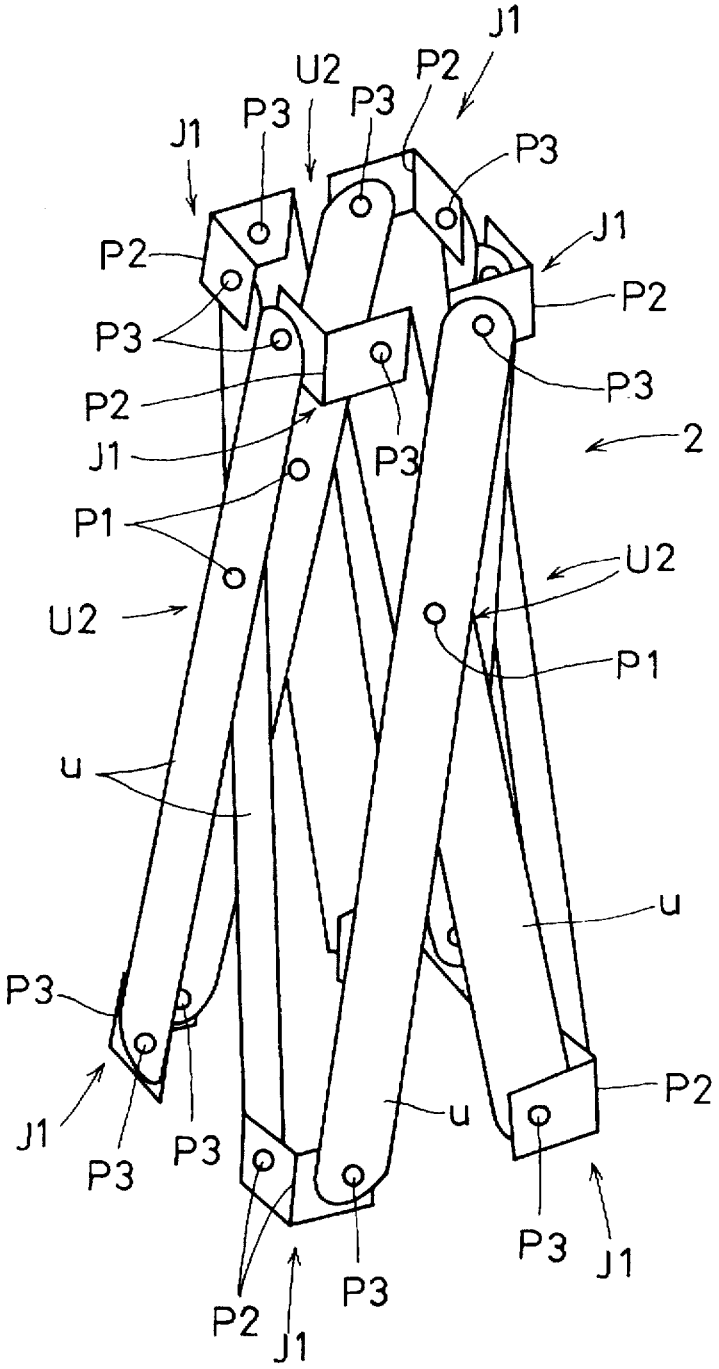
FIG. 7 is a perspective view showing the structure of the second embodiment in the most contracted form.

A second embodiment will now be described with reference to FIGS. 5 to 7.

A structure 2 of this embodiment comprises four primary constituent units U2 each including two diagonal members u constituting the diagonals of an isosceles trapezoidal lateral face of a quadrangular pyramid frustum. In this embodiment, four primary constituent units U1 like those in the first embodiment are coupled to one another into a ring-like form. Like the structure 1 of the first embodiment, adjacent primary constituent units U2 are coupled together by couplers J1 of type 1 (see FIG. 2).

Figure 5:
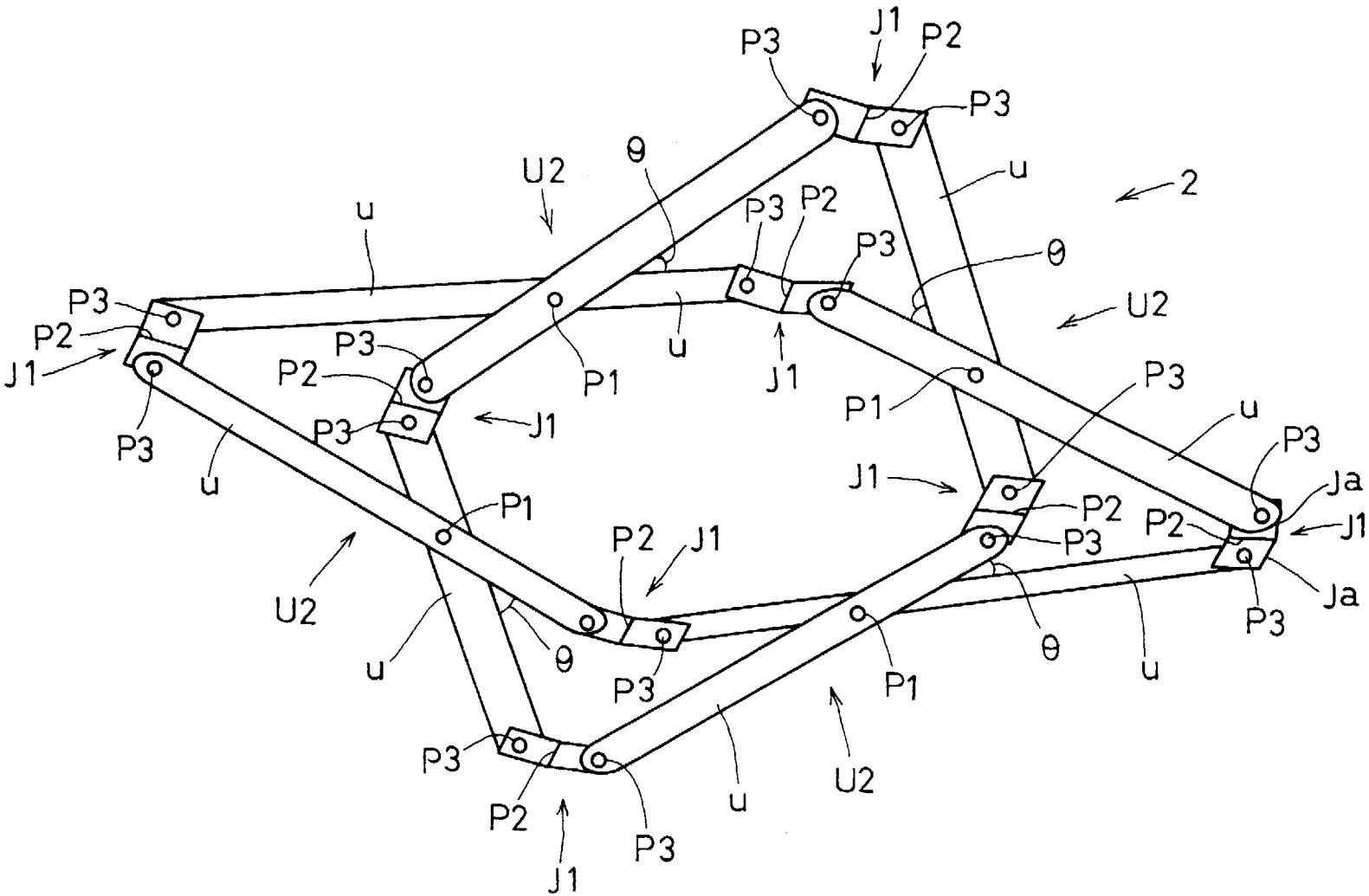
FIG. 5 is a perspective view showing a structure according to a second embodiment of the invention in the most expanded form.

This structure 2 again can be expanded into a two-dimensional form (i.e., the most expanded form) as shown in FIG. 5, in which each of the primary constituent units U2 lies in the same plane. Also, each primary constituent unit U2 is contracted in a rising fashion as the diagonal intersection angle θ is increased by external forces exerted to its diagonal members u in a direction to bring third rotation axes P3 on the same upper or lower side toward each other. FIG. 6 shows the structure 2 in an intermediate contracted form. When the third rotation axes P3 on the same side in each primary constituent unit U2 are brought to be closest to each other as shown in FIG. 7, the structure 2 assumes a form closest to the uni-dimensionally contracted form (i.e., the most contracted form). The structure 2 can be expanded and contracted three-dimensionally between the most expanded form shown in FIG. 5 and the most contracted form shown in FIG. 7.

The structure 2 (i.e., secondary constituent unit of type 3) is a basic one of the structures of various types according to the invention. The structures 1 and 2 of the first and second embodiments are examples of the invention.

Third Embodiment

A third embodiment will now be described with reference to FIGS. 8 to 11. This embodiment is an example of the invention.

A structure 3 of this embodiment comprises three secondary constituent units M31, M32 and M33 which are coupled to one another in the axis L direction, and each comprise three primary constituent units U3 each including two diagonal members u constituting the diagonals of an isosceles trapezoidal lateral face of a triangular pyramid frustum. The primary constituent units U3 in each secondary constituent unit are coupled to one another by couplers J1 of type 1 and also with couplers J2, which will be hereinafter referred to as of type 2, into a ring-like form. The three secondary constituent units M31, M32 and M33 are each a secondary constituent unit of type 3, i.e., the structure 1 of the first embodiment. These secondary constituent units M31, M32 and M33 comprise three primary constituent units U31, three constituent units U32 and three constituent units U33, respectively. However, the ratio μ of division by the first rotation axis P1 in each of the primary constituent units U31, U32 and U33, is different from that in the structure 1 of the first embodiment.

Figure 8:
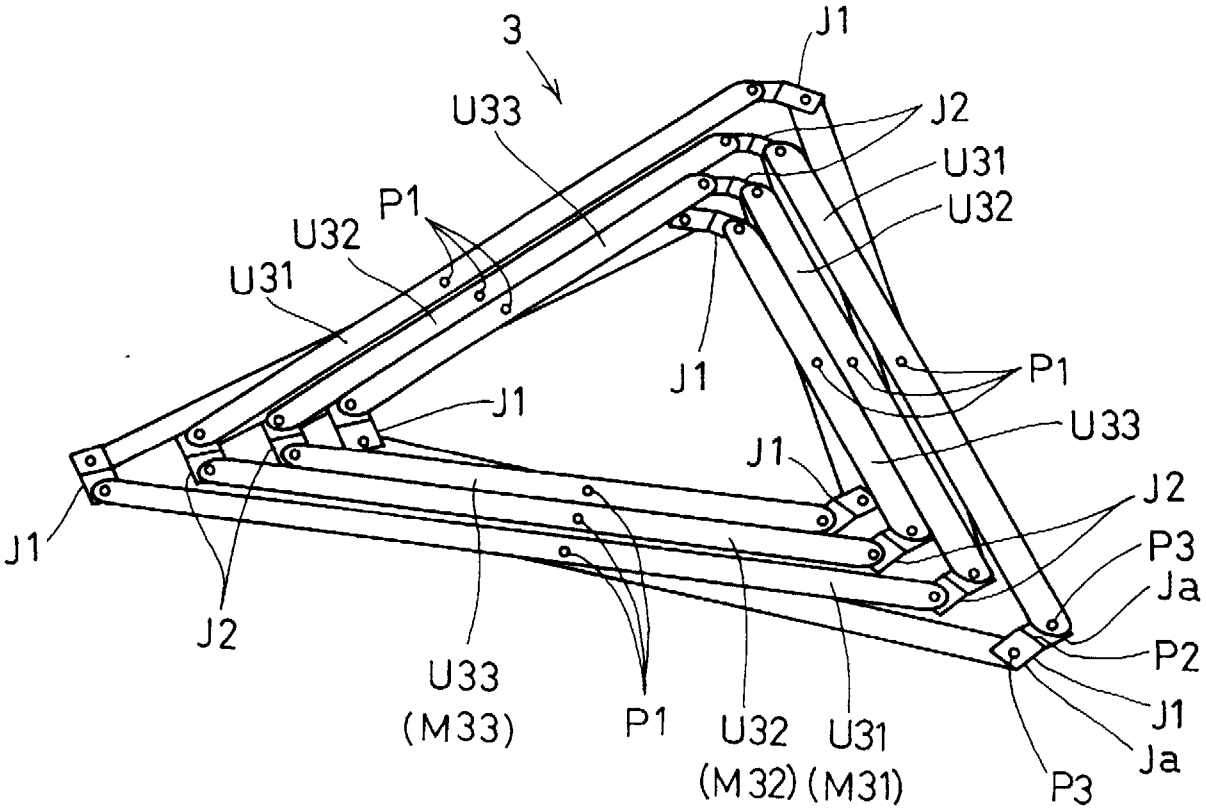
FIG. 8 is a perspective view showing a structure according to a third embodiment of the invention in the most expanded form.
Figure 9:
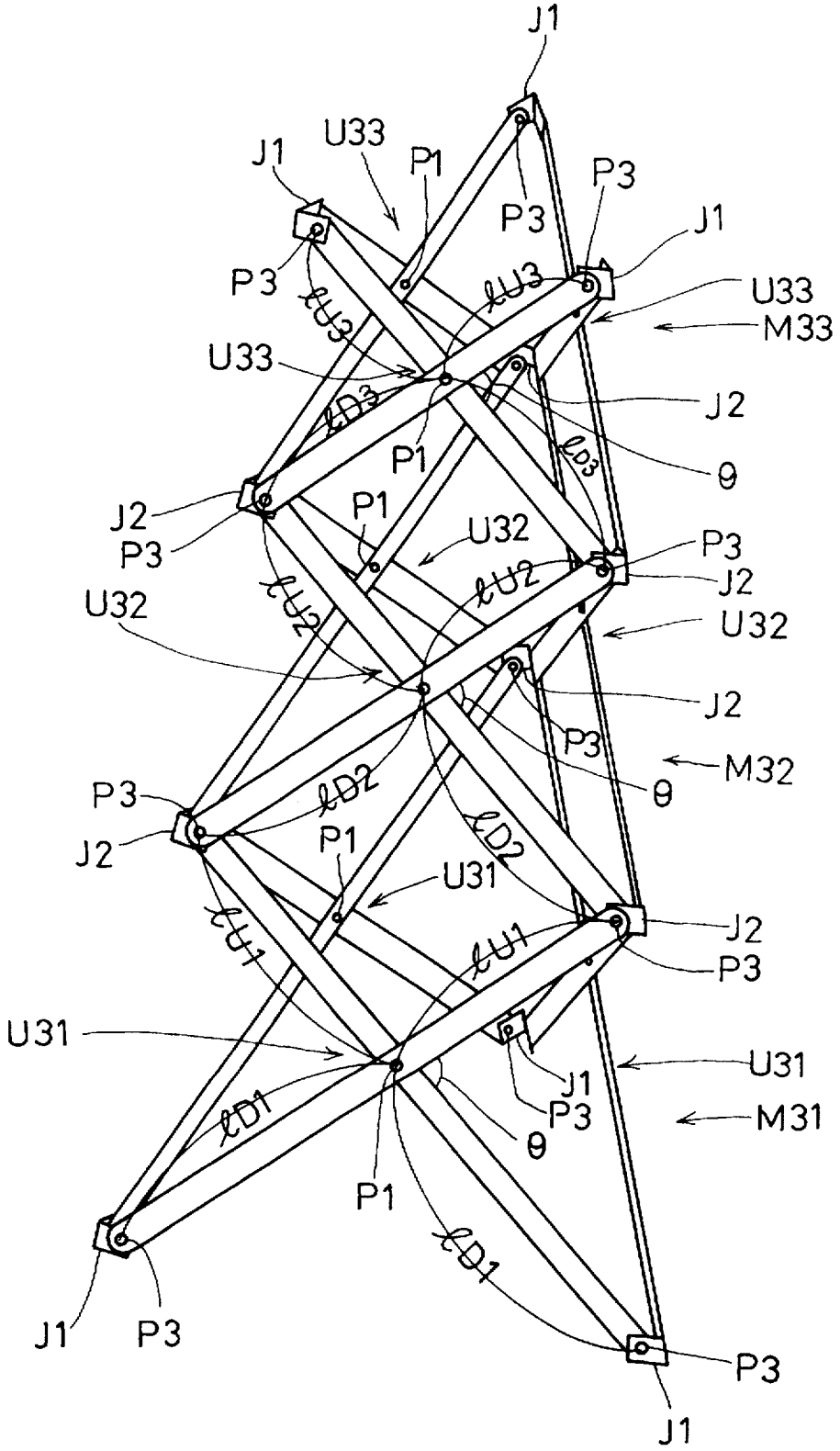
FIG. 9 is a perspective view showing the structure of the third embodiment in an intermediate expanded or contracted form.
Figure 10:
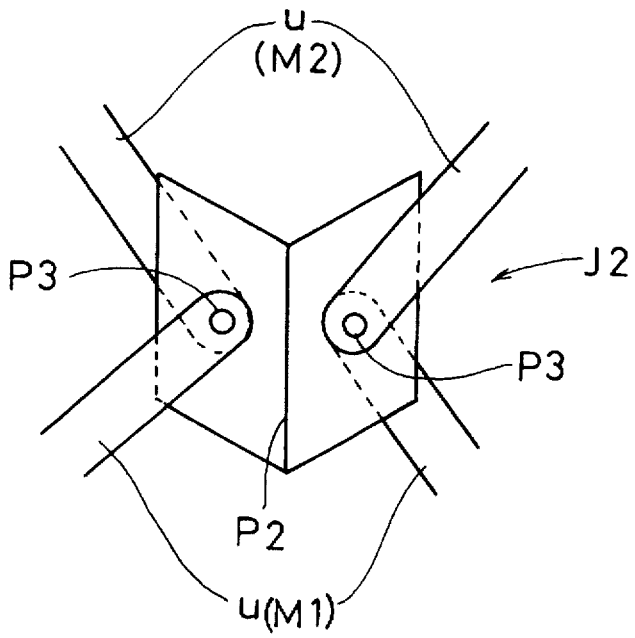
FIG. 10 is a perspective view showing a coupler of type 2.

The structure 3 is shown in its two-dimensionally expanded or most expanded form in FIG. 8, in its uni-dimensionally contracted or most contracted form in FIG. 10, and in its intermediate form between the two extreme forms in FIG. 9.

As most clearly shown in FIG. 9, secondary constituent units M31 and M32 (or M32 and M33) adjacent in the height direction (i.e., axis L direction) are coupled together by couplers J1 of type 1. These couplers will be hereinafter referred to as "couplers J2 of type 2".

As shown in FIG. 10, the coupler J2 of type 2 couples together a total of four diagonal members u, two of which are coupled together for relative rotation about one third rotation axis P3. Specifically, two diagonal members u are pin-coupled together for relative rotation about one third rotation axis P3. The three secondary constituent units M31, M32 and M33 are coupled to one another in the axis L direction with three couplers J2 of type 2, each having one second rotation axis P2 and two third rotation axes P3, used in common between adjacent ones M31 and M32 (or M32 and M33). Two or four or more secondary constituent units M may be coupled together likewise.

Referring to FIG. 9, the first rotation axis P1 in each primary constituent unit U31 in the lower secondary constituent unit M31, divides the diagonal member length between the opposite end third rotation axes P3 with a ratio in the of 1:μ, i.e., lD1:lU1=1:μ. Similarly, intermediate and upper secondary constituent units M32 and M33, lD2:lU2=lD3 : lU3=1:μ. Besides, the diagonal member length U1 in the lower secondary constituent unit M31 between the first rotation axis P1 and the upper third rotation axis P3 and the diagonal member length lD2 in the intermediate secondary constituent unit M32 between the first rotation axis P1 and the lower third rotation axis P3 are equal (lU1=lD2). Thus, a parallelogram (or a square) P1 P3 P1 P3 is defined between each primary constituent unit U31 of the lower secondary constituent unit M31 and the opposed primary constituent unit U32 of the intermediate secondary constituent unit M32. Similarly, with the intermediate and upper secondary constituent units M32 and M33, lU2=lD3, and a parallelogram (or a square) P1 P3 P1 P3 is defined between opposed primary constituent units U32 and U33.

Figure 11:
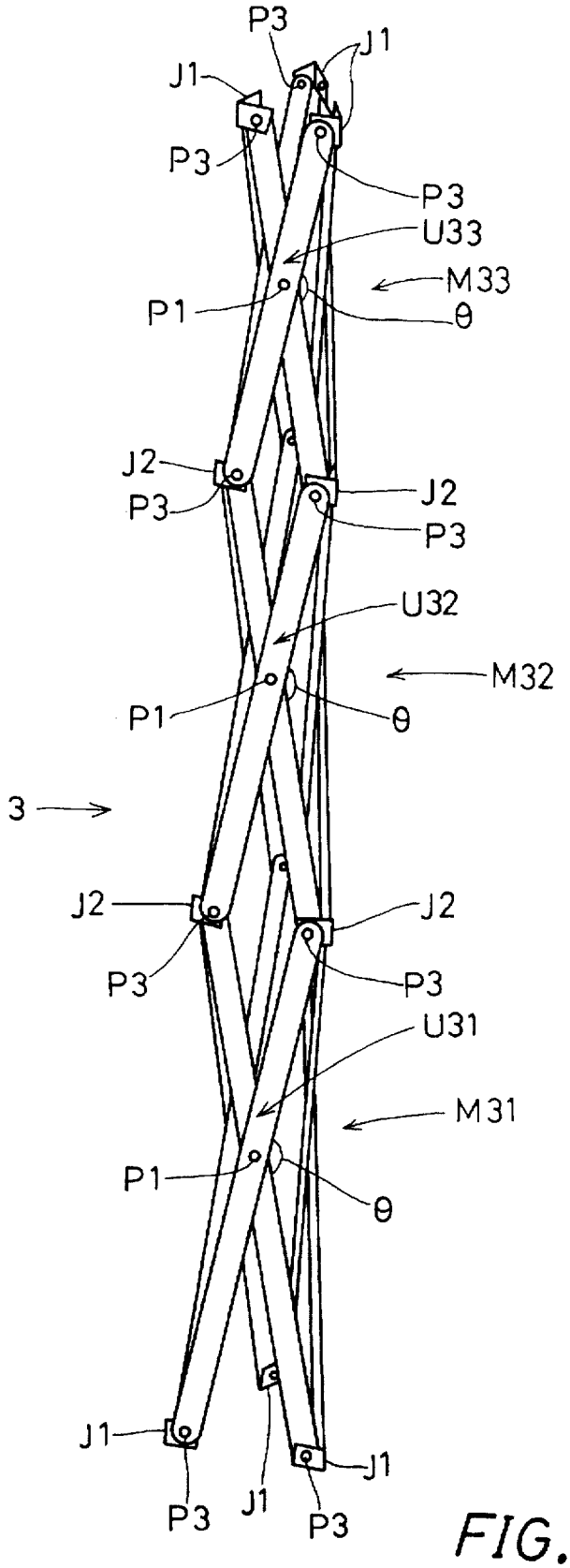
FIG. 11 is a perspective view showing the structure of the third embodiment in the most contracted form.

Again with the above structure 3, the diagonal members u in each of the primary constituent units U31, U32 and U33 constitute diagonals of a trapezoid. Thus, when the diagonal intersection angle θ of each of the primary constituent units U31, U32 and U33 becomes about 21.8°, the structure assumes the two-dimensionally expanded form, i.e., the most expanded form, as shown in FIG. 8. When the diagonal intersection angle θ becomes closest to 180° after reaching an intermediate form as shown in FIG. 9, the structure assumes the most uni-dimensional form, i.e., the most contracted form, as shown in FIG. 11. Between the two extreme forms, the structure can be expanded and contracted three-dimensionally. Again, the structure 3 of this embodiment, like the structures 1 and 2 described above, is not brought to a perfectly uni-dimensionally contracted form.

Fourth Embodiment

A fourth embodiment will now be described with reference to FIGS. 12 to 14. This embodiment is a different example of the invention.

A structure 4 of this embodiment comprises three secondary constituent units M41, M42 and M43 which are coupled to one another in the axis L direction and each comprise four primary constituent units U4 each including two diagonal members u constituting the diagonals of an isosceles trapezoidal lateral face of a quadrangular pyramid frustum. The primary constituent units U4 in each constituent unit are coupled to one another by couplers J1 of type 1 or couplers J2 of type 2 as noted above into a ring-like form. The three secondary constituent units M41, M42 and M43 again each constitute a secondary constituent unit of type 3 as noted above. In other words, the structure 4 of this embodiment is obtained by coupling together the structures 2 of the second embodiment (i.e., secondary constituent units of type 3) as the three secondary constituent units M4 in the axis L direction. Like the third embodiment, the ratio μ of division by the first rotation axis P1 in the primary constituent units U41, U42 and U43, is different from that in the structure 2 of the second embodiment. In the structure 4 of this embodiment, each of the secondary constituent units M31, M32 and M33 is formed by using four primary constituent units, instead of three units U31, U32 and U33 in the structure 3 of the third embodiment.

Figure 12:
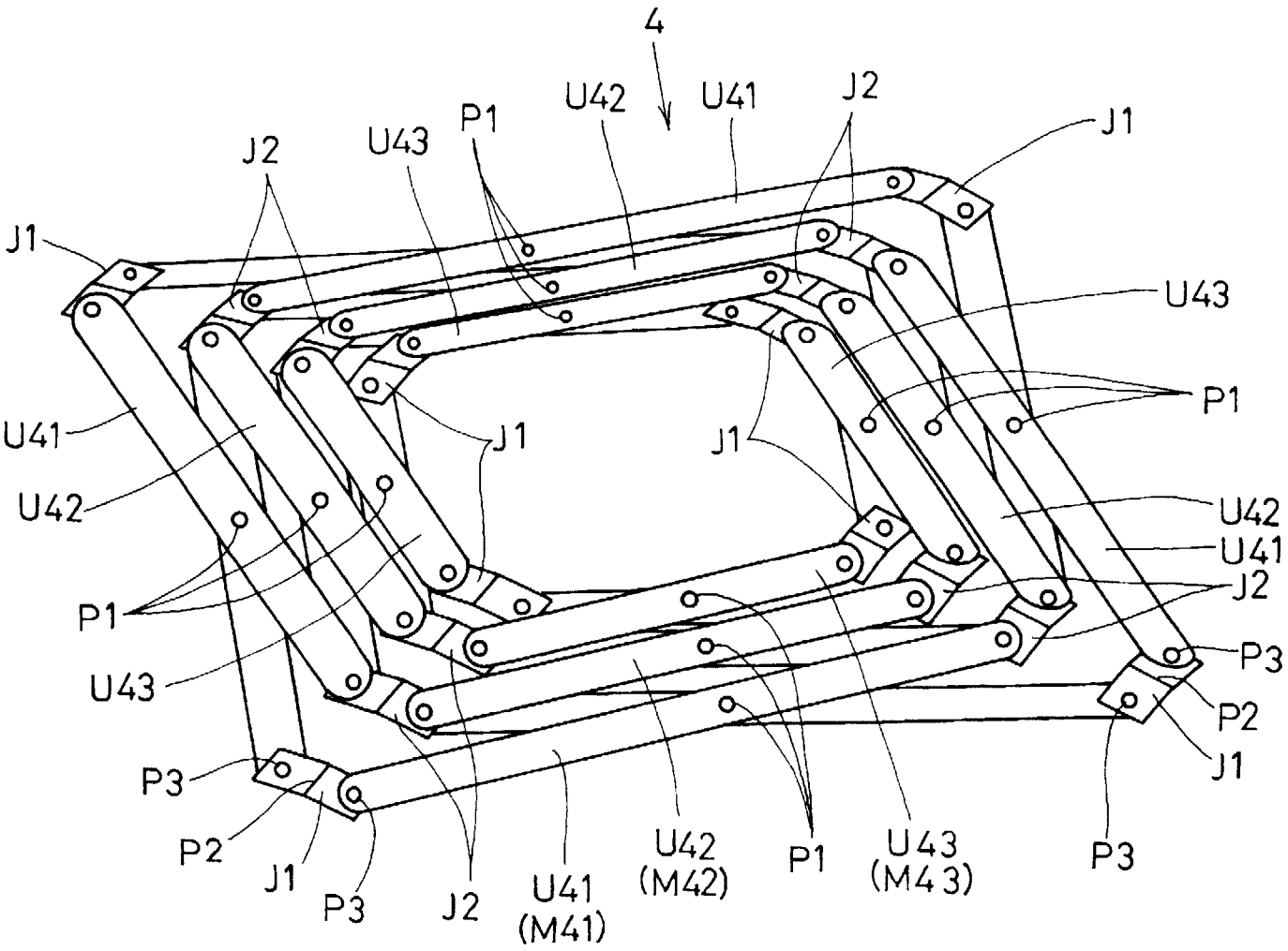
FIG. 12 is a perspective view showing a structure according to a fourth embodiment of the invention in the most expanded form.

The structure 4 is shown in its most two-dimensional form, i.e., the most expanded form, in FIG. 12, and in its most uni-dimensional form, i.e., the most contracted form, in FIG., 14. It is shown in an intermediate form between the two extreme forms in FIG. 13.

Figure 13:
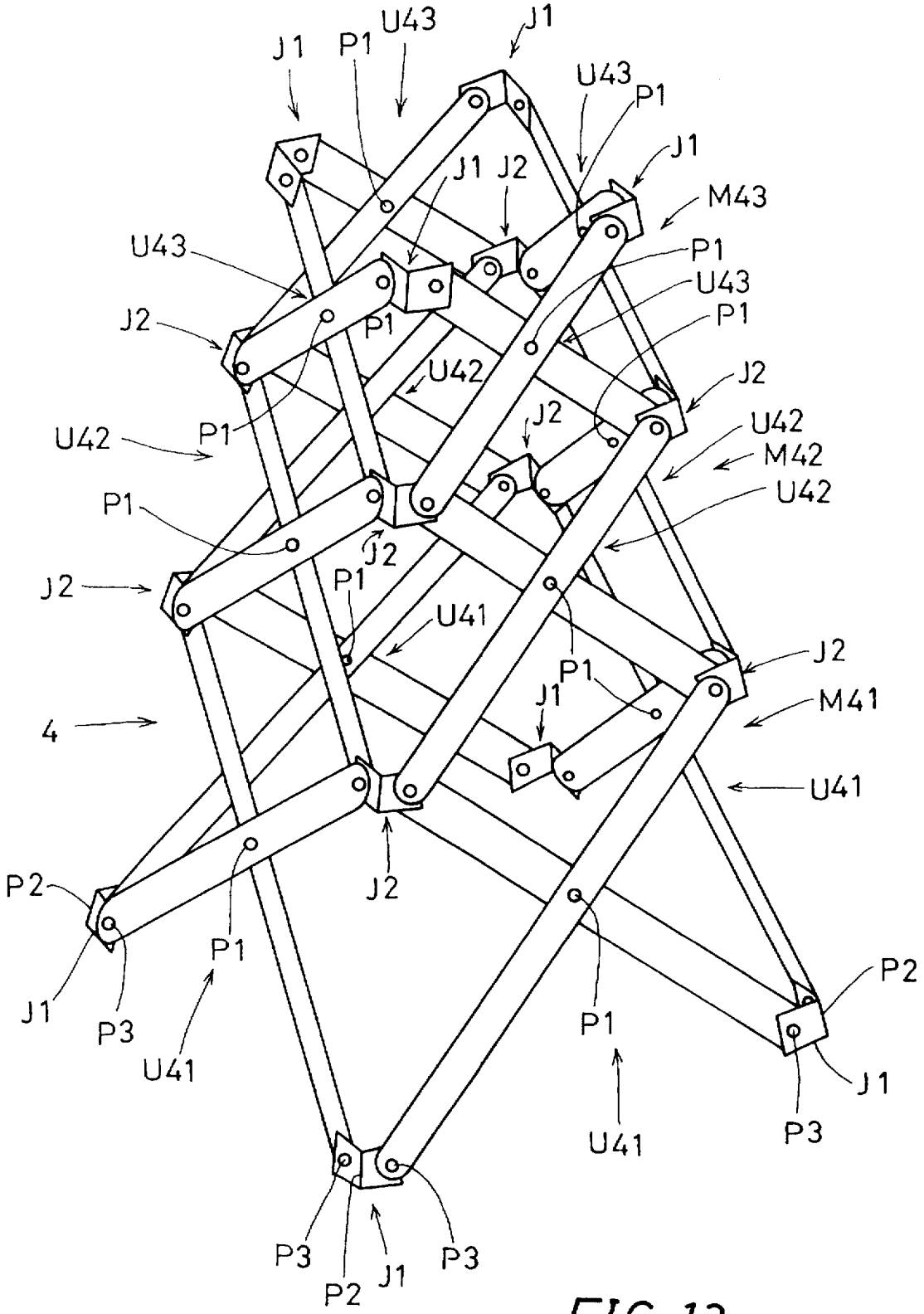
FIG. 13 is a perspective view showing the structure of the fourth embodiment in an intermediate expanded or contracted form.

As best shown in FIG. 13, the lower secondary constituent unit M41 includes four primary constituent units U41, the intermediate secondary constituent unit M42 includes four secondary constituent units U42, and the upper secondary constituent units M43 includes four primary constituent units U43. The coupling of the primary constituent units U41, U42 and U43 between the secondary constituent units M41 and M42 and also between the secondary constituent units M42 and M43 is the same as in the structure 3 of the third embodiment. In the primary constituent units U41, U42 and U43, the ratio μ of division by the first rotation axis P1 is equal. Like the above structure 3 of the third embodiment, four parallelograms are formed by diagonal members u between the secondary constituent units M42 and M43.

Figure 14:
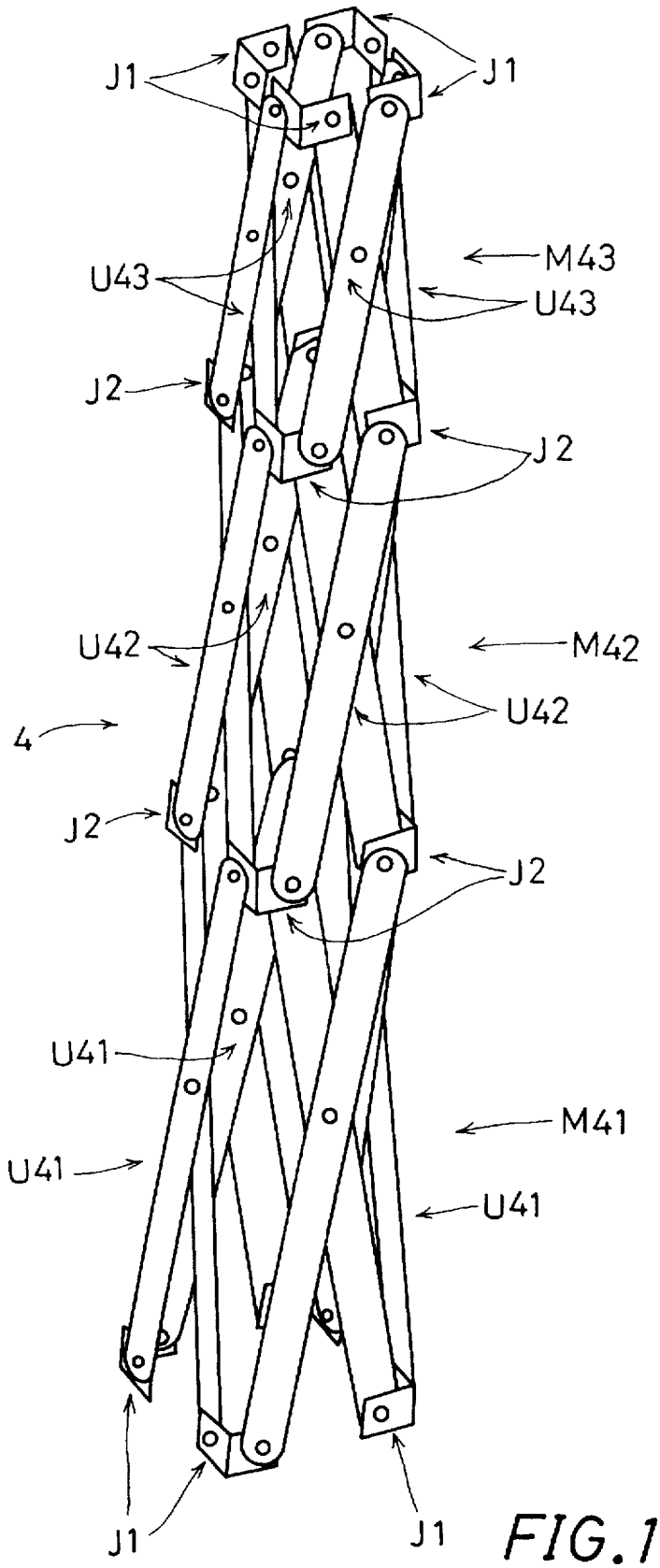
FIG. 14 is a perspective view showing the structure of the fourth embodiment in the most contracted form.

The structure 4 again is capable of being expanded and contracted between the most expanded form shown in FIG. 12 and the most contracted form in FIG. 14. This structure 4 permits assembling of a high voltage power transmission line tower or the like without need of any high locality operation by coupling together a number of diagonal members u on the ground as the structure 4 in the most contracted form as shown in FIG. 12, then expanding the structure by applying a predetermined external force thereto to an intermediate form as shown in FIG. 13, and then securing the structure 4 in this form.

Fifth Embodiment

A fifth embodiment will now be described with reference to FIGS. 15 to 20.

Figure 18:
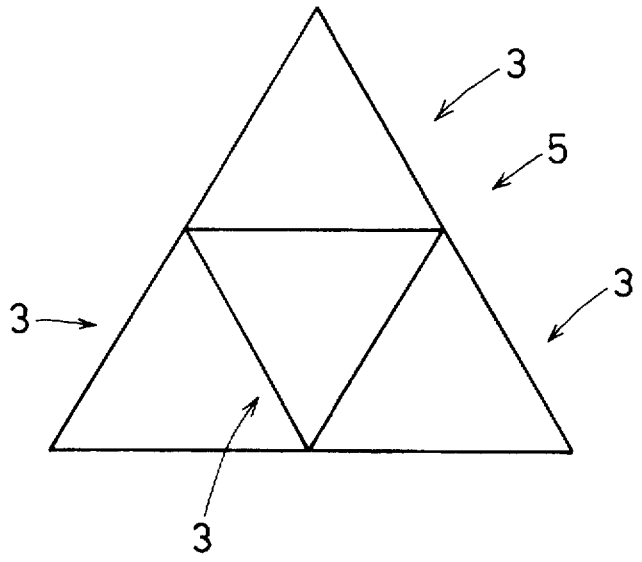
FIG. 18 is a schematic plan view showing the structure of the fifth embodiment.

A structure 5 of this embodiment comprises three structures 3 of the third embodiment. As shown in FIG. 18, the structures 3 are coupled together in a direction perpendicular to their axes L, which are perpendicular to the plane of paper in FIG. 18, (i.e., direction of the plane of paper), that is, in their transversal and longitudinal directions, into a ring-like form.

Couplers J3 and J4 of types 3 and 4 as well as couplers J1 and J2 of types 1 and 2 are used for coupling the structures to one another.

Figure 16:
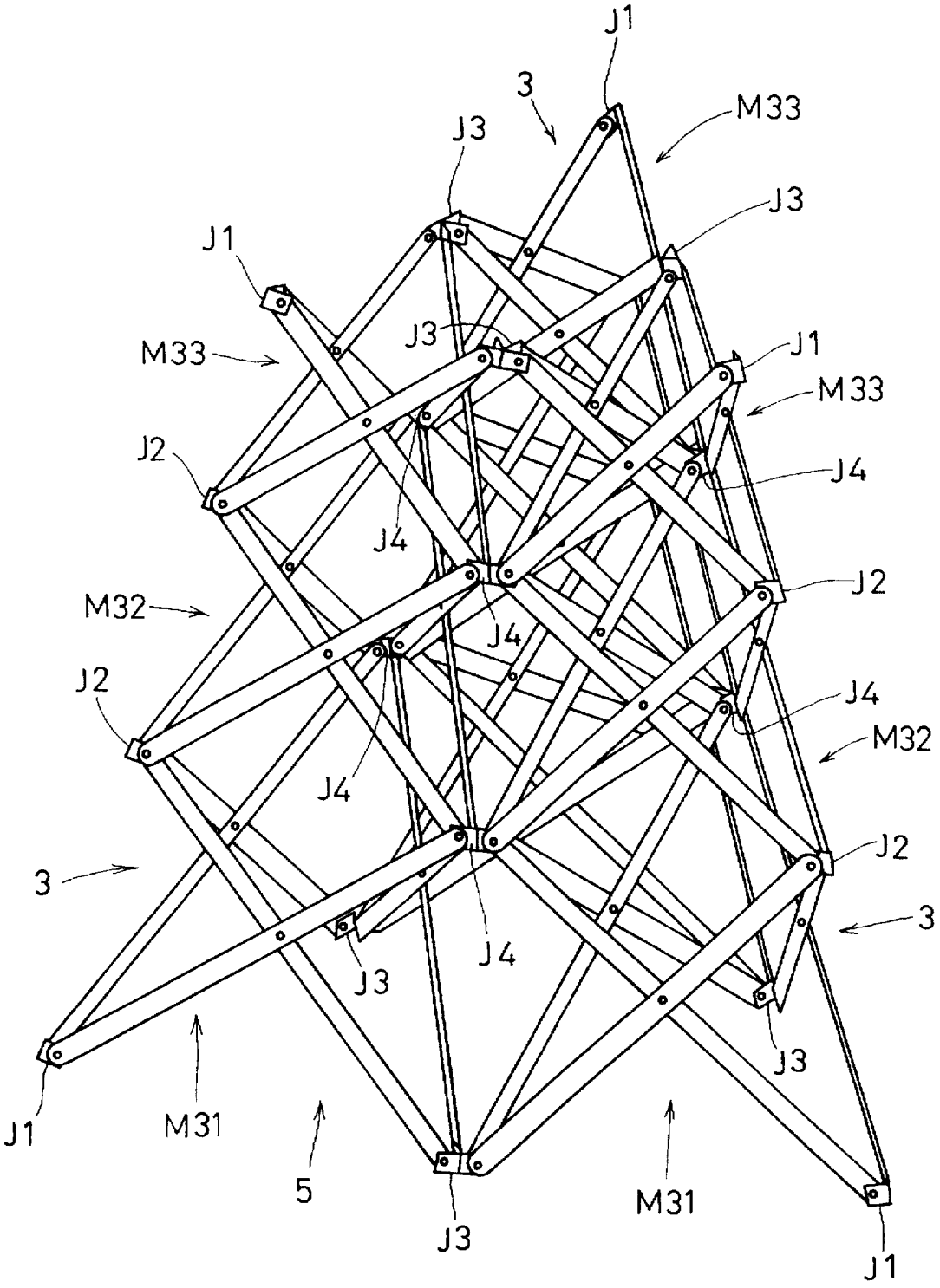
FIG. 16 is a perspective view showing the structure of the fifth embodiment in an intermediate expanded or contracted form.
Figure 19:
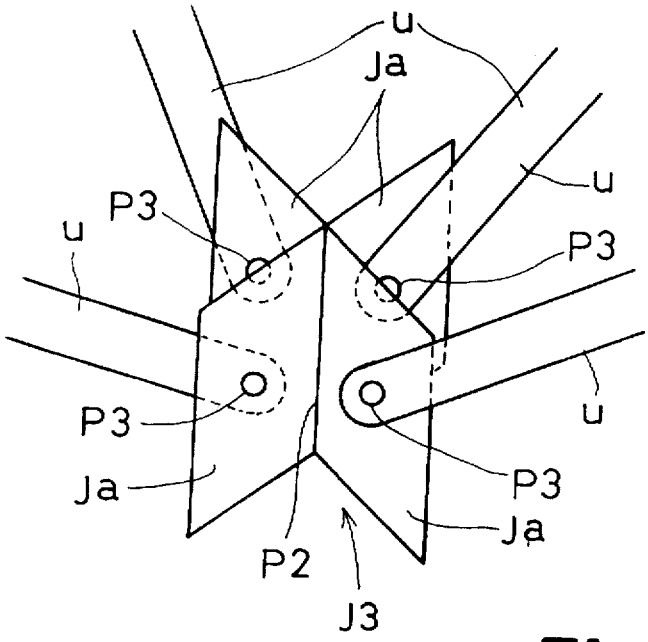
FIG. 19 is a perspective view showing a coupler of type 3.

As shown in FIG. 19, the coupler J3 of type 3 includes four coupling members Ja which each have a third rotation axis P3 and which are coupled to one another for independent rotation about a second rotation axis P2 as a common rotation axis. That is, the coupler J3 is constituted by two couplers J1 of type 1 which are coupled together with the second rotation axis P2 as a common rotation axis. Four diagonal members u are pin-coupled to the coupler J3 of type 3 for independent rotation about their respective third rotation axes P3. As shown in FIG. 16, these couplers J3 of type 3 are used to couple together adjacent ones of the structures 3 at the upper and lower ends of the structure 5.

Figure 20:
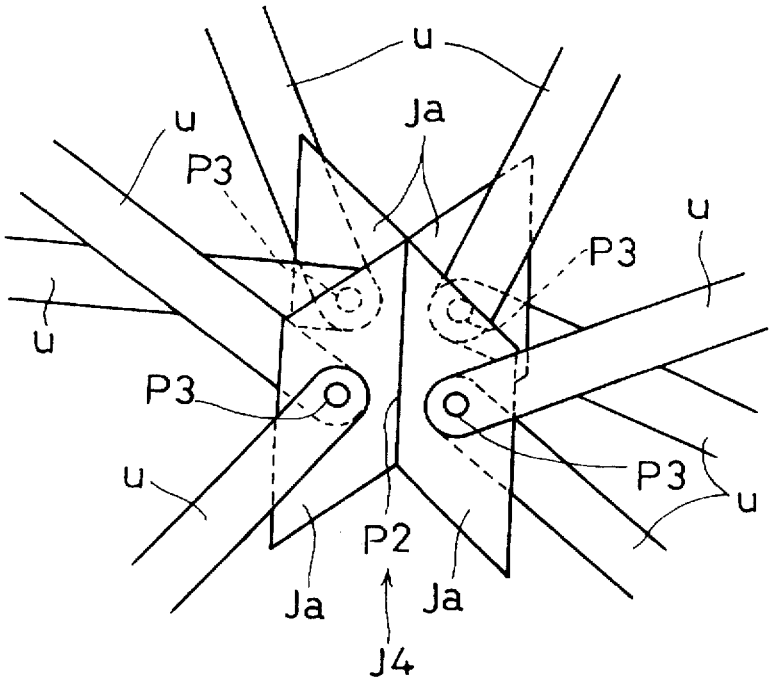
FIG. 20 is a perspective view showing a coupler of type 4.

As shown in FIG. 20, like the coupler J3 of type 3, the coupler J4 of type 4 includes four coupling members Ja having a third rotation axis P3 and coupled together for independent rotation about a second rotation axis P2 as a common rotation axis. In this case, two diagonal members u are coupled for rotation about each of the four third rotation axes P3, that is, a total of eight diagonal members u are coupled to each coupler J4 of type 4. That is, the couplers J4 is constituted by two couplers J2 of type 2 coupled together with the second rotation axis P2 as a common rotation axis. This coupler J4 of type 4 is used at the locality at which a secondary constituent unit M is coupled to adjacent ones in the axis L direction and also in the direction perpendicular thereto, that is, both in the longitudinal and transversal directions.

Figure 15:
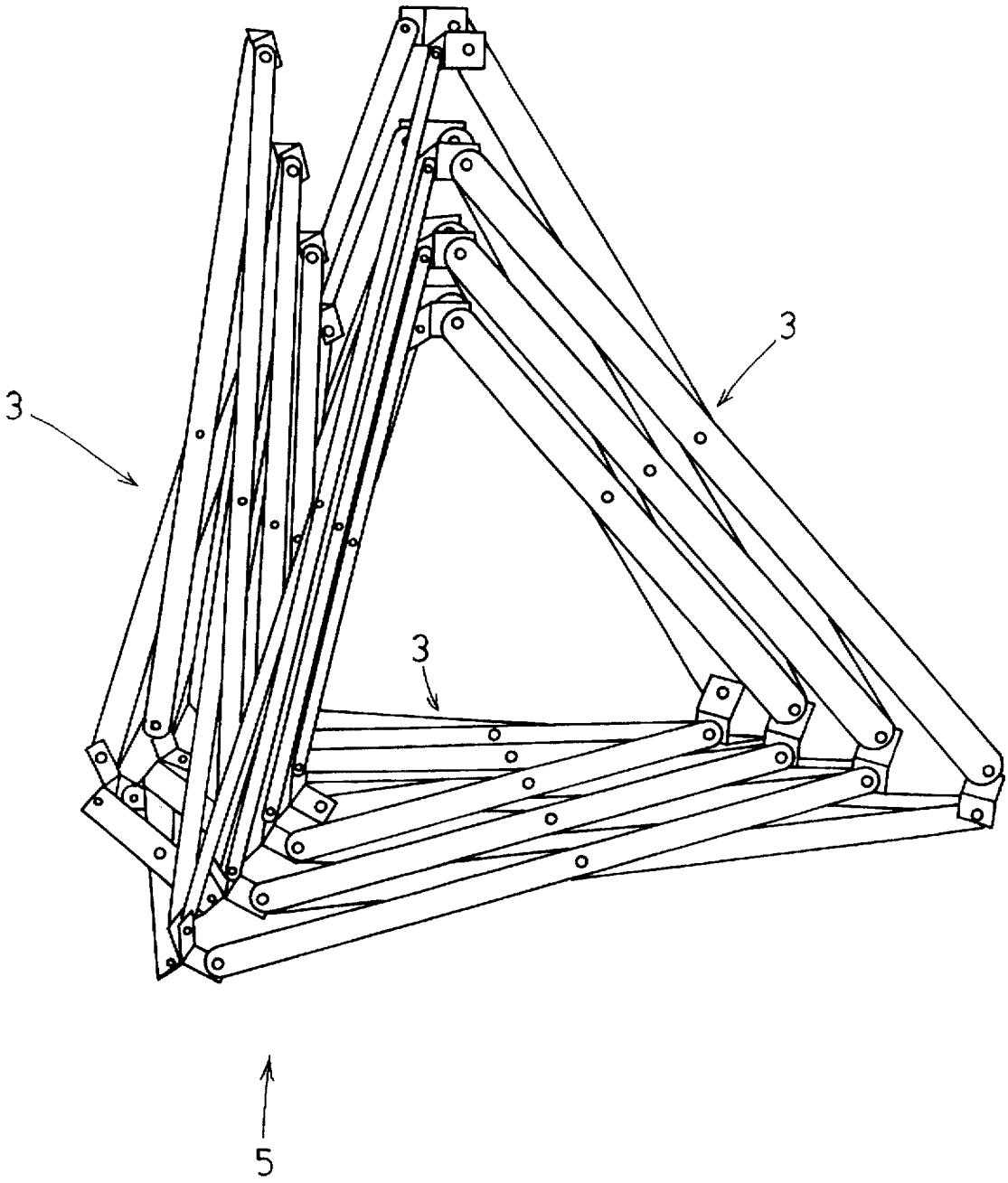
FIG. 15 is a perspective view showing a structure according to a fifth embodiment of the invention in the most expanded form.
Figure 17:
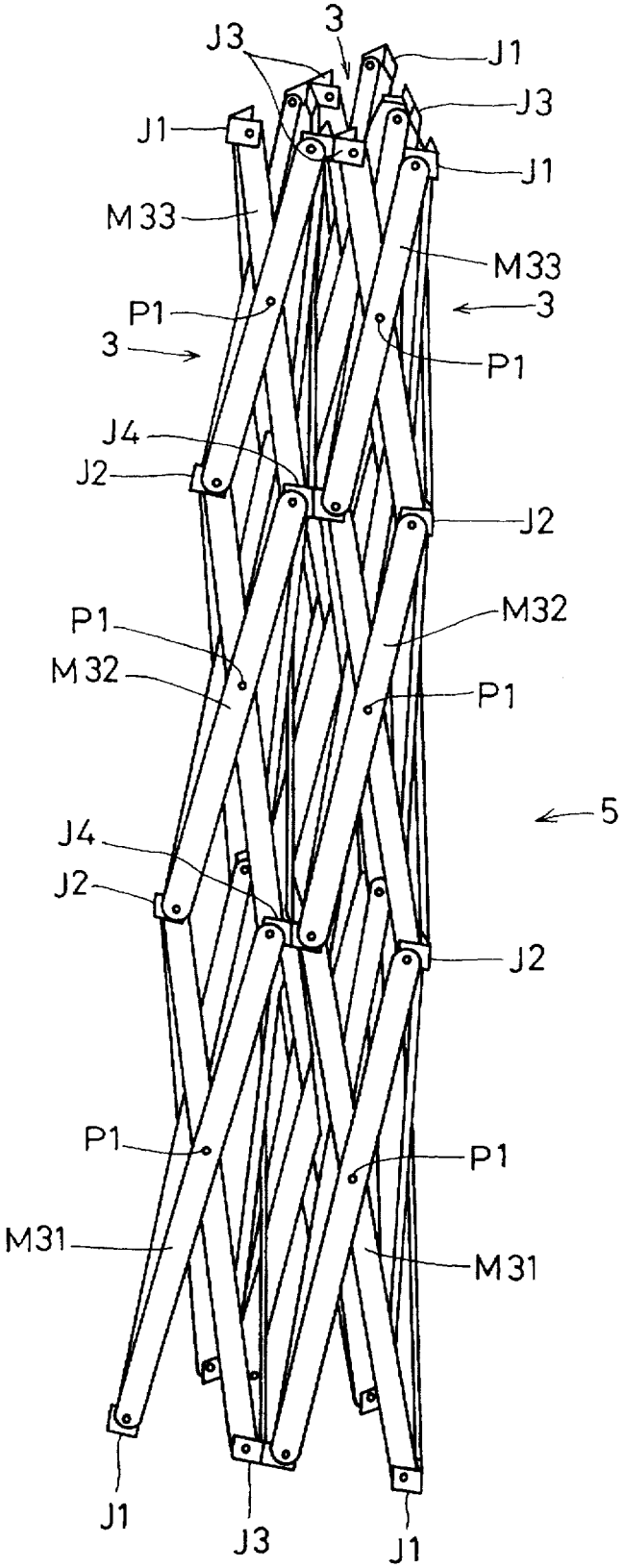
FIG. 17 is a perspective view showing the structure of the fifth embodiment in the most contracted form.

When an external force is applied onto the structure 5 to change the diagonal intersection angle θ of each of the primary constituent units U31, U32 and U33 in the secondary constituent units M31, M32 and M33 of each structure 3, the structure 5 can be three-dimensionally expanded and contracted between the most expanded form as shown in FIG. 15 (with each structure 3 in the most expanded form) and the most contracted form as shown in FIG. 17 (with each structure 3 in the most contracted form). The structure 5 is shown in its intermediate form between the two extreme forms in FIG. 16. Like the structure 4, this structure 5 permits assembling of, for instance, a high tension transmission line tower, without need of any high locality operation.

Sixth Embodiment

Figure 21:
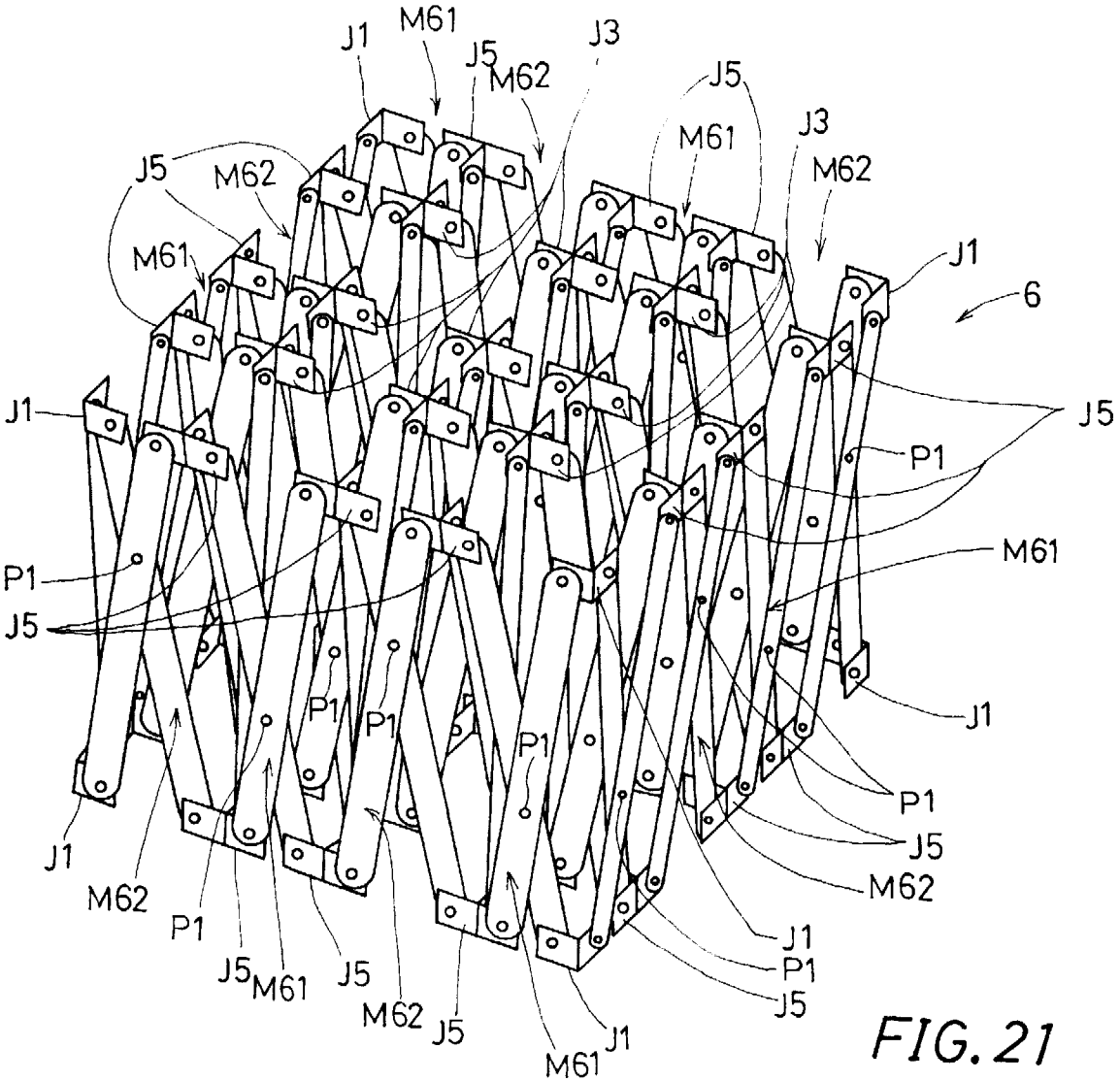
FIG. 21 is a perspective view showing a structure according to a sixth embodiment of the invention in the most expanded form.

A sixth embodiment will now be described with reference to FIGS. 21 to 25. As shown in FIG. 21, a structure 6 of this embodiment comprises secondary constituent units of type 3 (i.e., structures 2 of the second embodiment) used as first secondary constituent units M61 and secondary constituent units of type 4 used as second secondary constituent units M62, the first and second secondary constituent units M61 and M62 being coupled together alternately in a two-dimensional fashion in directions perpendicular to the axis L direction, i.e., in transversal and longitudinal directions. Thus, as shown in FIG. 25, the lateral faces of the structure 6, constituted by respective primary constituent units U, have first rotation axes P1 located alternately at upper and lower positions.

The coupling of the primary constituent units U in the secondary constituent units M61 and M62 and the coupling of these secondary constituent units M61 and 62, are made by using couplers J5 of type 5 to be described later in addition to couplers J1 and J3 of types 1 and 3 as noted above.

Figure 24:
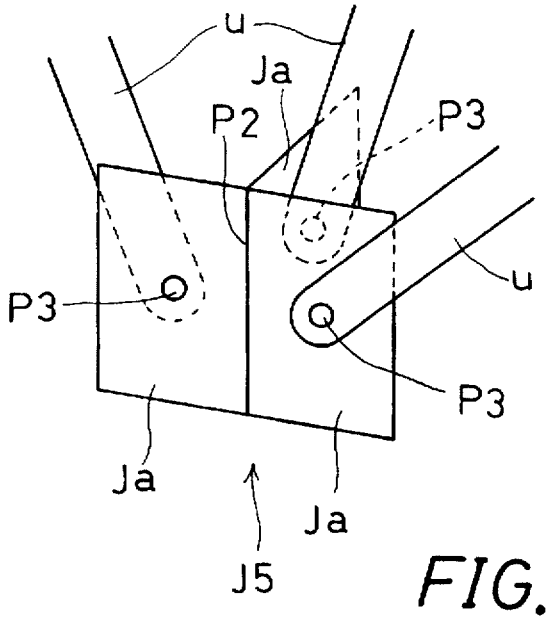
FIG. 24 is a perspective view showing a coupler of type 5.
Figure 25:
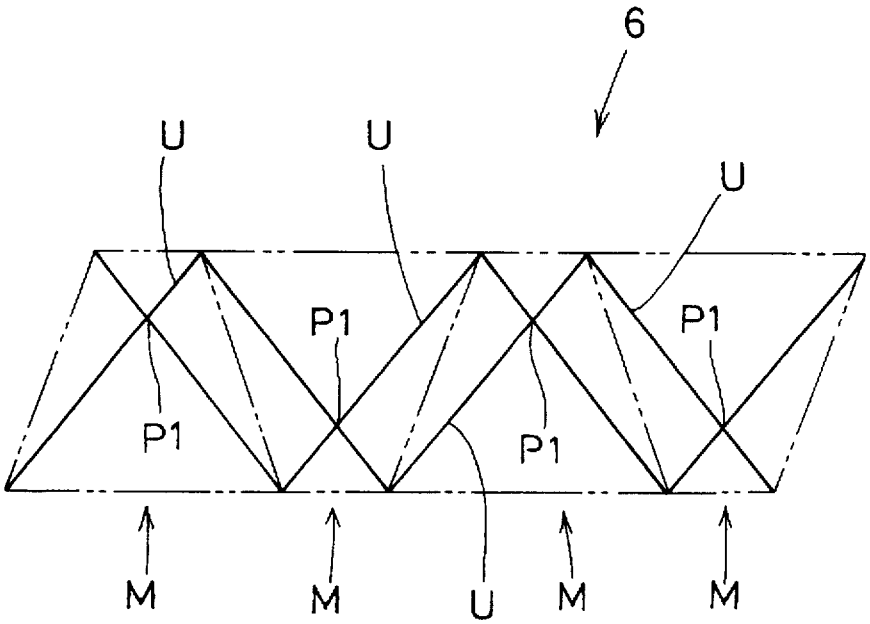
FIG. 25 is a schematic developed view showing the layout of the structure of the sixth embodiment.

As shown in FIG. 24, the coupler J5 of type 5 includes three coupling members Ja each having a third rotation axis P3 and coupled together for independent rotation about a second rotation axis P2 as a common rotation axis. One diagonal member u is coupled to each third rotation axis P3.

In the structure 6 of this embodiment, couplers J1 of type 1 are used at the eight corners, couplers J5 of type 5 are used at other ends, and couplers J3 of type 3 are used for other localities.

The structure 6 having the above construction is brought to the most contracted form by minimizing the distance between the third rotation axes P3 in each primary constituent unit U, i.e., maximizing the diagonal intersection angle θ in each primary constituent unit U. This form is shown in FIG. 21. By exerting an external force to the structure 6 to increase the distance between the third rotation axes P3 in each primary constituent unit U and thus reduce the diagonal intersection angle θ therein from the most contracted form, the structure 6 is developed three-dimensionally to assume consequent intermediate forms shown in FIGS. 22 and 23 and eventually reach the most expanded form close to a substantial two-dimensional form with a minimum diagonal intersection angle θ.

Figure 22:
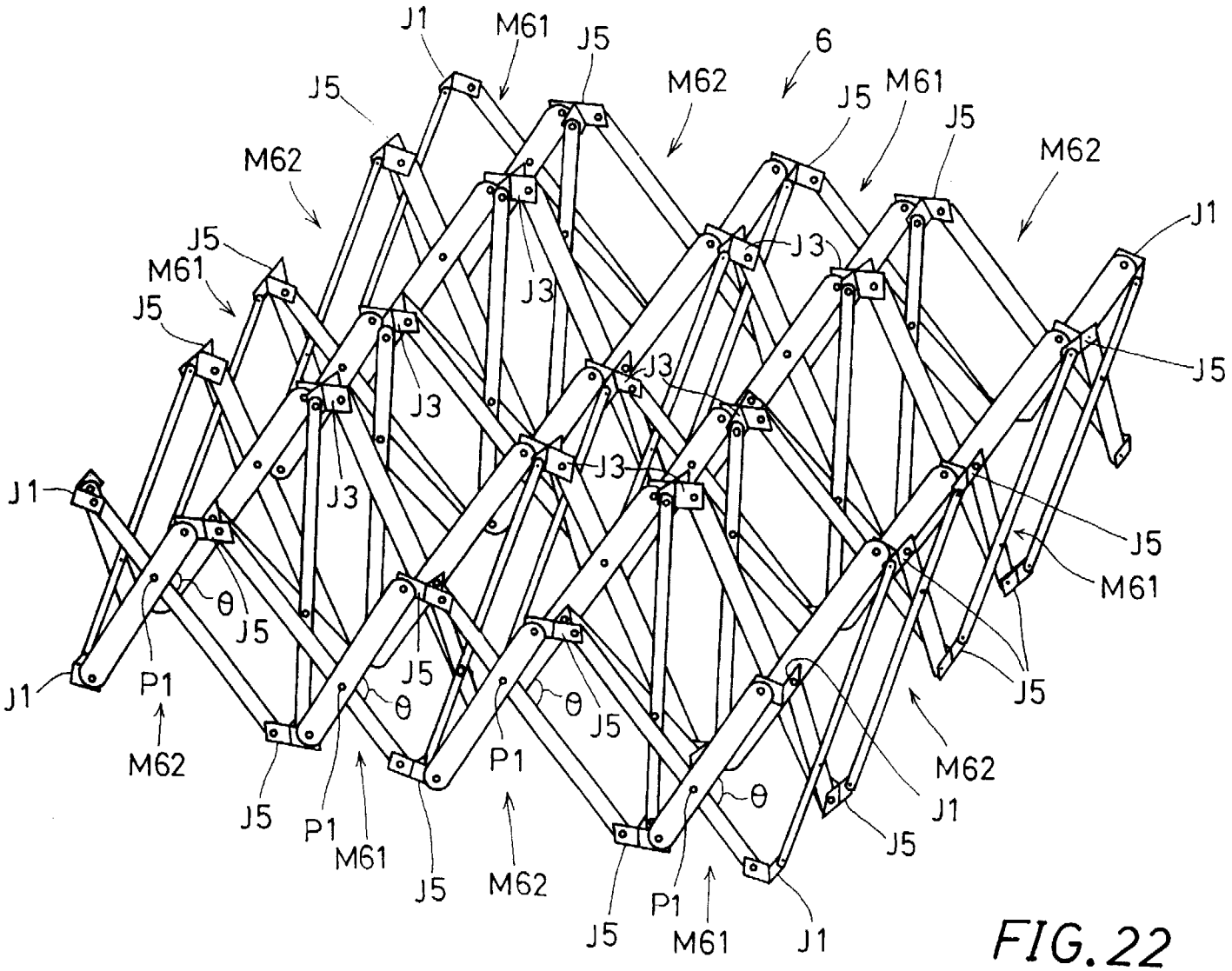
FIG. 22 is a perspective view showing the structure of the sixth embodiment in an intermediate expanded or contracted form.
Figure 23:
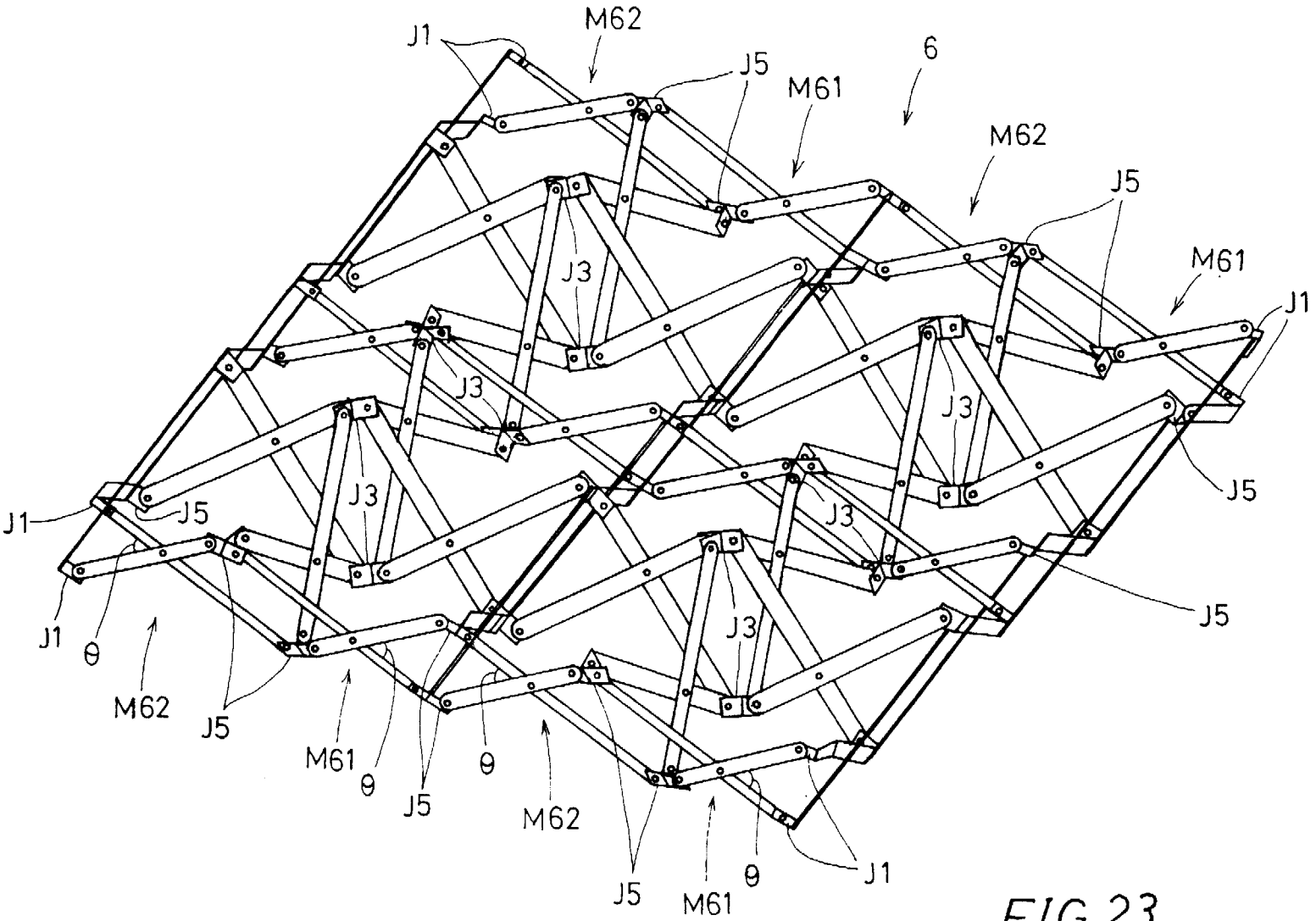
FIG. 23 is a perspective view showing the structure of the sixth embodiment in the most contracted form.

By exerting a converse external force to the structure 6 in a direction to reduce the distance between the third rotation axes P3, i.e., increase the diagonal intersection angle θ, from the most expanded form, each primary constituent unit U is changed in form in a rising fashion, and the structure 6 assumes consequent intermediate forms as shown in FIGS. 23 and 22 to eventually reach the most contracted form as shown in FIG. 21. The structure 6 may be used to form a torus structure constituting, for instance, the floor of a large-scale building structure, by compactly assembling it to a form as shown in FIG. 21 on the ground, then suspending it and then developing it in space. As a different example, the structure 6 may be used to form a three-dimensional torus structure used for space structure by assembling it to the most contracted form, i.e., the most compact form, then bringing it out from the atmosphere, and then developing it to cause action of tension elements.

Seventh Embodiment

Figure 27:
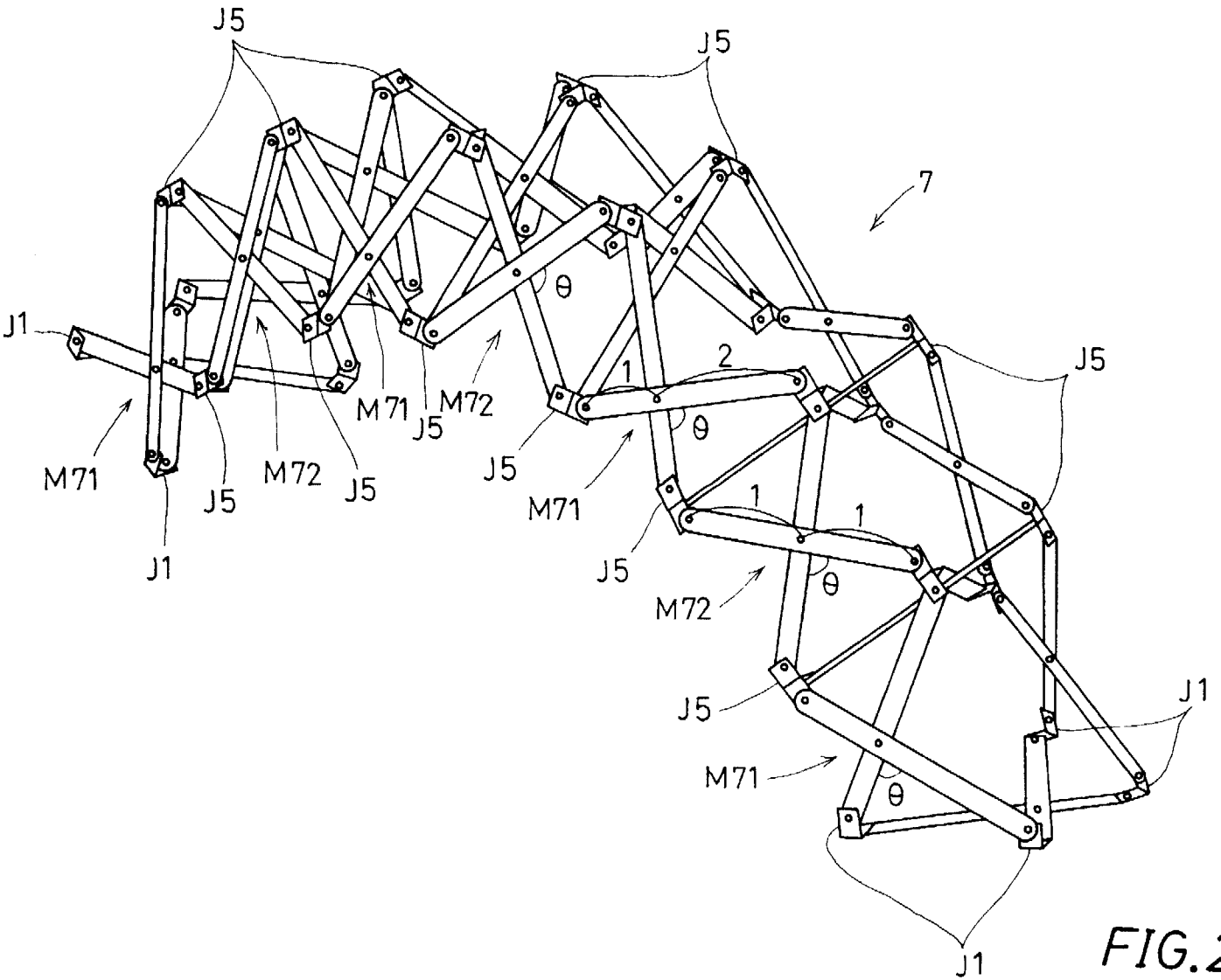
FIG. 27 is a perspective view showing the structure of the seventh embodiment in an intermediate expanded or contracted form.
Figure 28:
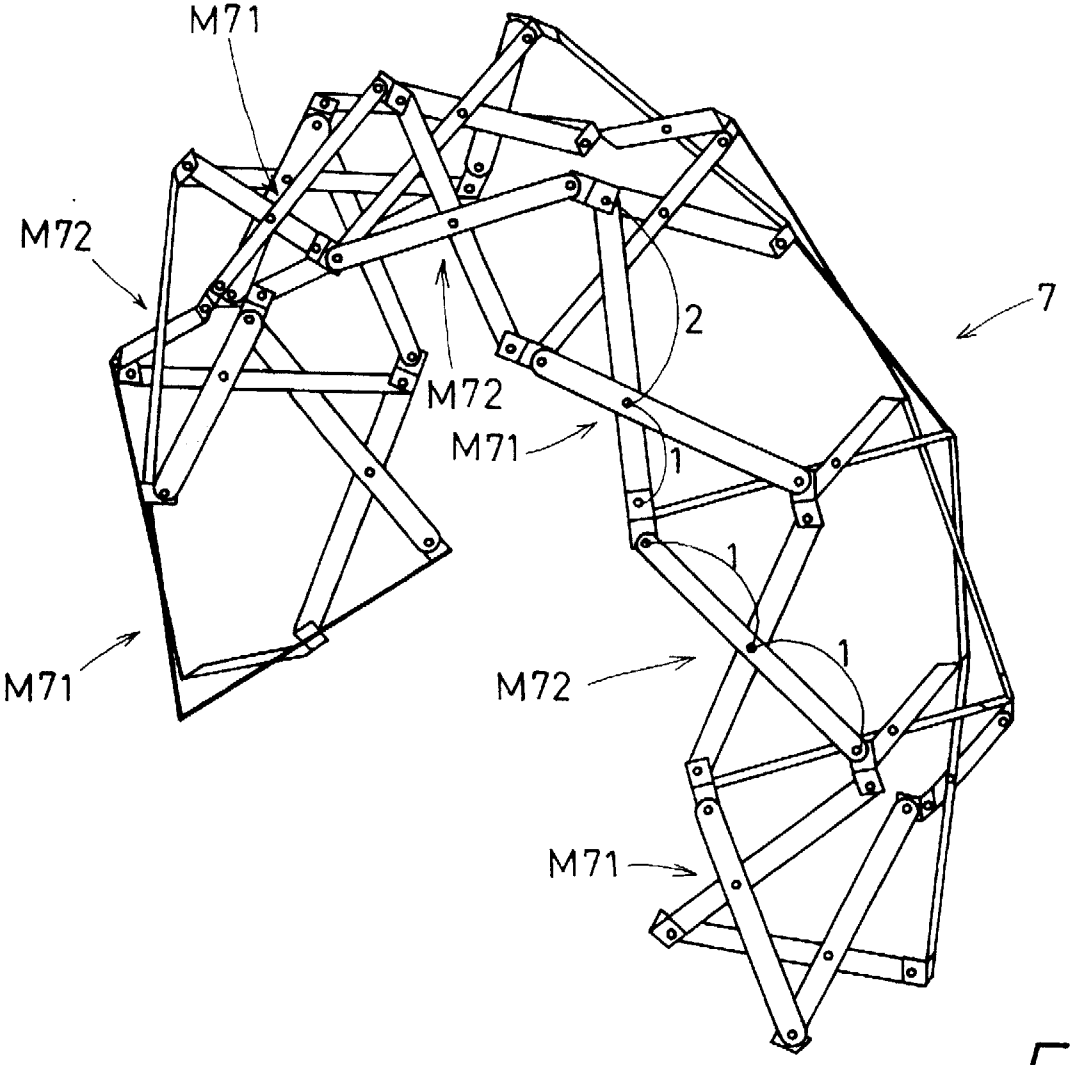
FIG. 28 is a perspective view showing the structure of the seventh embodiment in the most expanded form.

A seventh embodiment will now be described with reference to FIGS. 26 to 28. A structure 7 of this embodiment comprises first secondary constituent units M71 and second secondary constituent units M72, these units M71 and M72 being coupled together alternately in a direction perpendicular to their axes L, i.e., in a transversal direction thereof. The first secondary constituent units M71 each include primary constituent units, each of which includes diagonal members u constituting the two diagonals of a lateral face of a solid with isosceles trapezoidal lateral faces. A segment of each diagonal member u between two third rotation axes P3 is divided by a first rotation axis P1 with a ratio of 2:1. The primary constituent units in this secondary constituent unit M71 are coupled to one another in a ring-like form such that their long and short divided parts appear alternately. These secondary constituent units M71 correspond to the secondary constituent unit of type 4.

The second secondary constituent units M72 likewise each include primary constituent units, each of which includes diagonal members u constituting the two diagonals of a lateral face of a solid with isosceles trapezoidal lateral faces, the primary constituent units being coupled together in a ring-like form. In these units M72, a segment of each diagonal member u between two third rotation axes P3 is divided by a first rotation axis P1 with a ratio of 1:1 or 2:1. The primary constituent units with a division ratio of 2:1 and those with a division ratio of 1:1 appear alternately. These secondary constituent units M72 correspond to the secondary constituent unit of type 5. In this embodiment, the arrangement of the secondary constituent unit of type 5 is such that the primary constituent units with a division ratio of 2:1 are combined alternately with those with a division ratio of 1:1.

The first and second secondary constituent units M71 and M72 are coupled together alternately in a direction perpendicular to the axis L direction (i.e., in a transversal or left-right direction as viewed in the drawing) with one primary constituent unit used in common between adjacent ones of them. Thus, when one lateral face of the structure 7 is noted in the drawing, the primary constituent units divided into the division ratios of 1:2 and 1:1 are arranged alternately.

The coupling of the first and second secondary constituent units M71 and M72 adjacent to each other is made by a coupler J5 of type 5 as noted above.

Figure 26:
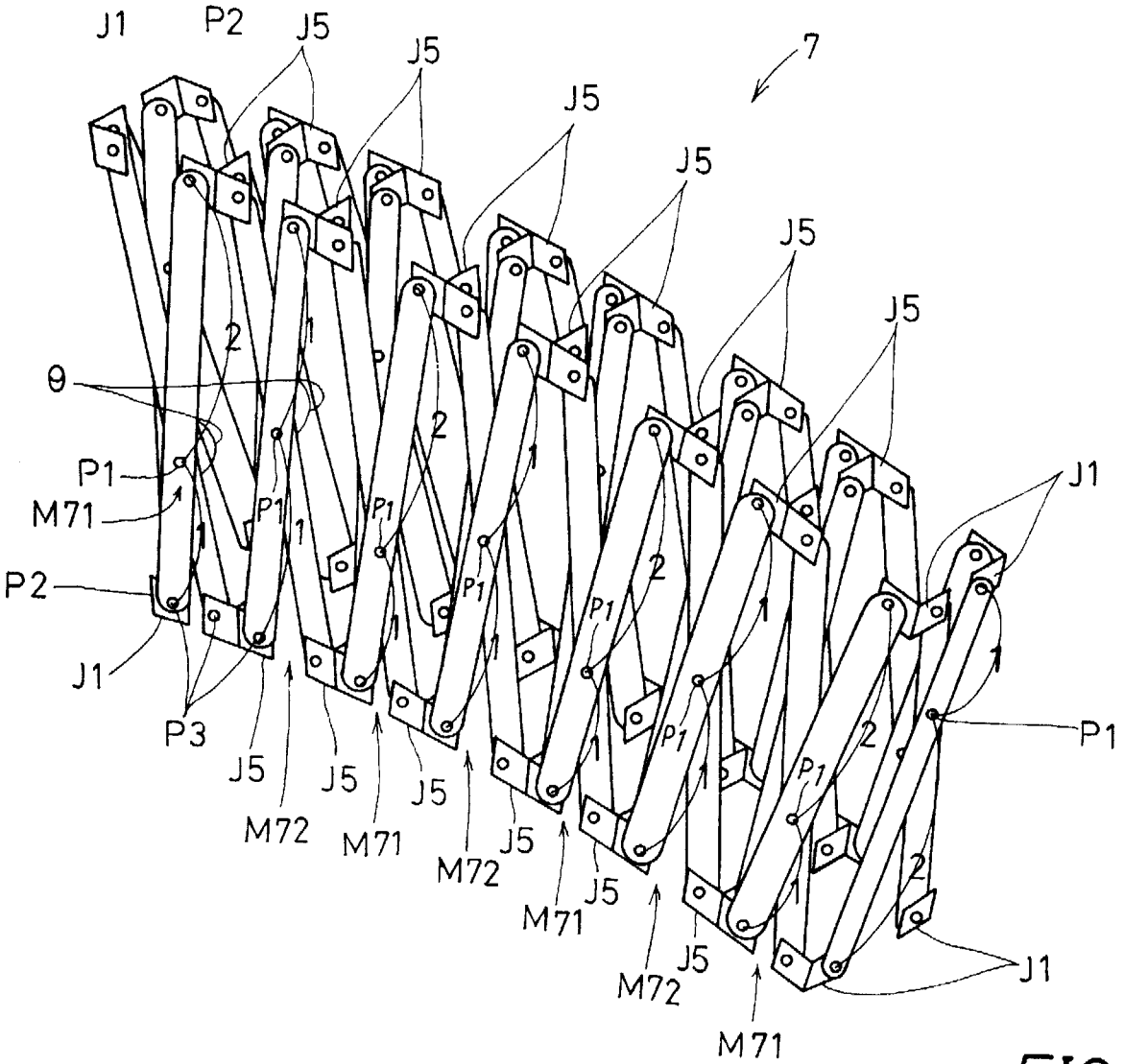
FIG. 26 is a perspective view showing a structure according to a seventh embodiment of the invention in the most contracted form.

The structure 7 having the above construction is shown in its most contracted form in FIG. 26. When an external force is exerted to the structure 7 in this form in a direction of reducing the diagonal intersection angle θ of each primary constituent unit, it is changed in form to assume an intermediate form as shown in FIG. 27 and eventually reach the most expanded form, i.e., an arch-like form, as shown in FIG. 28. When a force is applied to the structure 7 in the most expanded form in a direction of reducing the primary constituent unit diagonal intersection angle θ, the structure 7 is returned via the intermediate form shown in FIG. 27 to the most contracted form shown in FIG. 26. This structure 7 may be used as a structure unit or a drive of a bridge or a building structure, for instance, by assembling it to the most contracted form as shown in FIG. 26 and then exerting an external force thereto to be developed into the arch-like form as shown in FIG. 27 or 28. Like the structure 6, the structure 7 may also be used to form a structure for space structures.

Eighth Embodiment

Figure 30:
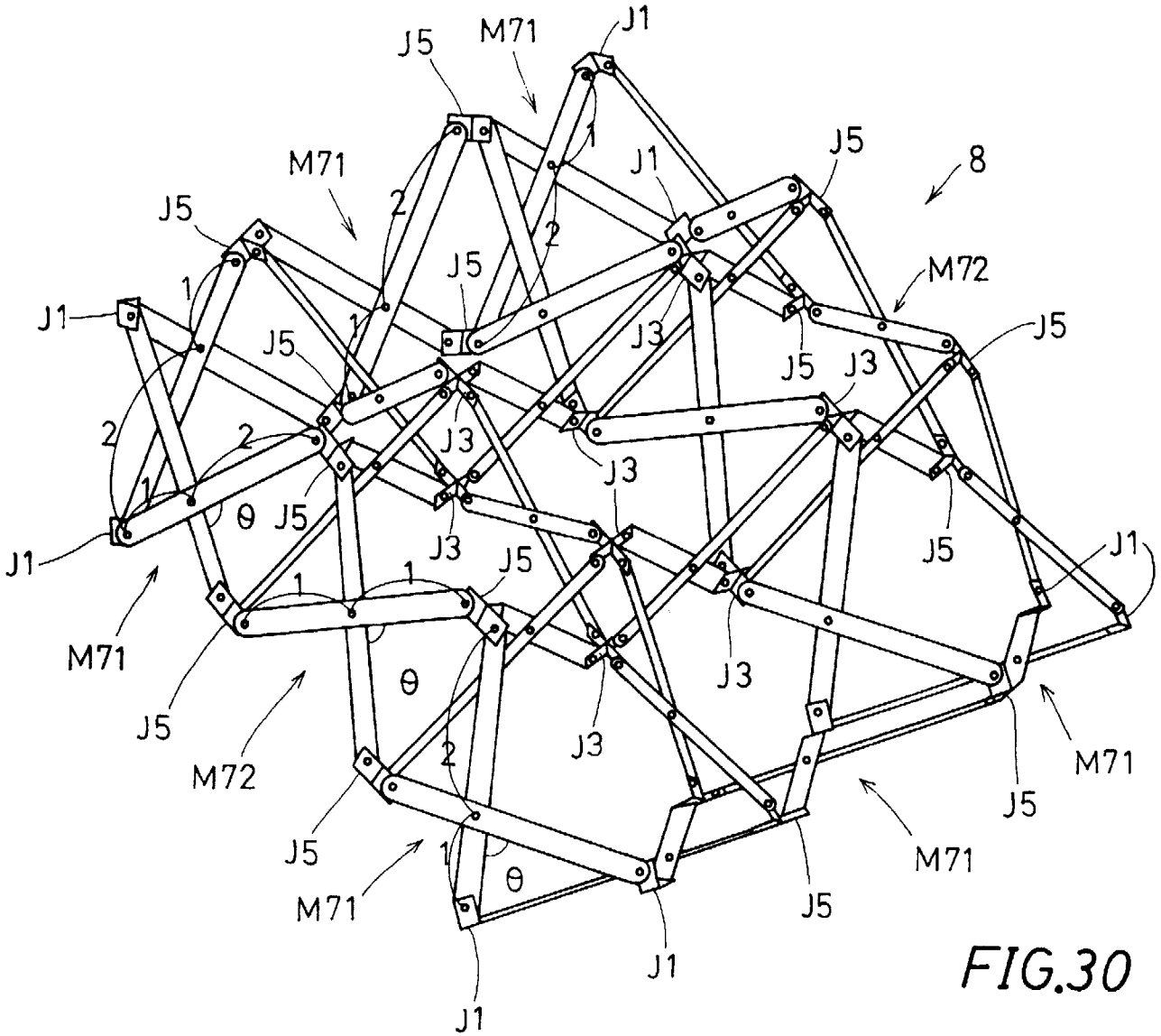
FIG. 30 is a perspective view showing the structure of the eighth embodiment in an intermediate form.
Figure 31:
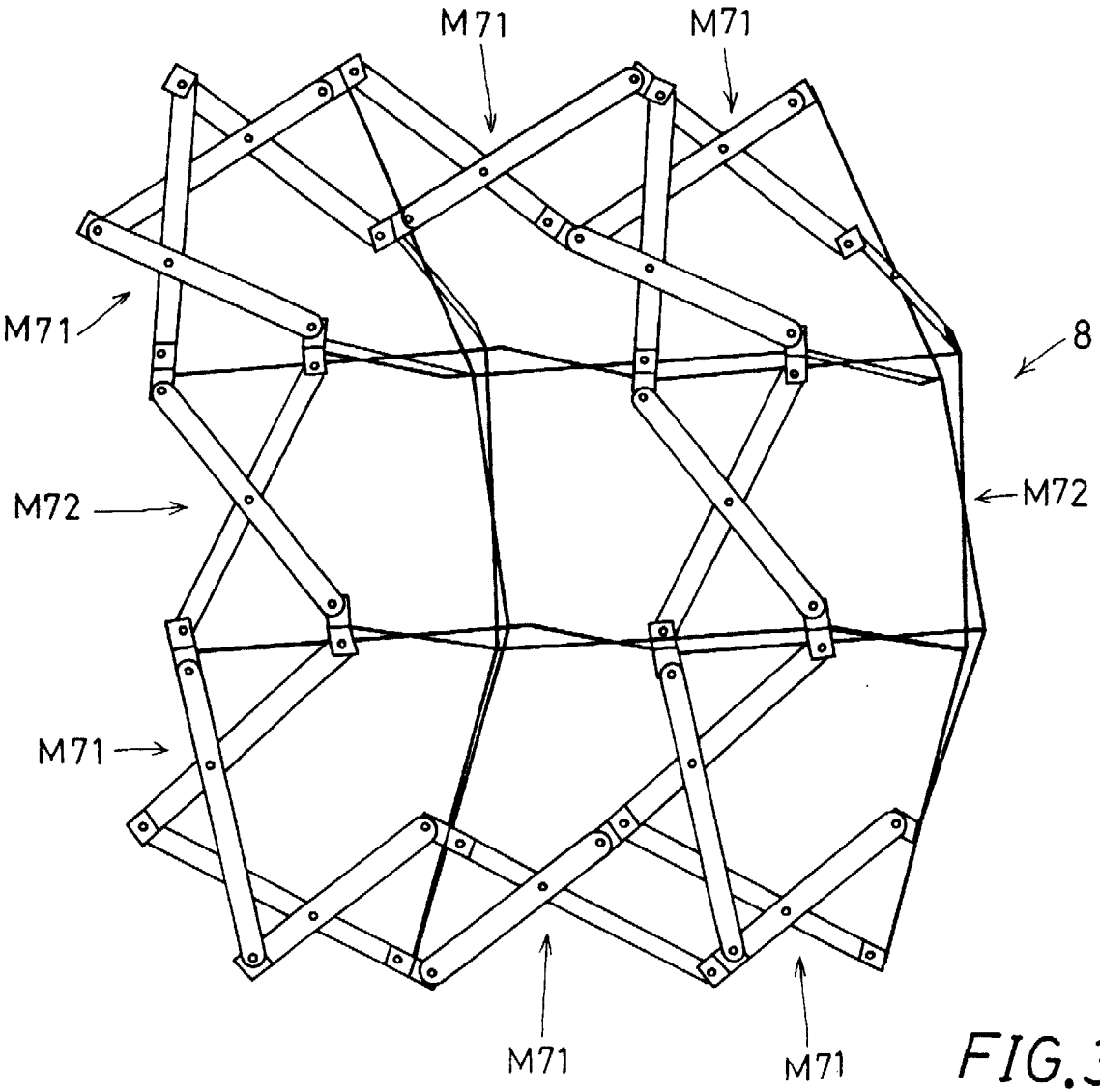
FIG. 31 is a perspective view showing the structure of the eighth embodiment in the most expanded form.

An eighth embodiment will now be described with reference to FIGS. 29 to 31. Like the seventh embodiment. This embodiment is an example of the invention. Specifically, a structure 8 of this embodiment comprises a plurality of the structures 7 of the seventh embodiment, which are coupled to one another alternately in a longitudinal direction such that the long and the short sides of lateral faces appear at the top and the bottom alternately. More specifically, the first and second secondary constituent units M71 and M72 of the seventh embodiment are coupled together alternately in both transversal and longitudinal directions. In the structure 8, as shown in the drawing, a lateral face in which primary constituent units U with a division ratio of 2:1 and those with a division ratio of 1:1 appear alternately, and a lateral face in which primary constituent units with a division ratio of 2:1 and those with the inverse division ratio appear alternately, are adjacent to one another.

Like the structure 6 of the sixth embodiment, the coupling of the secondary constituent units M71 and M72 is made by using couplers J1, J3 and J5 of types 1, 3 and 5.

Figure 29:
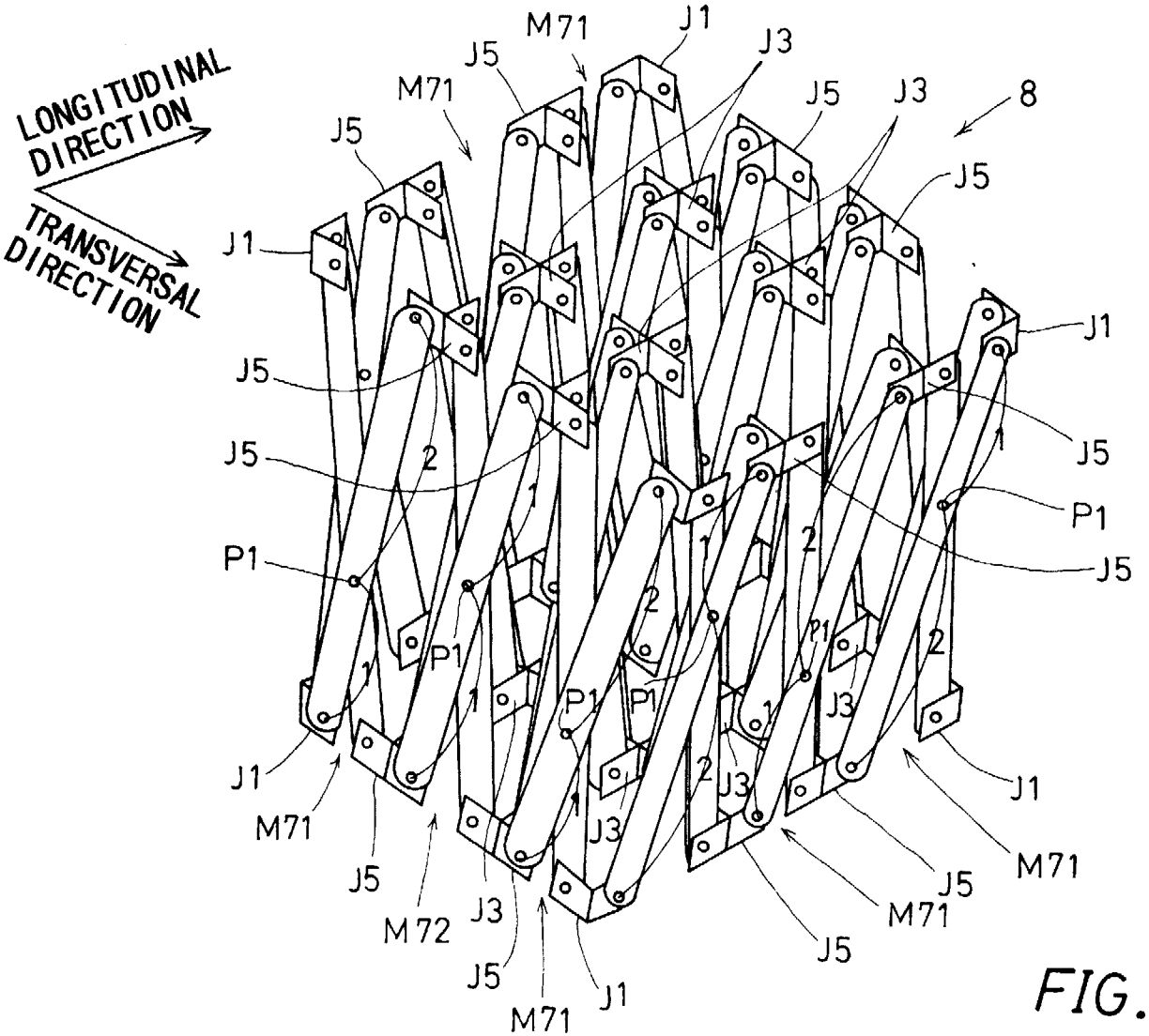
FIG. 29 is a perspective view showing a structure according to an eighth embodiment of the invention in the most contracted form.

The structure 3 having the above construction is shown in its most contracted form in FIG. 29. When a force is exerted to the structure 8 in a direction of reducing the diagonal intersection angle θ of each primary constituent unit U, the structure 8 is changed in form to assume an intermediate form as shown in FIG. 30 and eventually reach the most expanded form, i.e., a vault-like form, as shown in FIG. 31.

Ninth Embodiment

Figure 33:
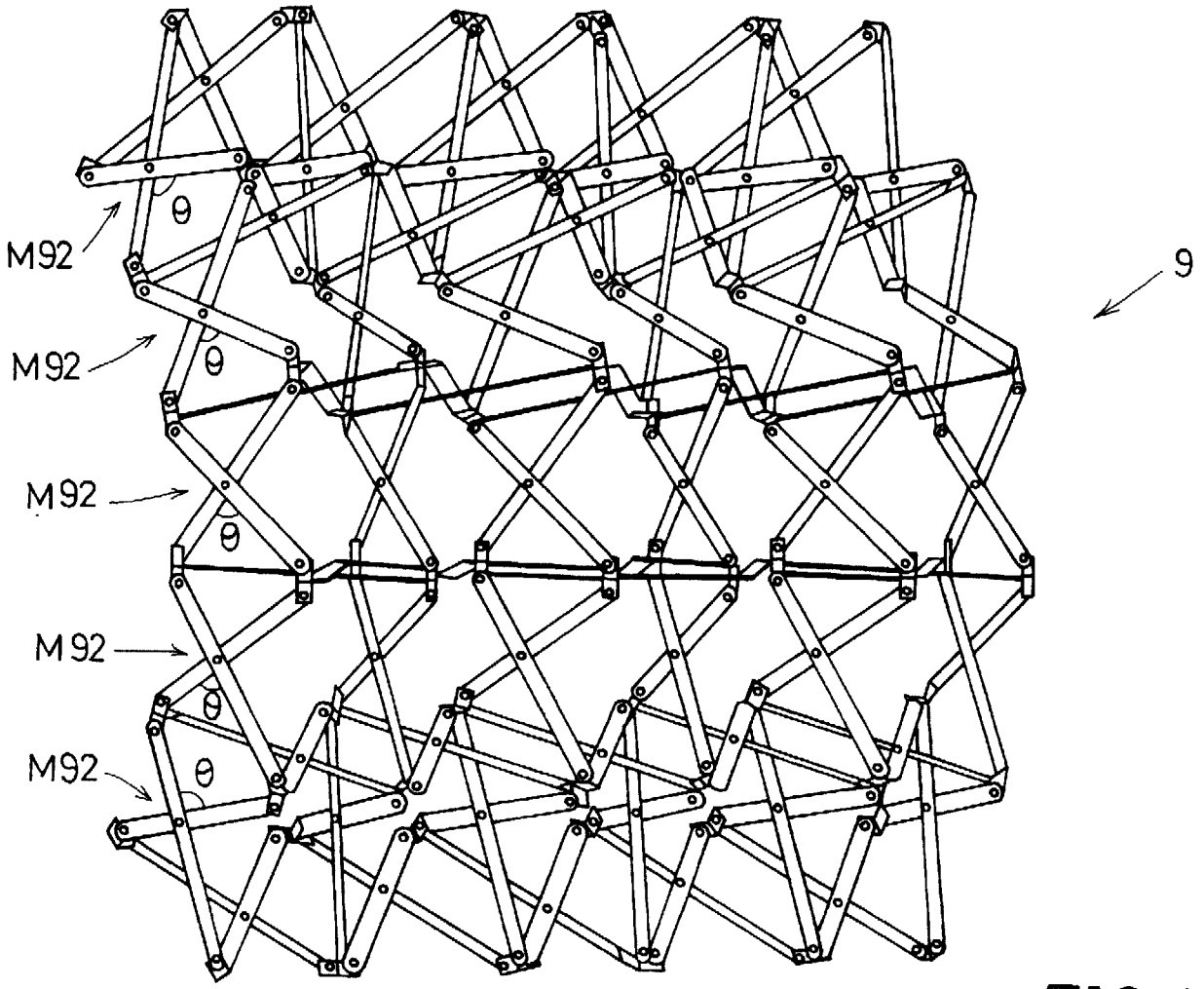
FIG. 33 is a perspective view showing the structure of the ninth embodiment in an intermediate expanded or contracted form.
Figure 34:
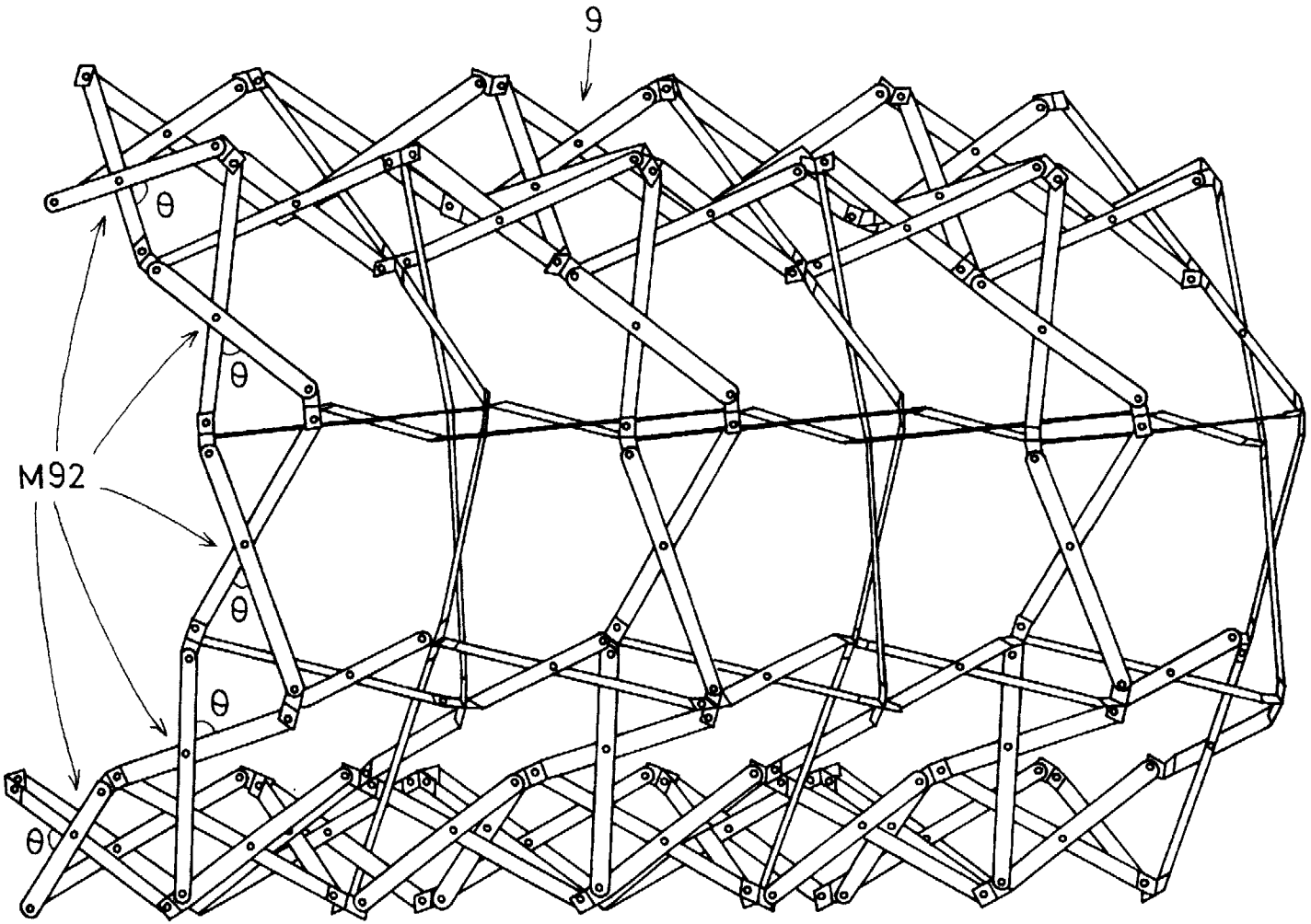
FIG. 34 is a perspective view showing the structure of the ninth embodiment in the most expanded form.

A ninth embodiment will now be described with reference to FIGS. 32 to 34. Again, this embodiment is an example of the invention.

A structure 9 of this embodiment comprises first secondary constituent units M91 which are the secondary constituent units of type 3 (the structures 2) and second secondary constituent units M92 which are the secondary constituent units of type 4. Specifically, what are obtained by coupling the first secondary constituent units M91 to one another in the same vertical orientation in a transversal direction, and what are obtained by coupling the second secondary constituent units M92 to one another in the same vertical orientation in a transversal direction, are coupled to one another alternately in a longitudinal direction. Thus, a lateral face F1 in which primary constituent units with a division ratio of 2:3 appear in the same vertical orientation, and a lateral face F2 in which primary constituent units with a division ratio of 2:1 appear in alternate inverse vertical orientations, are adjacent to one another.

Couplers J1 of type 1 are used at a total of eight corners of the top and the bottom, and like the sixth or the eighth embodiment, the coupling of the secondary constituent units M91 and M92 is made by using couplers J3 and J5 of types 3 and 5.

Figure 32:
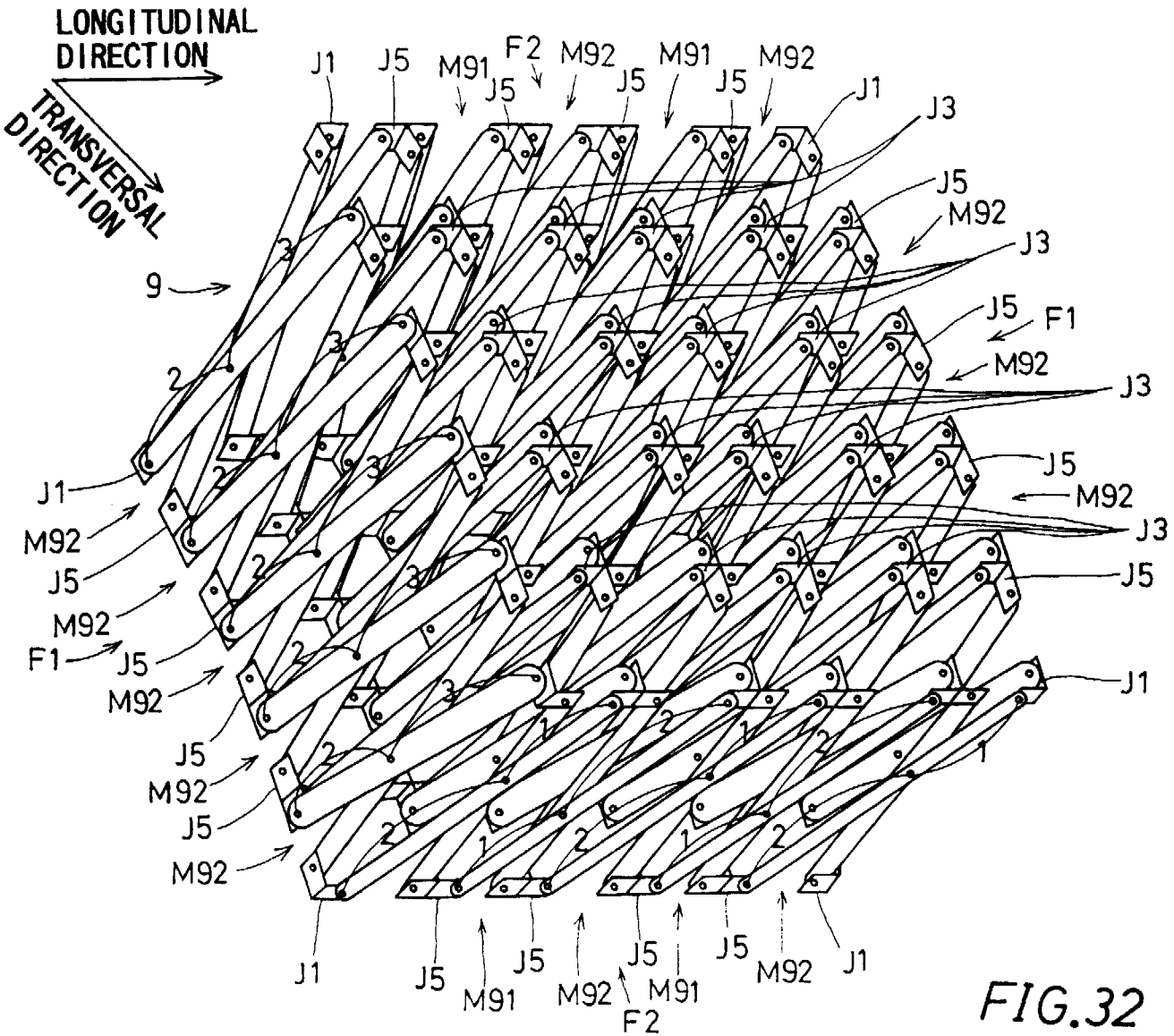
FIG. 32 is a perspective showing a structure according to a ninth embodiment of the invention in the most contracted form.

The structure 9 having, the above construction is shown in FIG. 32 in its most contracted form with a maximum diagonal intersection angle θ of each primary constituent unit U. When a force is exerted to the structure 9 in this most contracted form in a direction of reducing the diagonal intersection angle θ, i.e., increasing the distance between the third rotation axes P3, the structure 9 is changed in form three-dimensionally to assume an intermediate form as shown in FIG. 33 and eventually reach the most expanded form with a minimum diagonal intersection angle θ. The most expanded form is a vault-like form as in the structure 8. By exerting a force to the structure 9 in a direction of increasing the primary constituent unit diagonal intersection angle θ from the most expanded form, the structure 9 is contracted to the most contracted form as shown in FIG. 32. The structure 9, as well as the structure 8, can be used as a three-dimensional torus structure for various large-scale building structures by assembling it to the compact and most contracted form, and then expanding it to the most expanded form or an intermediate form therebefore, thus providing for the action of tension elements noted above, if necessary.

As applications of this embodiment, by varying the division ratio, it is possible to provide a three-dimensional torus, for instance, a structure which is straight in one of the X and Y directions and has a face arrangement of variable curvature of radius in the other direction, or a structure having a spiral sectional profile.

Tenth Embodiment

A tenth embodiment will now be described with reference to FIGS. 35 to 37.

Figure 35:
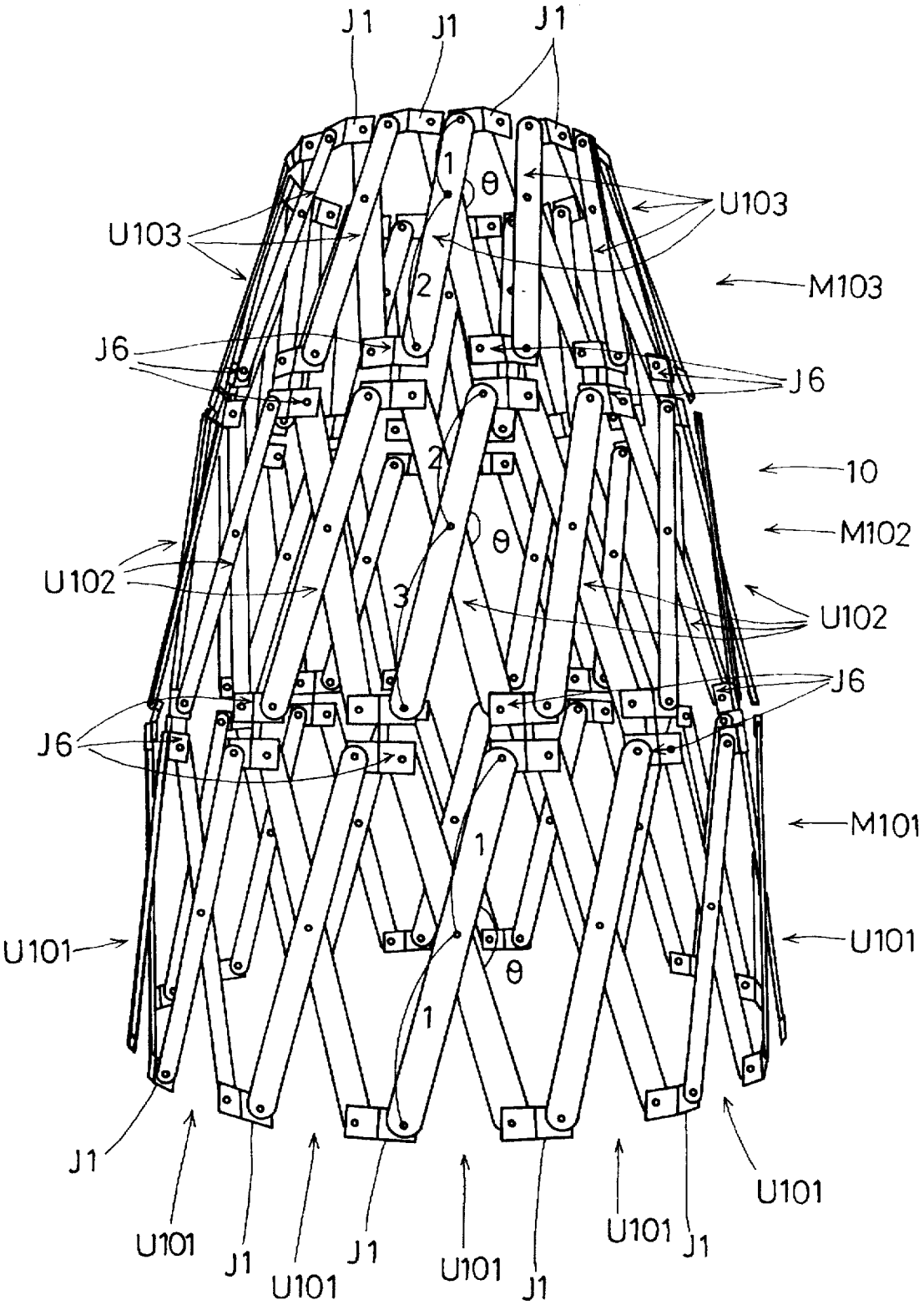
FIG. 35 is a perspective view showing a structure according to a tenth embodiment of the invention in a contracted form.

As shown in FIG. 35, in a structure 10 of this embodiment, secondary constituent units of types 2 and 3 among those of types 2 to 5 are coupled to one another in their axis L direction by using couplers 6 of type 6. More specifically, the structure 10 comprises three vertical stages, i.e., a lower stage constituted by secondary constituent units M101 of type 2, a middle stage constituted by secondary constituent units M102 of type 3, and an upper stage constituted by secondary constituent units M103 of type 3. The structure 10 uses couplers J6 of type 6 for the coupling between the secondary constituent units M101 and the secondary constituent units M102 and also the coupling between the secondary constituent units M102 and the secondary constituent units M103, so that the structure 10 can assume a substantially cylindrical form.

The lower stage secondary constituent units M101 of type 2 each include a plurality of primary constituent units U101 having a division ratio μ of unity and coupled to one another into a ring-like form. The coupling of the primary constituent units U101 is made by using couplers J1 of type 1.

The middle stage secondary constituent units M102 of type 3 each include a plurality of primary constituent units U102 having a division ratio μ of 2/3 and coupled to one another into a ring-like form. The coupling of the primary constituent units U102 is made by using couplers J1 of type 1.

The upper stage secondary constituent units M103 of type 3 each include a plurality of primary constituent units U103 having a division ratio μ of 0.5 and coupled to one another into a ring-like form. The coupling of the primary constituent units U103 is made by using couplers J1 of type 1.

Figure 37:
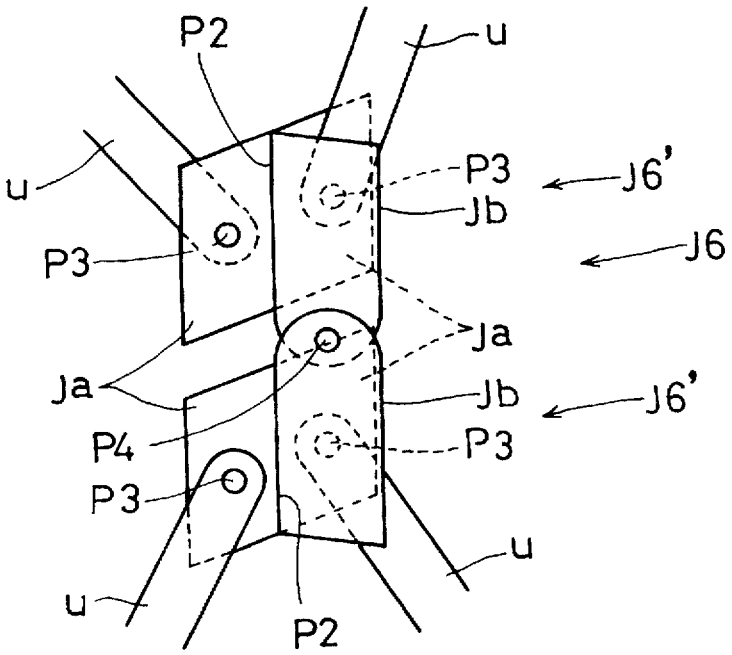
FIG. 37 is a perspective view showing a coupler of type 6.

As shown in FIG. 37, the coupler J6 of type 6 has a structure including two couplers J1 of type 1 coupled together about a fourth rotation axis P4. More specifically, the coupler J6 includes two couplers J6', each of which has two coupling members Ja coupled together for relative rotation about a second rotation axis P2 as a common axis and a further coupling member Jb. The two couplers J6' have their coupling members Jb coupled together for relative rotation about a fourth rotation axis P4. To each of the coupling members Ja, one diagonal member u is coupled for rotation about a third rotation axis P3. The fourth rotation axis P4 is perpendicular to each second rotation axis P2. The two second rotation axes P2 each of the two coupling members Ja lie in the same plane, that is, they are for relative rotation about the fourth rotation axis P4 in the same plane.

Figure 36:
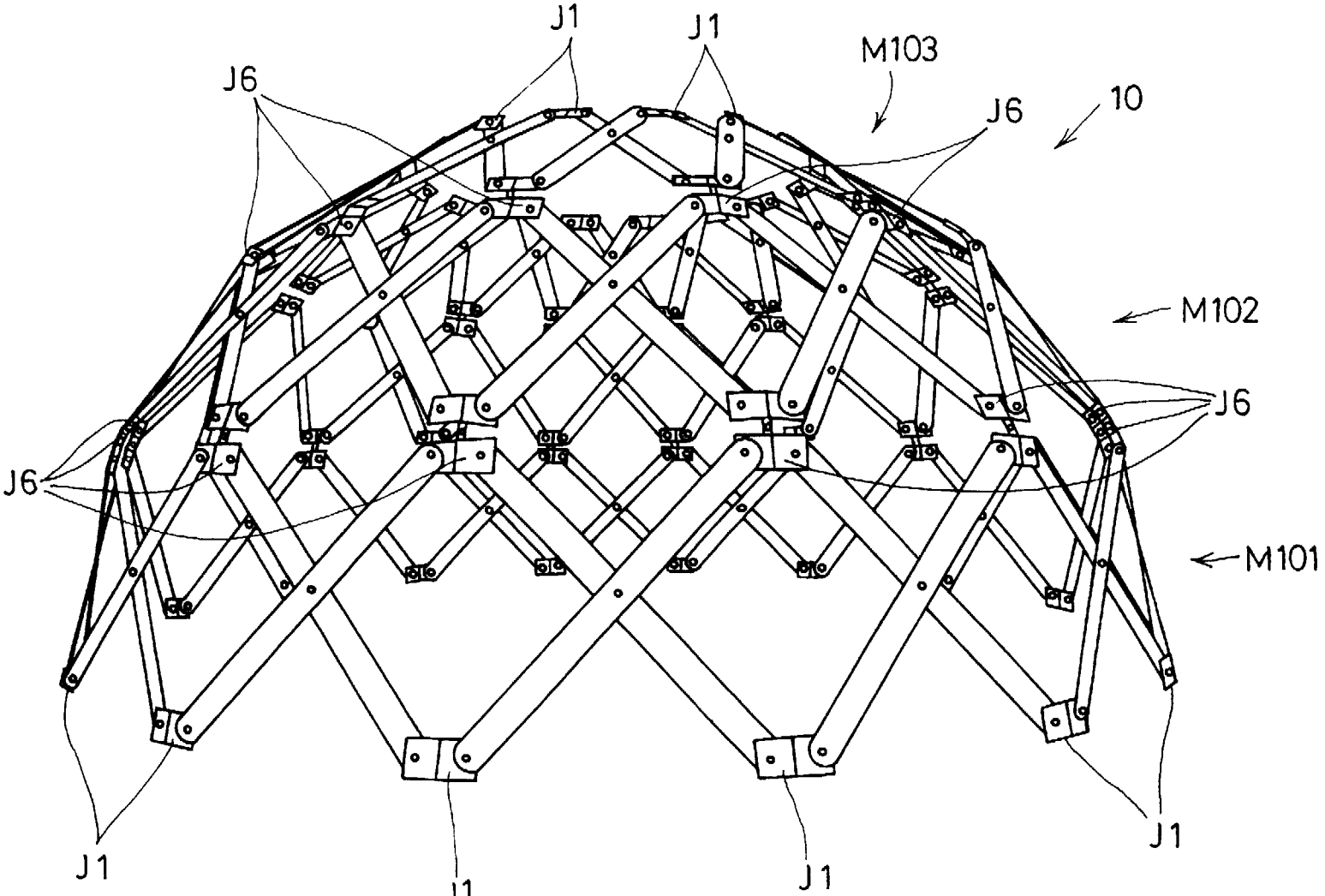
FIG. 36 is a perspective view showing the structure of the tenth embodiment in an expanded form.

When an external force is exerted to the structure 10 having the above construction in a direction of reducing the diagonal intersection angle θ of the primary constituent units U101, U102 and U103 of the secondary constituent units M101, M102 and M103, the secondary constituent units M101, M102 and M103 are expanded as a whole to assume an intermediate form as shown in FIG. 36 and eventually reach the most expanded form (not shown). When a converse external force is applied to increase the diagonal intersection angle θ of the primary constituent units U101, U102 and U103, the structure 10 is uni-dimensionally contracted to assume a form as shown in FIG. 35 and eventually reach the most contracted form, which is a substantially cylindrical form. The structure 10 is three-dimensionally expanded and contracted between the most contracted form and the most expanded form, and, as shown in FIG. 36, it forms a dome-like structure in its intermediate form.

This structure 10 again may be used as a structure constituting, for instance, a dome-like roof of a building by assembling together the number of primary constituent units U101, U102 and U103 as shown above and then developing the structure to the dome-like form as shown in FIG. 36.

11th Embodiment

An 11th embodiment will now be described with reference to FIGS. 38, 39, 40(A) and 40(B).

Figure 38:
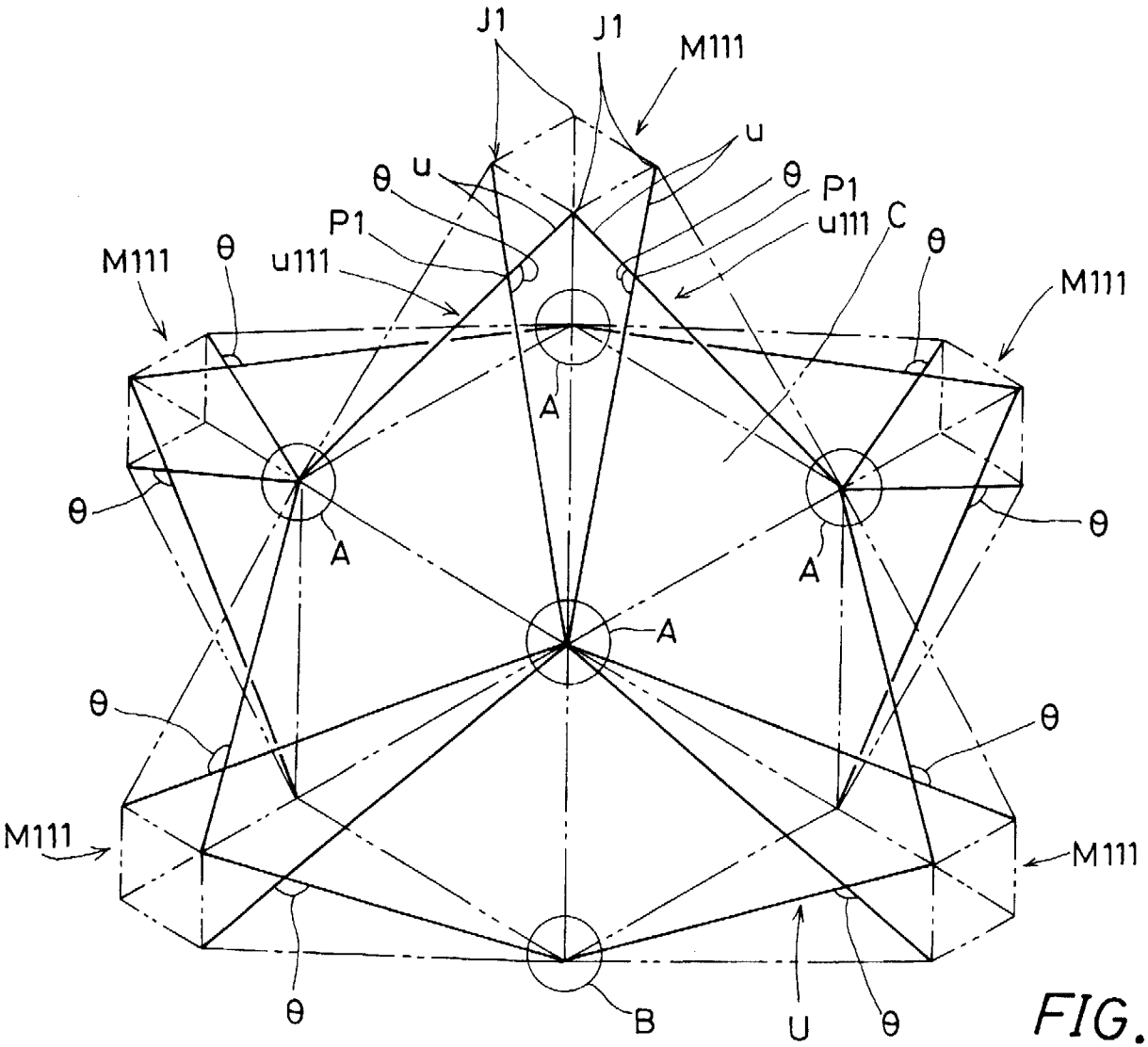
FIG. 38 is a schematic perspective view showing a structure according to an 11th embodiment of the invention in an contracted form.

As shown in FIG. 38, a structure 11 of this embodiment comprises five secondary constituent units M111 located on the respective lateral faces of a regular hexahedron C other than the base thereof. The secondary constituent units M111 are coupled to one another by couplers J7 of type 7 and also by couplers J8 of type 8. Each of the secondary constituent units M111 is substantially the same in structure as the above structure 2 (see FIG. 7). Specifically, it includes four primary constituent units U111 (only two thereof being shown) which are coupled to one another into a ring-like form, and each constitute a lateral face of a quadrangular pyramid frustum and have two diagonal members u mutually coupled for relative rotation about a first rotation axis P1. On the top side of each secondary constituent element M111, the primary constituent units U111 are coupled to one another by couplers J1l of type 1.

Figure 39:
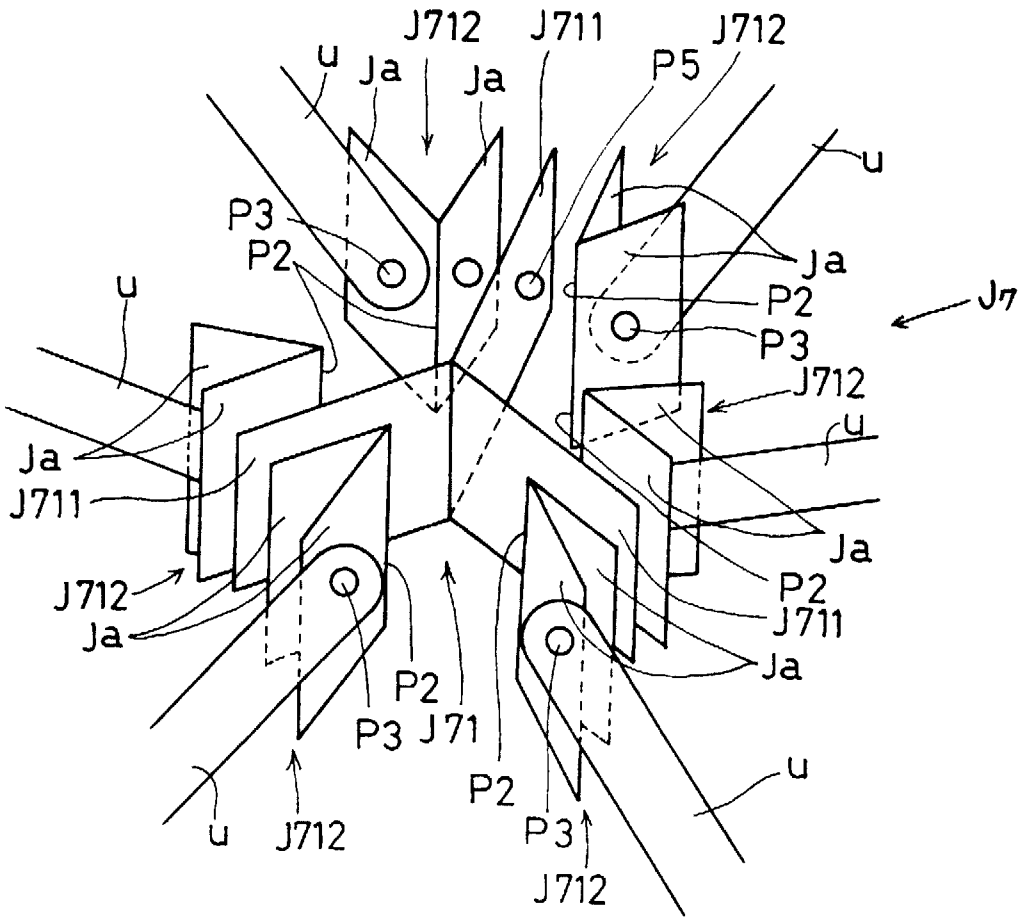
FIG. 39 is a perspective view showing a coupler of type 7.

On the base side of each secondary constituent unit M111, the primary constituent units U111 are coupled to one another by couplers J7 of type 7. As shown in FIG. 39 which specifically shows part A in FIG. 38, each coupler J7 of type 7 includes a main coupler J71 having three coupling members J711, and six sub-couplers J712 each coupled to each side of the coupling members J711 for rotation about a fifth rotation axis P5. The three coupling members J711 of the main coupler J71 are sheet-like members secured together at an angle of 120ø between adjacent ones of them. Each coupling member J711 has the fifth rotation axis P5 about which each sub-coupler J712 coupled to each side of the coupling member J711 is rotatable. Like the coupler J1 of type 1, each sub-coupler J712 has paired coupling members Ja coupled together for relative rotation about a second rotation axis P2. An end of a diagonal member u is coupled to one of the paired coupling members Ja of the sub-coupler J712 for rotation about a third rotation axis P3, and the other coupling member Ja is coupled to each coupling member J711 of the main coupler J71 for rotation about a fifth rotation axis P5. The coupler J7 of type 7 thus couples together six diagonal members u.

The three secondary constituent units M111 are coupled to one another with one coupler J7 of type 7 as described above used for each of four parts A in FIG. 38. These parts A correspond to the four upper corners of the regular hexahedron C. The coupling structure in part A is shown schematically in FIG. 40(A).

Figure 40A:
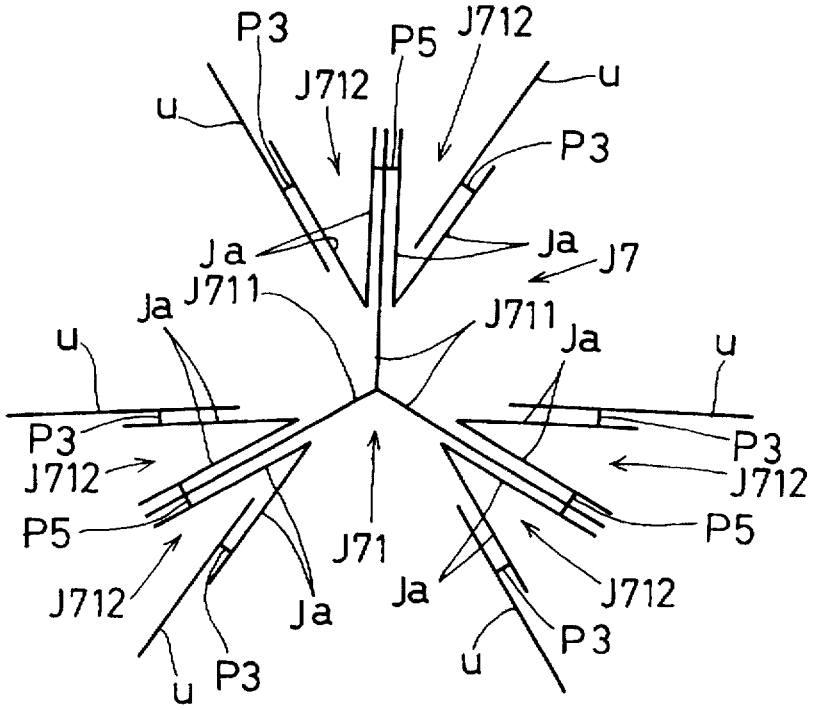
FIG. 40(A) is a schematic view showing a coupler of type 7.
Figure 40B:
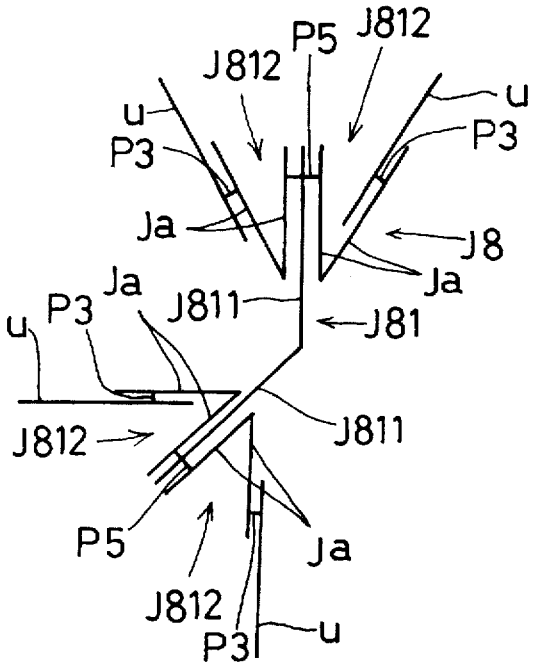
FIG. 40(B) is a schematic view showing a coupler of type 8.

At each of four base corners B of the regular hexahedron C, two adjacent secondary constituent units M111 are coupled together by a coupler J8 of type 8. The coupling structure in part B is shown in FIG. 40(B). As is seen, this coupler J8 of type 8 has a structure constituted by two of the coupling members J711 of the main coupler J71 of the above coupler J7 of type 7. More specifically, the coupler J8 of type 8 includes a main coupler J81 having two coupling members J811, and four sub-couplers J812 each coupled to each side of each coupling member J811 for rotation about a fifth rotation axis P5. One end of a diagonal member u is coupled to one coupling member Ja of each sub-coupler J812 for rotation about a third rotation axis P3, and the other coupling member Ja is coupled to each coupling member J811 for rotation about a fifth rotation axis P5.

As has been shown, the structure 11 of this embodiment comprises five secondary constituent units M111 which are coupled to one another by using the couplers J7 of type 7 and the couplers J8 of type 8. Thus, although not shown, when the structure 11 of this embodiment is brought closer to the most expanded form by applying external force thereto in the direction of reducing the intersection angle θ of each primary constituent unit U111, it is deformed into a substantially semi-spherical dome.

While this embodiment has concerned with the structure comprising the five secondary constituent units M111 each located on each lateral face of a regular hexahedron C, this is by no means limitative; for example, the structures 1 as described above or other structures constituting pentangular pyramid frustums, triangular pyramid frustums, etc. may be disposed such that each constitutes each face of a regular or pseudo regular polyhedron having 12 or 20 faces or a cube or other polyhedrons and be coupled together by using predetermined couplers. In this case, as the couplers, the coupler 7 of type 7 described above may be used by increasing or reducing, if necessary, the number of the sub-couplers J712 or the number of the coupling members J711 in the main coupler J71.

12th Embodiment

Figure 41:
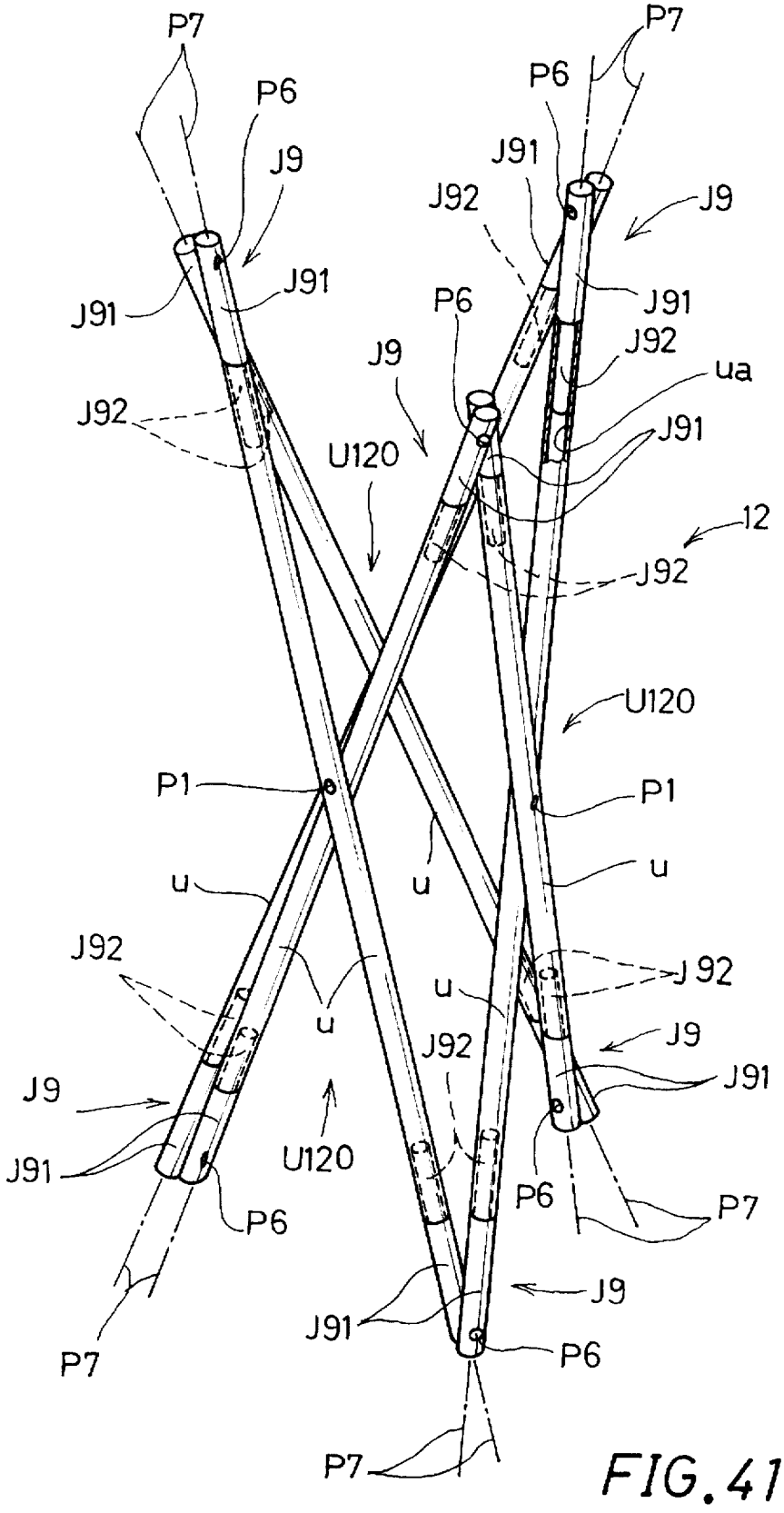
FIG. 41 is a perspective view showing a structure according to a 12th embodiment of the invention in a contracted form.
Figure 42:
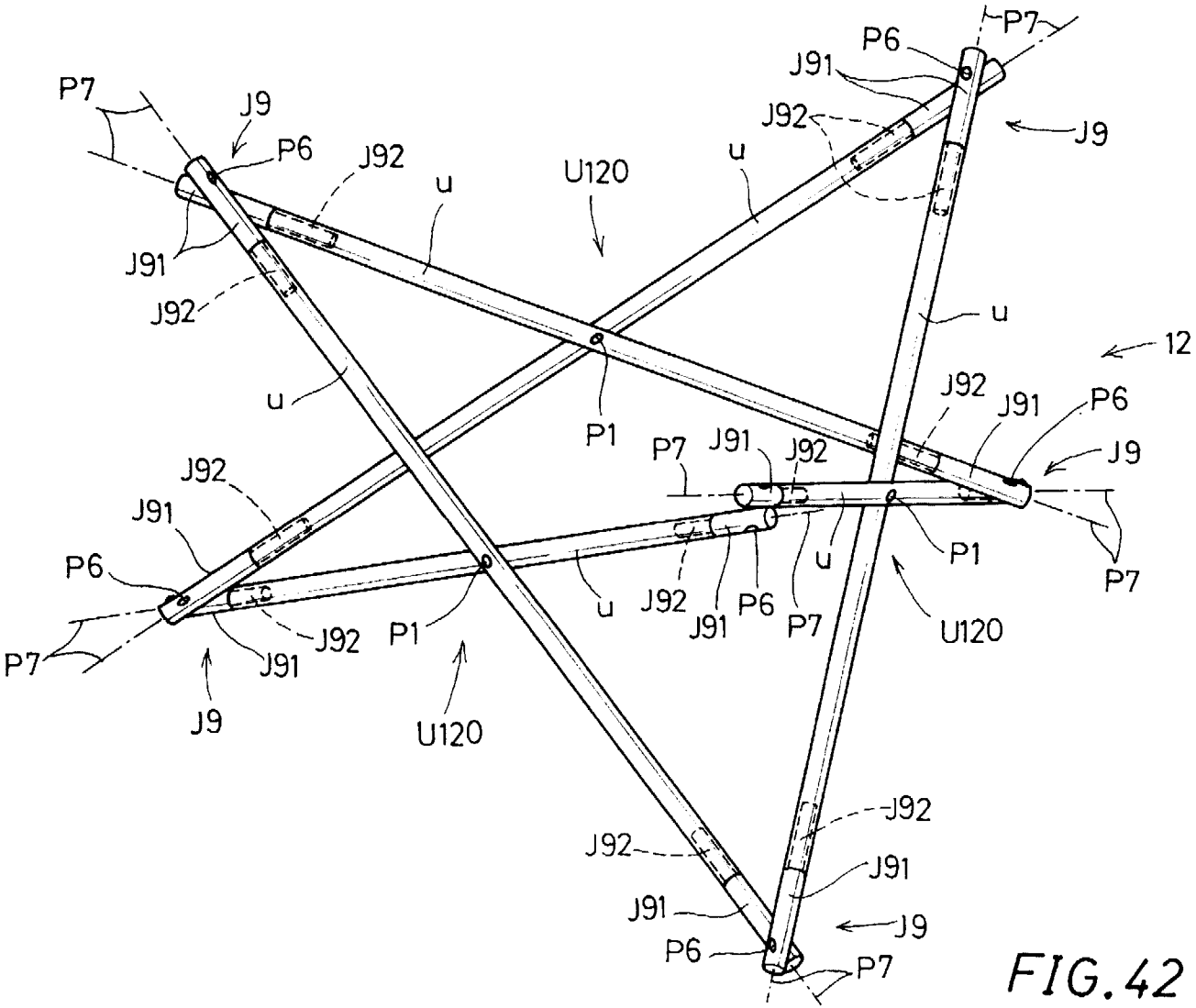
FIG. 42 is a perspective view showing the structure of the 12th embodiment in a contracted form.

A 12th embodiment will now be described with reference to FIGS. 41 and 42. A structure 12 of this embodiment comprises three primary constituent units U120 each located on a rectangular lateral face of a triangular prism. Each primary constituent unit U120 includes paired diagonal members u constituting the diagonals of the face and coupled together into the form of letter X for rotation about a first rotation axis P1 at the intersection of the diagonals. The diagonal members u are made from a sufficiently rigid pipe; a pipe of the same size is used for all the six diagonal members u of the three primary constituent units U120. The two diagonal members u in each primary constituent unit U120 are coupled together with a division ratio of 1:1 at the first rotation axis P1.

The three primary constituent units U120 are coupled to one another by a total of six couplers J9 of type 9 into a ring-like form. Each coupler J9 includes coupling members J91 which are each obtained by separating end portions of each diagonal member u to a predetermined length, adjacent coupling members J91 being coupled together for relative rotation about a sixth rotation axis P6. The sixth rotation axis P6 is perpendicular to the axes of the two coupling members J91 which pass through apexes of the triangular prism and which are coupled together (i.e., the axes of the two diagonal members u). Each coupling member J91 has an integral coaxial coupling bar J92 at its separated end. The coupling bar J92 is rotatably inserted in a bore ua of a diagonal member u extending from the associated end thereof. Each coupling member J91 is thus coaxially coupled to each diagonal member u. Each coupling member J91 is thus rotatable about the axis of the associated diagonal member u. This axis of rotation of the coupling member J91 will hereinafter be referred to as a seventh rotation axis P7.

Figure 48A:
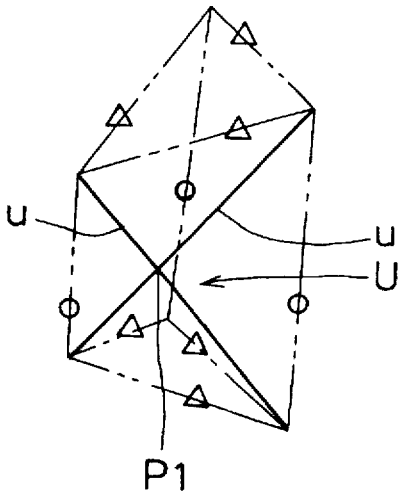

Like structures 1 to 11 of the above respective embodiments, the structure 12 having the above construction can be three-dimensionally expanded and contracted between the two-dimensionally expanded state (i.e., most expanded form) and the uni-dimensionally contracted form (i.e., most contracted form). The structure 12 is shown in a form close to the most contracted form in FIG. 41 and in a form close to the most expanded form in FIG. 42. As shown in FIG. 48(A), the structure 12 can be held in a predetermined stable state by appropriately providing tension elements or compressive elements along edges of the triangular prism. Such a structure may be utilized for various building structures or the like.

The diagonal members u may be made from pipes, but they may be made of solid bars or square bars instead of pipes. While the structure 12 of this embodiment has been described in relation to a triangular prism, this is by no means limitative, and the invention is applicable to other prisms or pyramid frustums as well. Furthermore, it is possible to develop the structure into a more complicated structure by combining a plurality of structures 12 each as an secondary constituent unit.

13th Embodiment

A 13th embodiment which is an example of the invention will now be described with reference to FIGS. 54 and 55. A structure 13 of this embodiment comprises a combination of secondary constituent units, which are one version of secondary constituent units of type 3 constituting a solid (pentangular pyramid frustum) having pentagonal base and lateral faces (hereinafter referred to as "secondary constituent unit M136 of type 6"), and those which are one version of secondary constituent units of type 4 constituting a solid (hexangular pyramid frustum) having hexagonal base and lateral faces (hereinafter referred to particularly as "secondary constituent unit M137 of type 7").

The secondary constituent unit M136 of type 6 includes primary constituent units U136, each of which constitute each lateral face of a pentangular pyramid frustum and have paired diagonal members u coupled together for relative rotation about a first rotation axis P1. The primary constituent units U136 of type 6 have an equal ratio μ of division of the diagonal members u by the first rotation axis P1 between opposite end third rotation axes P3, and are coupled to one another such that the large and the small parts of their division ratio μ are disposed in the same orientation. The secondary constituent unit M137 of type 7 includes primary constituent units U137, each of which constitutes each lateral face of a hexangular pyramid frustum and have paired diagonal members u coupled together for relative rotation about a first rotation axis P1. The primary constituent units P137 have an equal ratio μ of division of the diagonal members u by the first rotation axis P1 between the third rotation axes P3, and are coupled to one another such that the large and the small parts of the division ratio μ are disposed in the reverse orientation, alternately. In the structure 13 , pluralities of the two different kinds of secondary constituent units M136 and M137 are coupled to one another in a direction perpendicular to the axes of these units M136 and M137 (i.e., the direction of the plane of paper in FIG. 54) with a primary constituent unit U136 (or U137) used in common between adjacent secondary constituent units.

Figure 54:
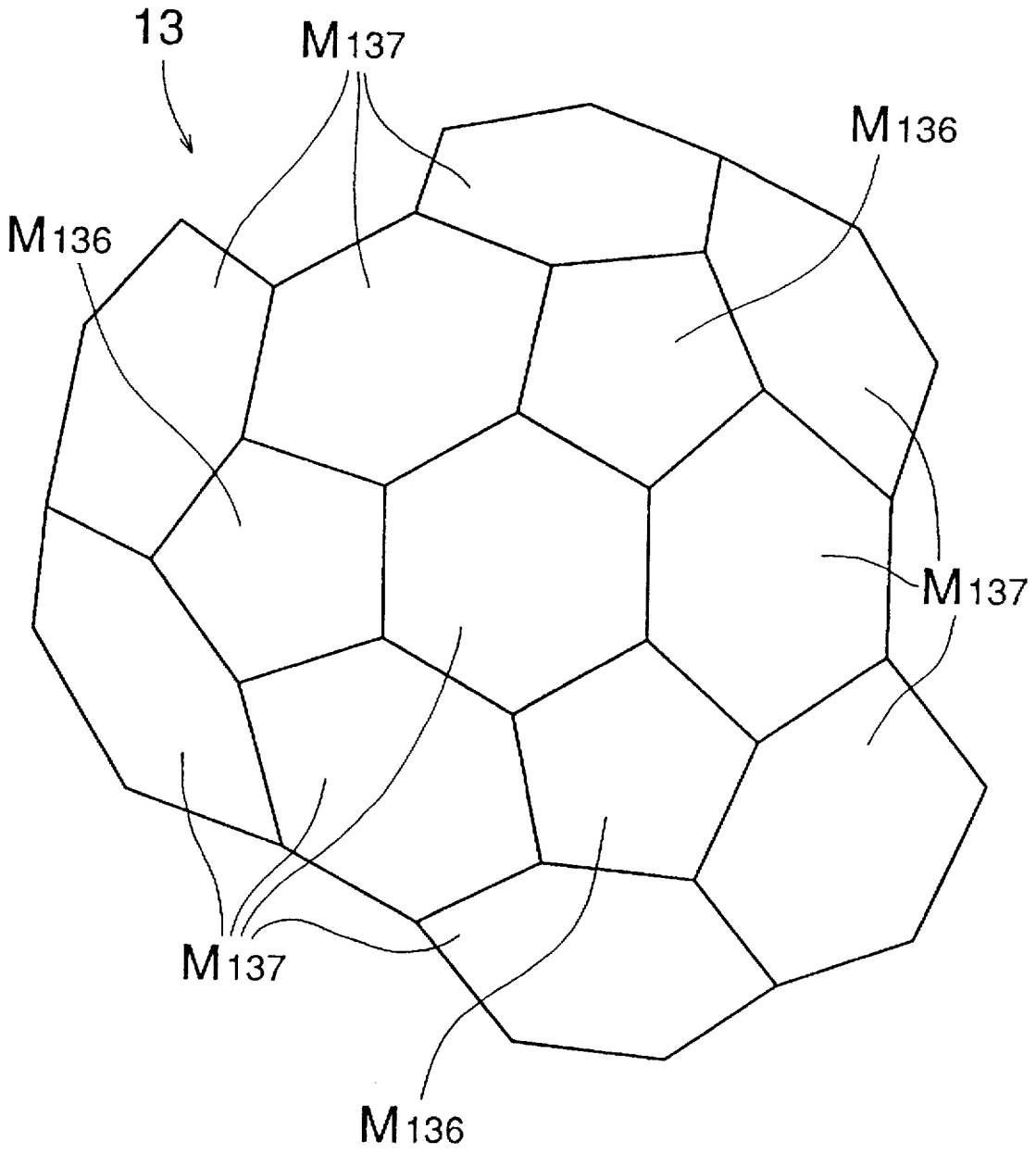
FIG. 54 is a schematic plan view showing a structure according to a 13th embodiment of the invention in the most contracted form.
Figure 55:
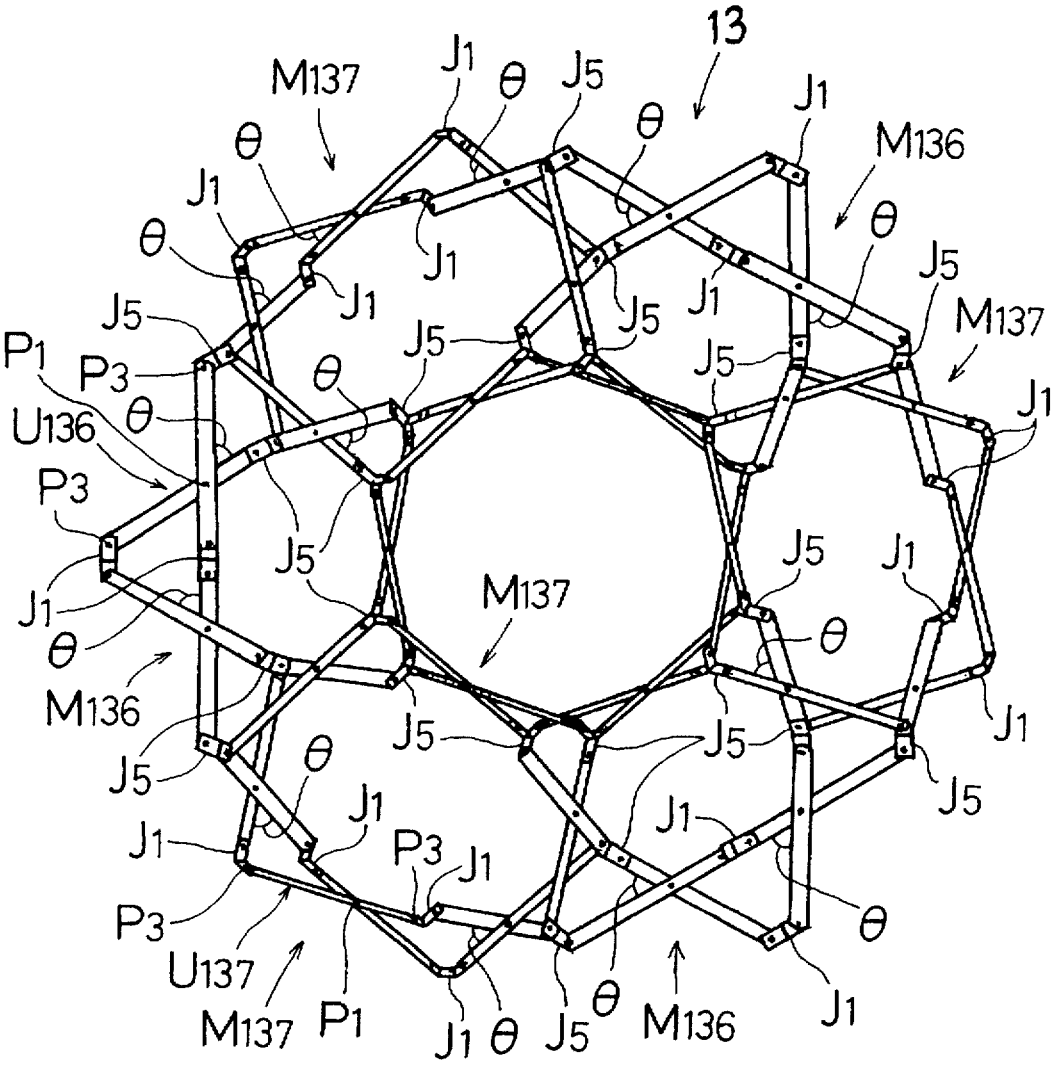
FIG. 55 is a perspective view showing the structure of the 13th embodiment in the most expanded form.

The structure 13 is shown in its uni-dimensionally contracted form or the most contracted form in the schematic plan view of FIG. 54 and in a dome-like intermediate form in FIG. 55. As shown in FIG. 54, the structure 13 comprises three secondary constituent units M136 of type 6 and ten secondary constituent units M137 of type 7. The three intermediate constituent units M136 of type 6 are each coupled with respect to every other one of six lateral faces of one secondary constituent unit M137 of type 7. FIG. 55 shows only part of the structure 13, i.e., only three secondary constituent units M136 of type 6 and four secondary constituent units M137 of type 7. Adjacent secondary units M136 and M137 are coupled together by using the above coupler J5 of type 5.

Again, this structure 13 is two-dimensionally expanded to the most expanded form by applying an external force thereto in the direction of reducing the intersection angle θ of the primary constituent units U136 and U137 in the secondary constituent units M136 and M137. As the structure 13 is two-dimensionally expanded, it eventually assumes a dome-like form having a double layer structure as shown in FIG. 55. By applying an external force to the structure 13 in the direction of increasing the angle θ, the structure is uni-dimensionally contracted to the most contracted form, that is, it eventually assumes a form as shown in FIG. 54.

14th Embodiment

Figure 56:
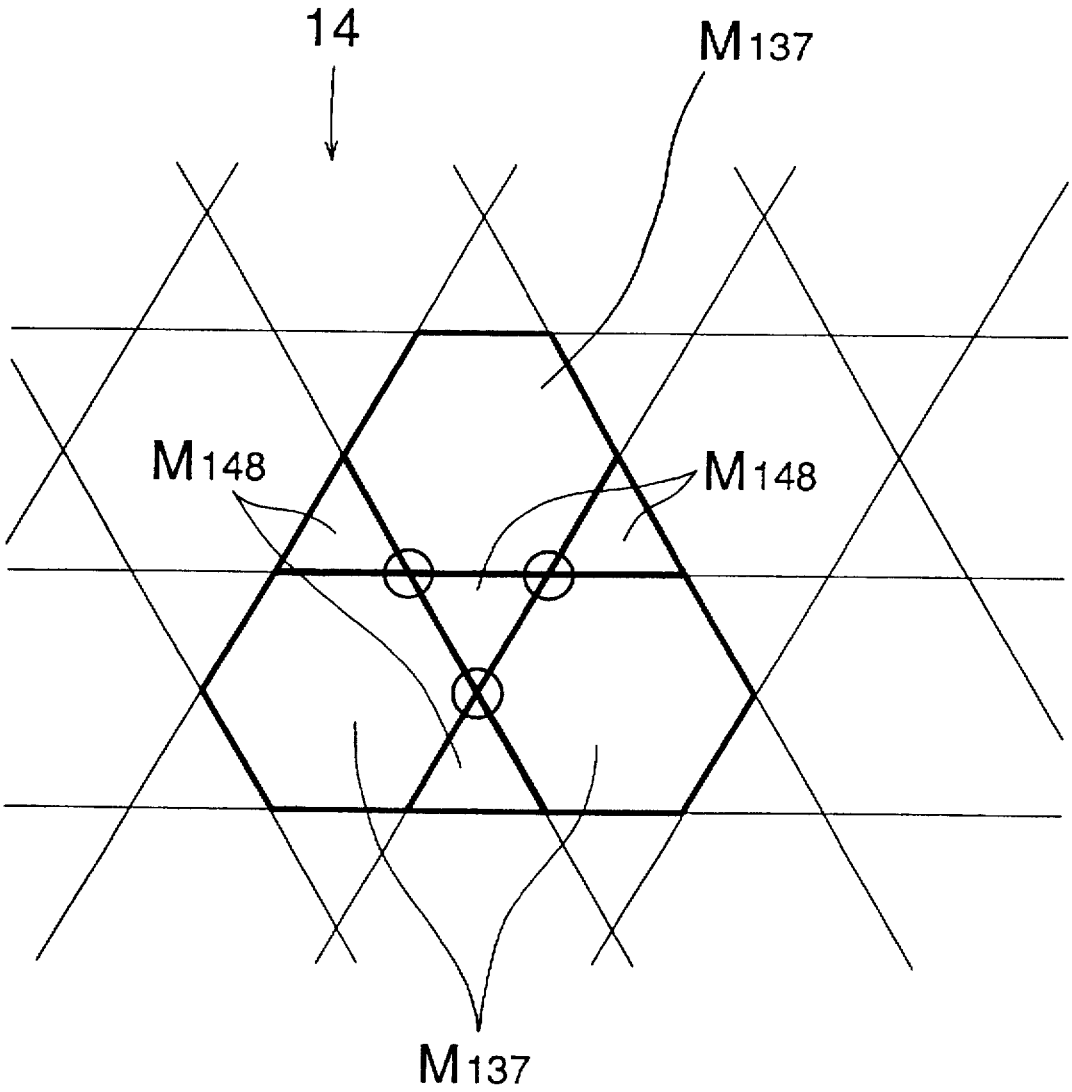
FIG. 56 is a schematic plan view showing a structure according to a 14th embodiment of the invention in the most contracted form.

A 14th embodiment which is also an example of the invention will now be described with reference to FIGS. 56 to 59. A structure 14 of this embodiment is an example of the invention as set forth in claim 19. This structure 14 comprises a combination of secondary constituent units M137 of type 7 and secondary constituent units M148 of type 8. In this embodiment, as best shown in FIG. 56, six secondary constituent units M148 of type 8 are each coupled to each lateral face of each secondary constituent unit M137 of type 7.

The secondary constituent unit M148 of type 8 includes three primary constituent units U148, each of which is one version of the secondary constituent unit of type 3 and is located on each lateral face of a triangular pyramid frustum having triangular base and top. The primary constituent units U148 each have paired rigid diagonal members u constituting the diagonals of the lateral face and coupled to one another for relative rotation about a first rotation axis P1 dividing the segment of the diagonal members u between opposite end third rotation axes P3 with an equal ratio μ. They are coupled to one another such that the large and the small parts of the division ratio μ are disposed in the same orientation. In the secondary constituent units M137 of type 7, adjacent primary constituent units are oriented such that they provide inverse division ratios μ to each other.

The secondary constituent units M137 and secondary constituent units M148 are coupled together basically by using couplers J3 of type 3 (see FIG. 19). At each end of the structure 14, however, the coupler J1 or J5 of type 1 or 5 is used (see FIG. 2 or 24). In FIG. 56, localities where the couplers J3 of type 3 are used are labeled by circle marks.

Figure 57:
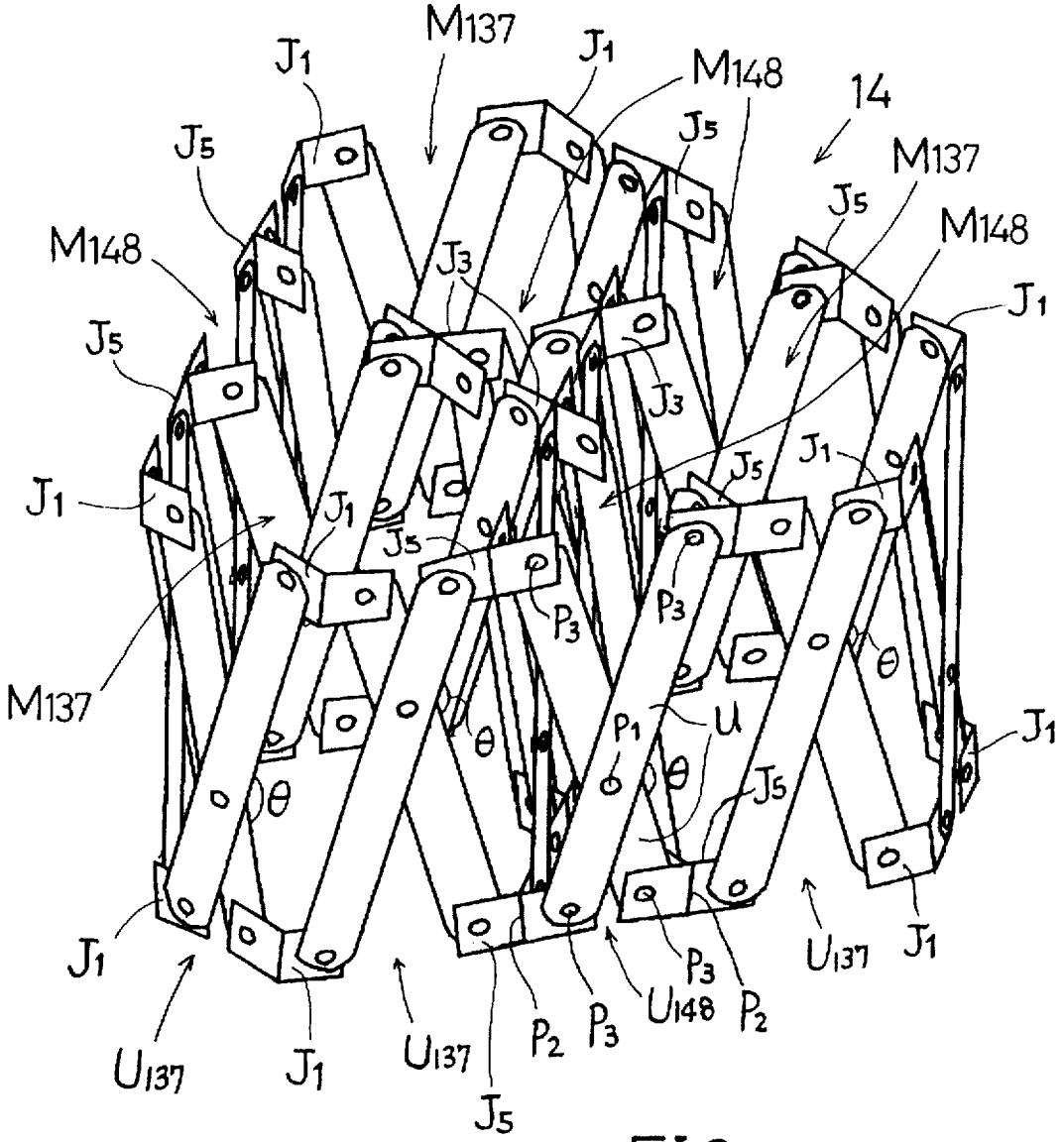
FIG. 57 is a perspective view showing the structure of the 14th embodiment in the most contracted form.
Figure 58:
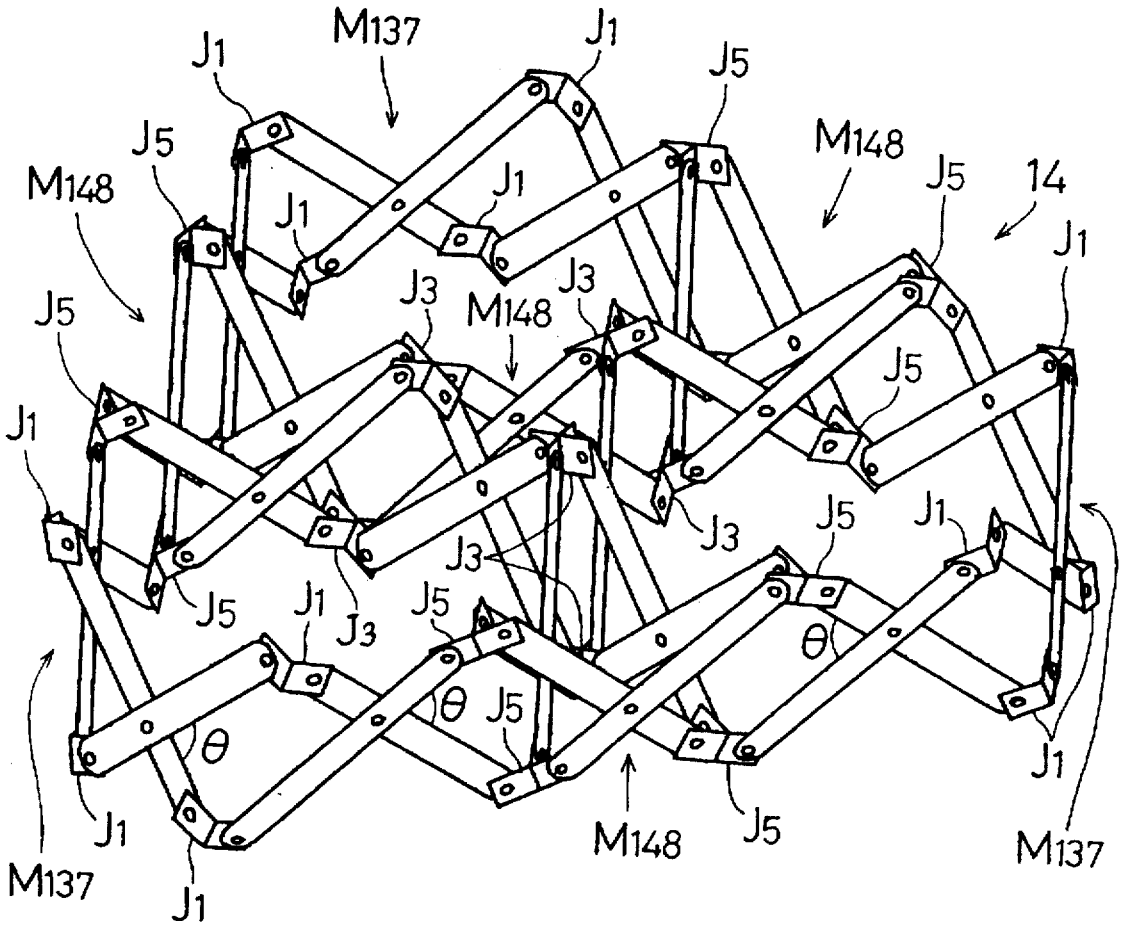
FIG. 58 is a perspective view showing the structure of the 14th embodiment in an intermediate expanded or contracted form.
Figure 59:
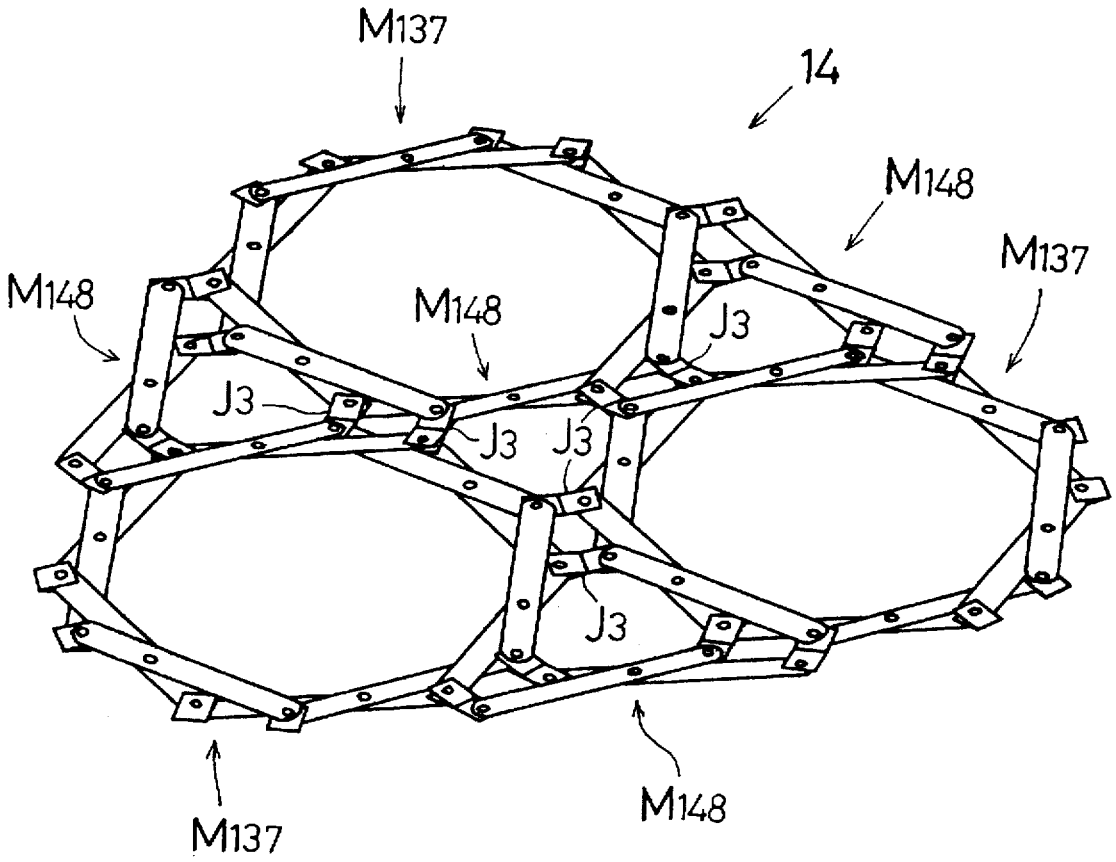
FIG. 59 is a perspective view showing the structure of the 14th embodiment in the most expanded form.

Again, the structure 14 having the above construction, is developed, by applying an external force thereto (either vertical compressive force or lateral tensile force) in the direction of reducing the intersection angle θ in each primary constituent unit U137 or U148, such that it is two-dimensionally expanded from its form close to the most contracted form as shown in FIG. 57 through an intermediate form as shown in FIG. 58 to eventually assume the most expanded form as shown in FIG. 59. During its development, the structure 14 is developed to a panel-like form having a double layer structure as its intermediate form (i.e., a form as shown in FIG. 58). Unlike this structure 14, the structure 13 described above is developed to a dome-like form having a double layer structure.

By applying an external force (i.e., either vertical tensile force or lateral compressive force) in the direction of increasing the intersection angle θ, the structure 14 is developed from the form as shown in FIG., 59 to the form as shown in FIG. 58 and then to the form as shown in FIG. 57. Thus, it is eventually three-dimensionally contracted to the most contracted form. The structure 14 in this most contracted form is shown in the schematic plan view of FIG. 56.

Any of the structures 6 to 9 of the sixth to ninth embodiments comprises a plurality of secondary constituent units of type 3 or 4 coupled to one another and each constituting a solid having quadrangular base and lateral faces. The structure 14 of this embodiment is set apart from the structures 6 to 9 in that it is obtained by coupling together the secondary constituent units M137 of type 7 each constituting a solid having hexagonal base and lateral faces and secondary constituent units M148 of type 8 each constituting a solid having triangular base and lateral faces. The secondary constituent unit M137 of type 7 is one version of the secondary constituent unit of type 4, and the secondary constituent unit M148 of type 8 is one version of the secondary constituent unit of type 3. Consequently, the secondary constituent units of types 3 and 4 are coupled together without regard to the shapes of the base and top of the units, and can provide a double layer structure as a result of their development.

The structures 6 to 9 as well as the structure 14 of this embodiment are developed into forms, which are determined by the arrangement of the division ratios μ of the primary constituent units U. Specifically, the structure is developed into a panel-like form (i.e., in a direction of plane or two-dimensionally) in a direction in which like division ratios μ are provided, but the large and the small parts thereof are disposed in the reverse orientation, alternately. The structure is developed into a curved form (i.e., three-dimensionally) in a direction in which like division ratios μ are provided, but the large and the small parts thereof are disposed in the same orientation. As an example, with the structure 9 shown in FIG. 32, the lateral faces provide division ratios μ of 2:3 vertically in the same orientation in the transversal direction. In this direction, the structure is thus developed into a curved form. In the longitudinal direction, on the other hand, a division ratio μ of 2:1 and the inverse thereof are provided alternately. In this direction, the structure is thus developed into a panel-like form. Consequently, the structure is developed as a whole into a vault-like form.

With the structure 8 shown in FIG. 29, lateral faces provide alternate division ratios of 2:1 and 1:1 in the transversal direction. In this direction, the structure is thus developed into a curved form. In the longitudinal direction, a division ratio of 2:1 and the inverse thereof are provided vertically alternately. In this direction, the structure is thus developed into a panel-like form. As a whole, the structure is thus developed into a vault-like form.

With the structure 6 of the sixth embodiment, the large and the small parts of the division ratios are disposed in the reverse orientation vertically alternately in both the transversal and longitudinal directions. The structure 6 thus undergoes linear development in both the directions, and is thus developed into a panel-like form.

Thus, while the structure 14 of this embodiment has been described in relation to one for development into a panel-like form, it is possible to provide a structure for development into a vault-like form or dome-like form by suitably selecting the division ratio μ provided by each primary constituent unit U. It is also possible to combine the structure 14 of this embodiment and the structure 13 of the 13th embodiment to obtain structures with greater division numbers for development into a dome-like form having double layer structures.

While the structure 14 shown in FIGS. 56 to 59 comprises four secondary constituent units M148 of type 8 and three secondary constituent units M137 of type 7, it is of course possible to obtain double layer structures of greater size by coupling together greater numbers of secondary constituent units M137 and M 148 of types 7 and 8.

15th Embodiment

Figure 60:
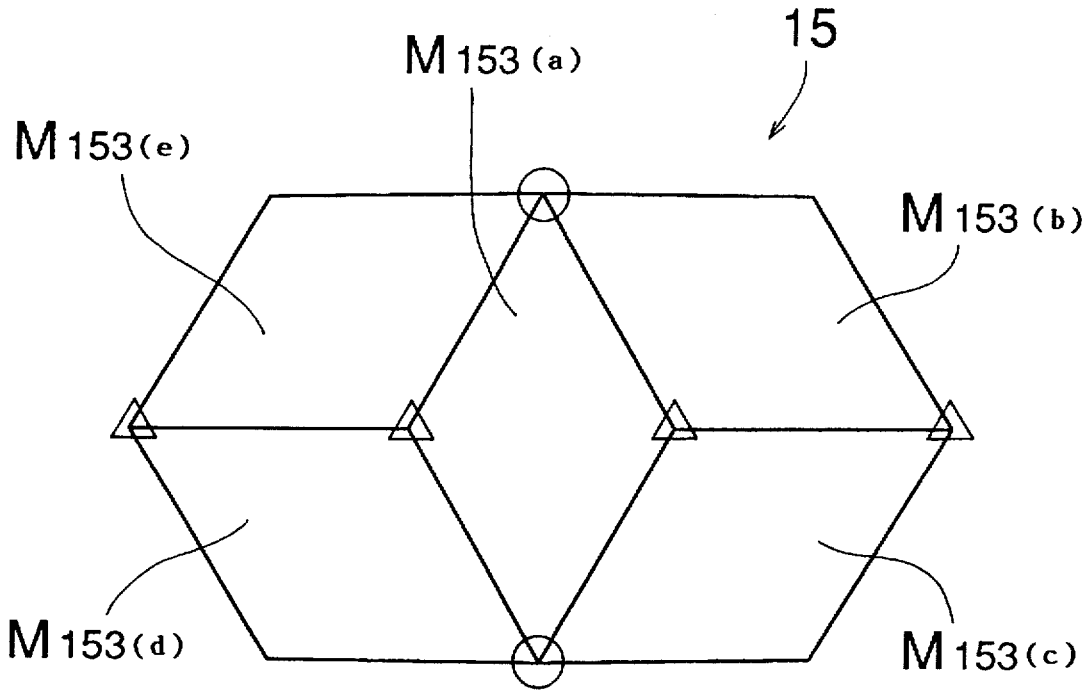
FIG. 60 is a schematic plan view showing a structure according to a 15th embodiment of the invention in the most contracted form.

A 15th embodiment which is an example of the invention will now be described. As shown in FIG. 60, a structure 15 of this embodiment comprises five secondary constituent units M153 of type 3 (i.e., structures 2 of the second embodiment) in which the top and base are quadrangular. Of these secondary constituent units M153, four units M153(*b*) to M153(*e*) are coupled to the respective lateral face of the remaining unit M153(*a*) with a primary constituent unit U153 used in common between each of them and the unit M153(*a*), and also they are each coupled to each adjacent secondary constituent unit M153 with a primary constituent unit U153 used in common between the two units. The top and base of the secondary constituent units M153(*a*) to M153(*e*) are thus rhombic (possibly parallelogrammic). In other words, the structure 15 of this embodiment comprises the five secondary constituent units M153 of type 3 having the rhombic top and base and coupled to one another in a direction perpendicular to their axes L with primary constituent units U153 each used in common between adjacent units. The large and the small parts of the division ratio μ in the primary constituent units U153 are all disposed in the same orientation. The coupling between adjacent ones of the secondary constituent units M153 is made by using a coupler J5 of type 5 or a coupler J3 of type 3. The coupler J5 of type 5 is used at each locality indicated by a triangle mark in FIG. 60, and the coupler J3 of type 3 is used at a locality indicated by a circle mark.

Figure 61:
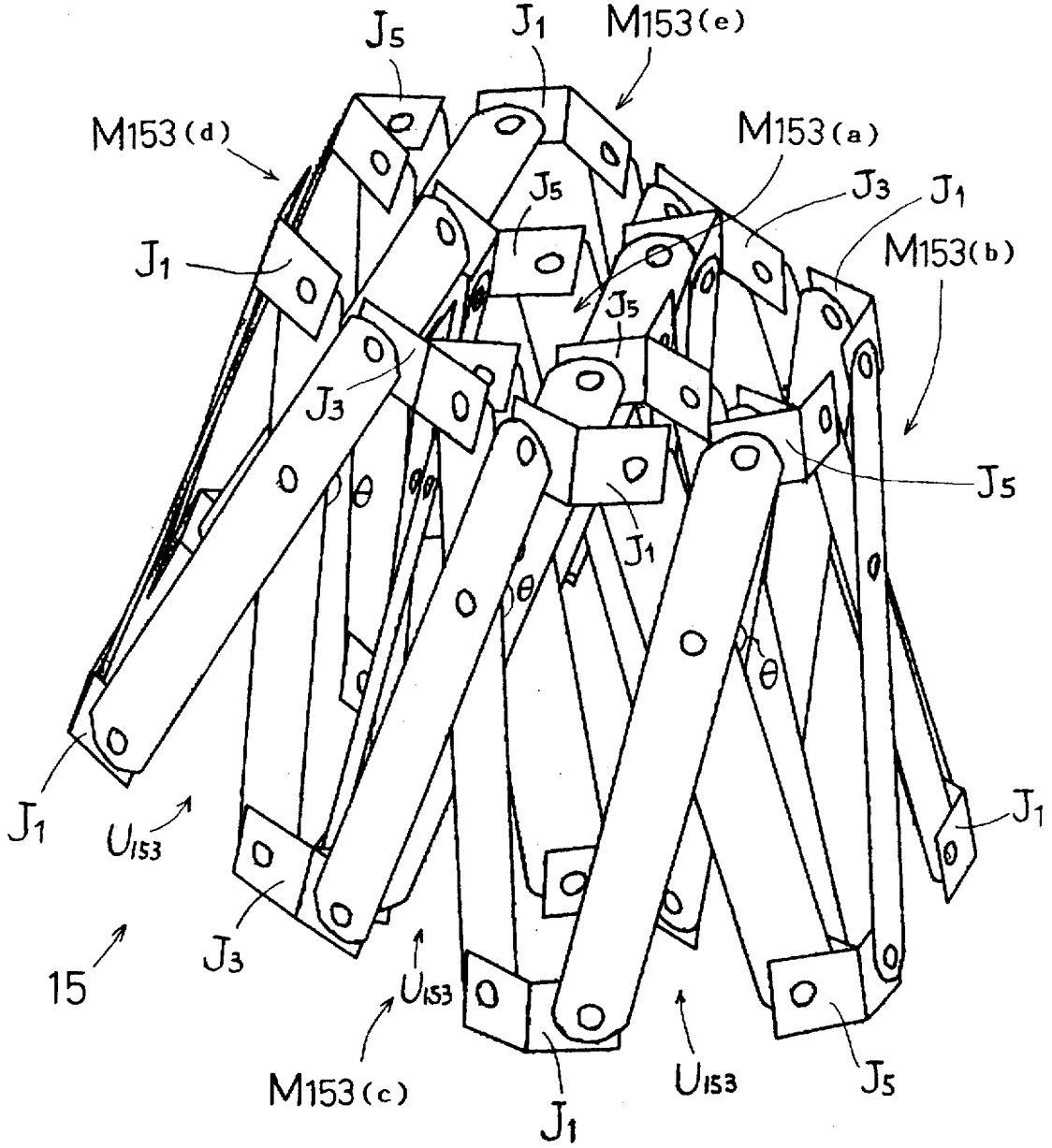
FIG. 61 is a perspective view showing the structure of the 15th embodiment in the most contracted form.
Figure 62:
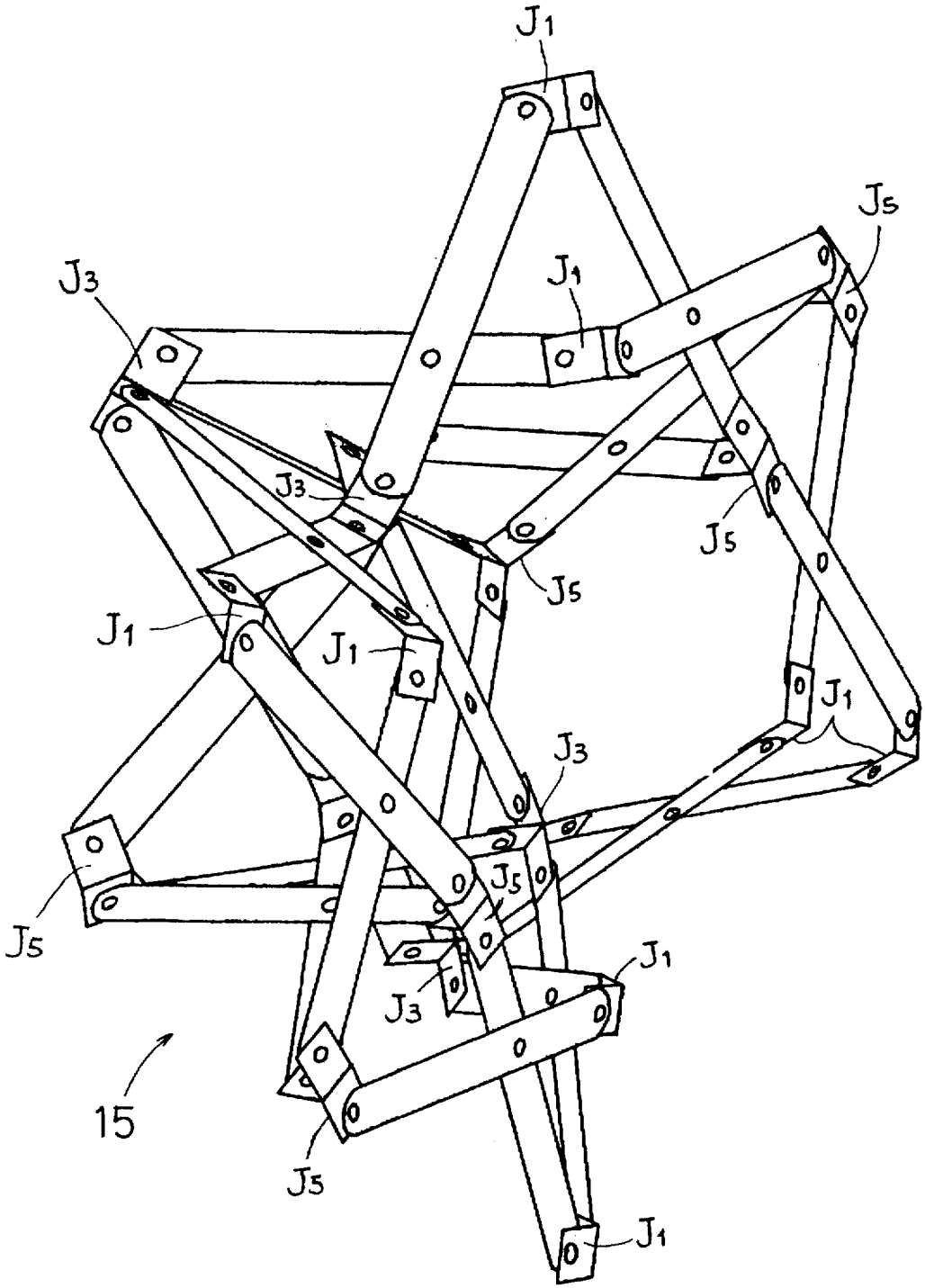
FIG. 62 is a perspective view showing the structure of the 15th embodiment in an intermediate expanded or contracted form.
Figure 63A:
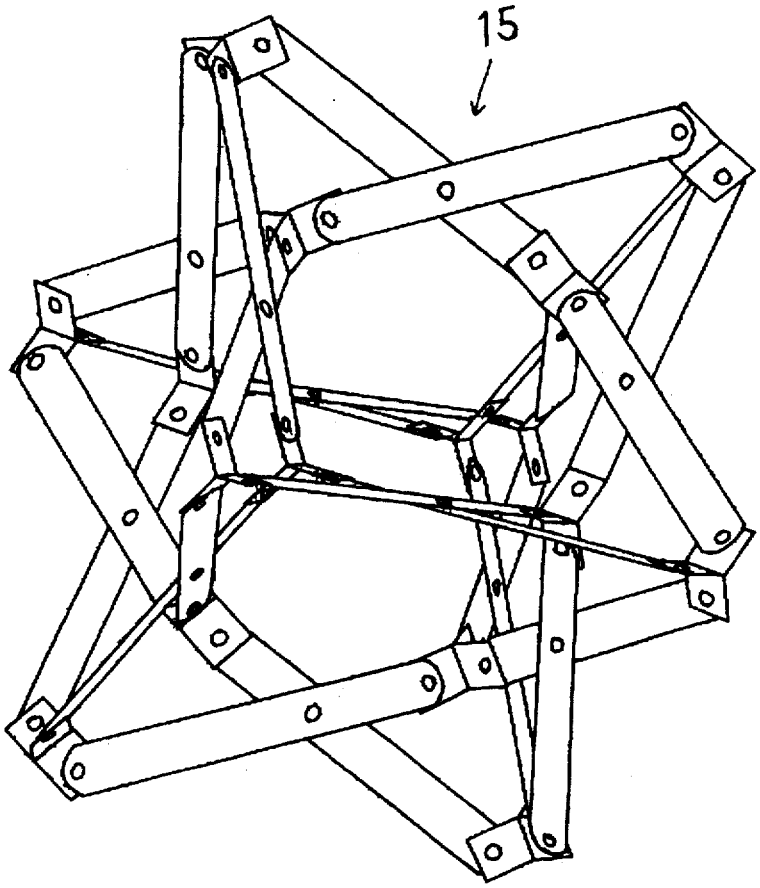
Figure 63B:
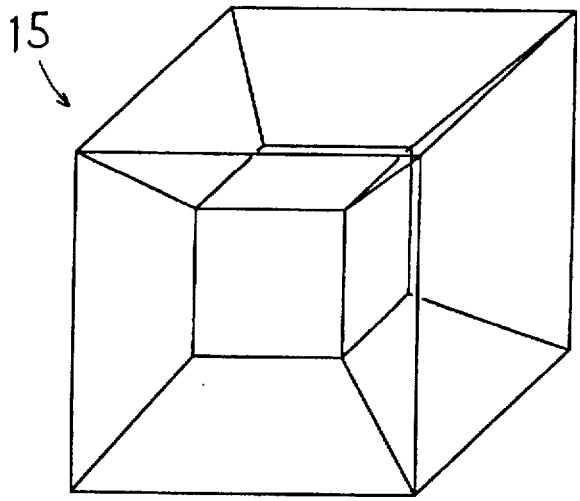

When an external force is applied to the structure 15 having the above construction in a direction of reducing the diagonal intersection angle θ of each primary constituent unit U153, the structure 15 is developed from a form close to the most contracted form as shown in FIG. 61 to be brought to an intermediate form as shown in FIG. 62 and eventually expanded to the most expanded form as shown in FIG. 63(A). In its most expanded form, the structure 15 constitutes a solid (a four-dimensional solid) as shown in FIG. 63(B) in which six quadrangular pyramid frustum structures (i.e., structures 2 of the second embodiment) are oriented toward the center of a cube.

16th Embodiment

Figure 64:
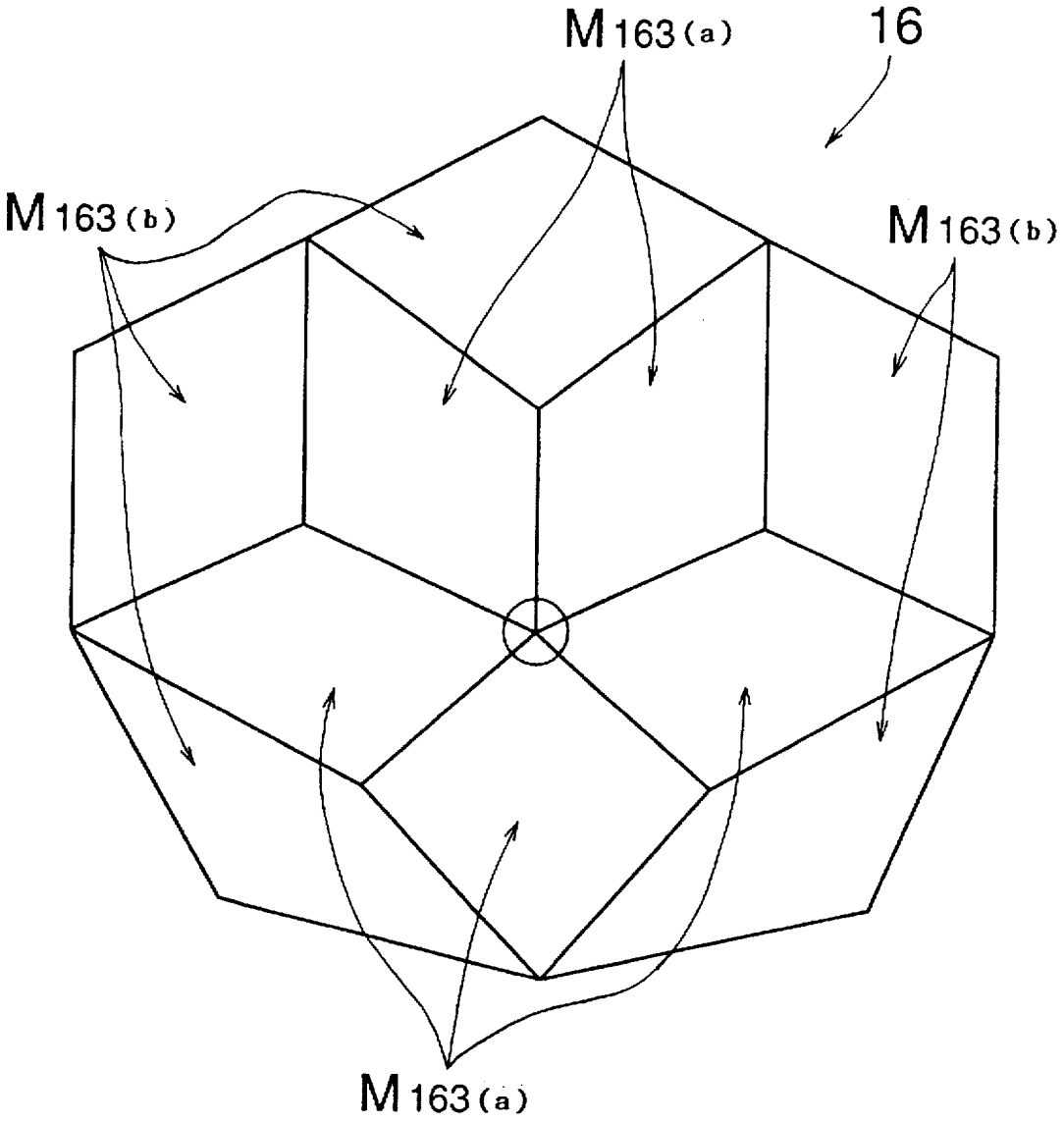
FIG. 64 is a schematic plan view showing a structure according to a 16th embodiment of the invention in the most contracted form.

A 16th embodiment will now be described with reference to FIGS. 64 to 67. A structure 16 of this embodiment is a development of the structure 15 of the 15th embodiment. As shown in FIG. 64, the structure 16 comprises ten secondary constituent units M163 having rhombic base and top and coupled to one another. Five central secondary constituent units M163(*a*) each have four lateral faces coupled to other secondary constituent units M163. Five edge part secondary constituent units M163(*b*) have two lateral faces coupled to other secondary constituent units M163. Again in this embodiment, the secondary constituent units M163 are each based on the secondary constituent unit of type 3 (i.e., structure 2 of the second embodiment) having quadrangular base and top.

At the locality indicated by circle mark in FIG. 64, a coupler J10 of type 10 is used to couple five secondary constituent units M163 to one another. The coupler J10 of type 10 includes five coupling members coupled together for relative rotation about a second rotation axis P2. An end of a diagonal member u is coupled to each coupling member for rotation about a third rotation axis P3. For other localities, couplers J1, J3 and J5 of types 1, 3 and 5 are used.

Figure 65:
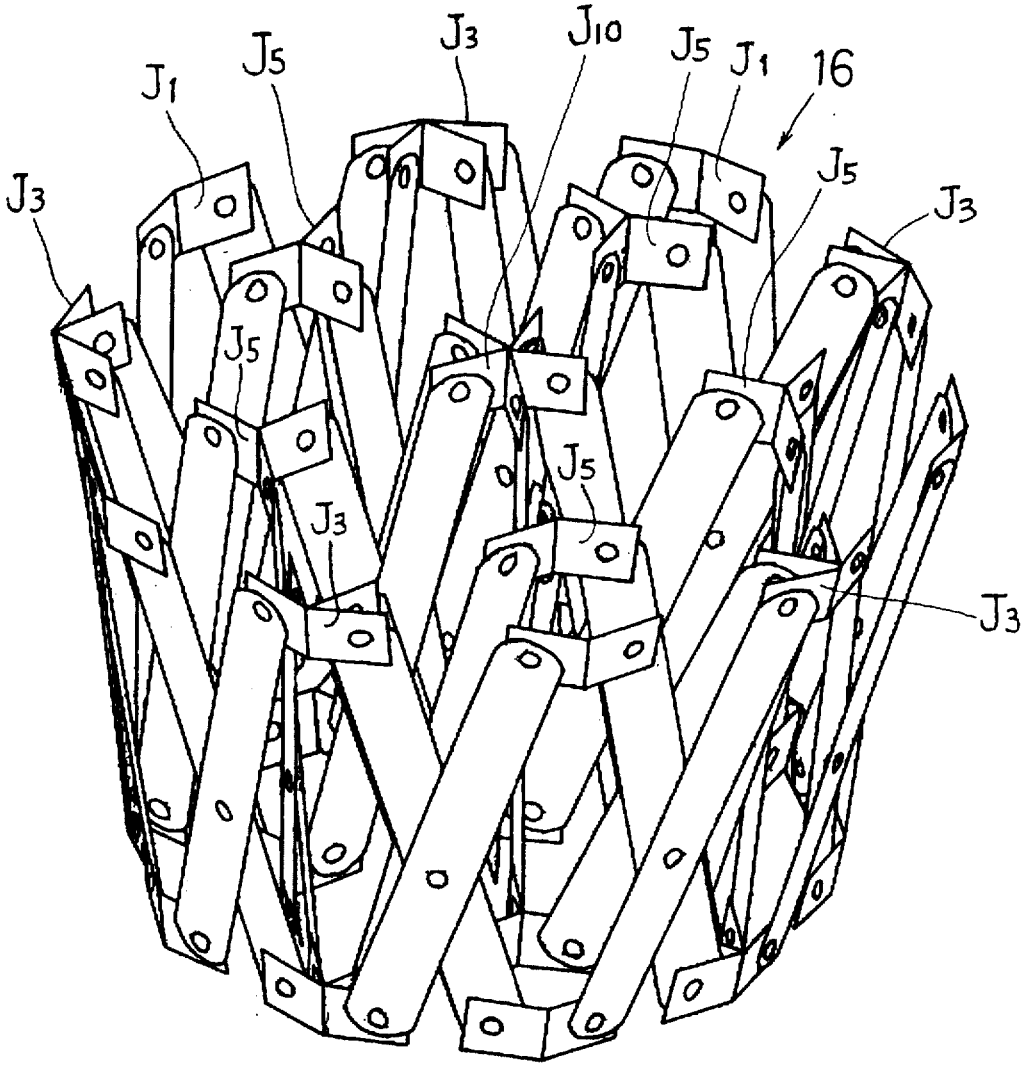
FIG. 65 is a perspective view showing the structure of the 16th embodiment in the most contracted form.
Figure 66:
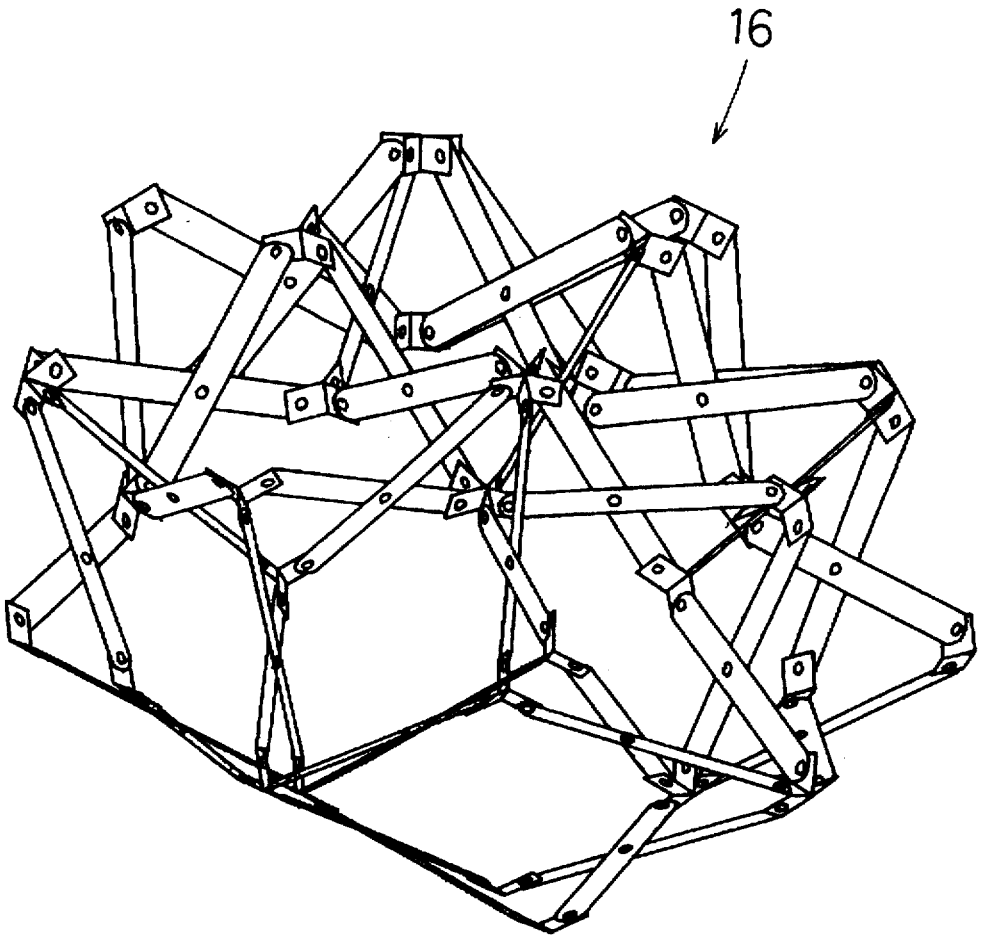
FIG. 66 is a perspective view showing the structure of the 16th embodiment in an intermediate expanded or contracted form.
Figure 67:
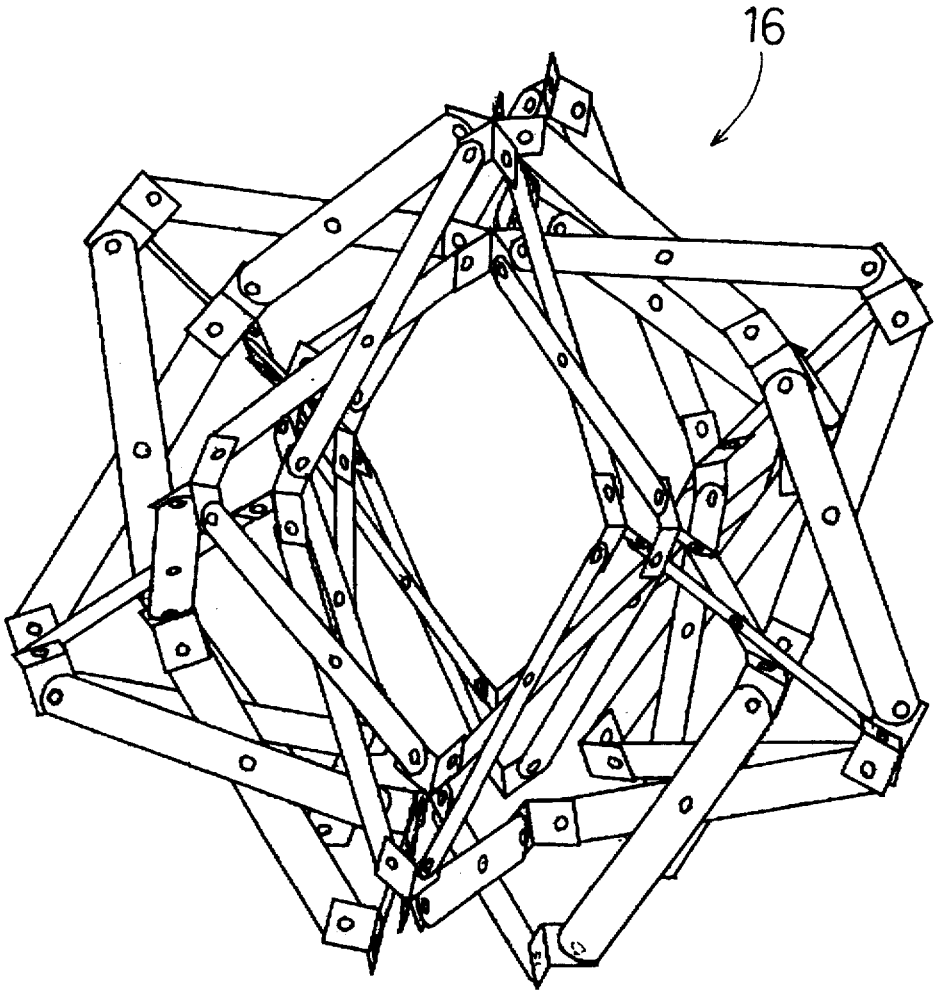
FIG. 67 is a perspective view showing the structure of the 16th embodiment in the most expanded form.

When an external force is applied to the structure 16 of this embodiment in a direction of reducing the diagonal intersection angle θ of each primary constituent unit U, the structure is expanded from a form close to the most contracted form as shown in FIG. 65 to be brought to an intermediate form as shown in FIG. 66 and eventually to a form close to the most expanded form as shown in FIG. 67. When it is expanded to the most expanded form, the structure 16 is like a sphere corresponding to a regular 20-face solid. Further, in the same stage, before reaching the most expanded form, it forms a dome-like structure corresponding to a half of a rhombic 30-face solid.

17th Embodiment

Figure 68:
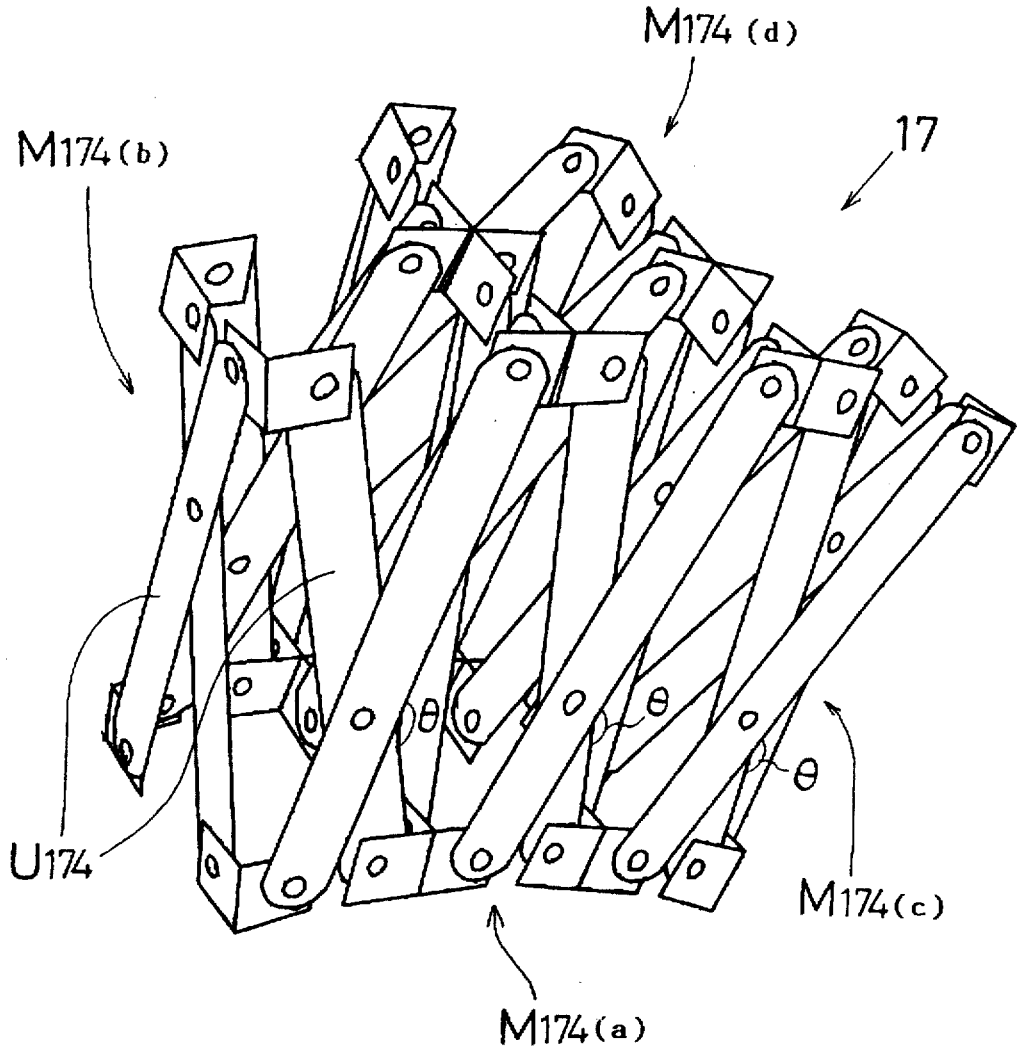
FIG. 68 is a perspective view showing a structure according to a 17th embodiment of the invention in the most contracted form.
Figure 69:
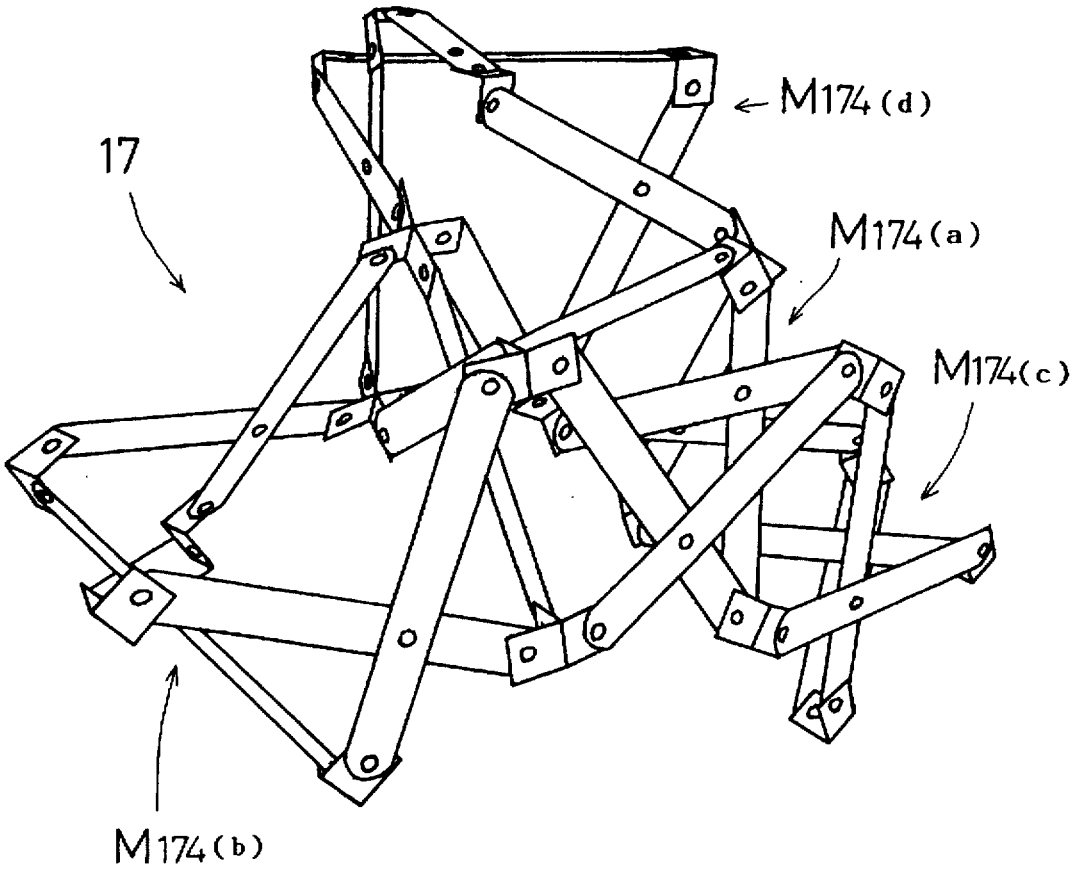
FIG. 69 is a perspective view showing the structure of the 17th embodiment in an intermediate expanded or contracted form.

A 17th embodiment will now be described with reference to FIGS. 68 to 70. A structure 17 of this embodiment is a modification of the structure 7 of the seventh embodiment (see FIGS. 26 to 28). The structure 17 comprises four secondary constituent units M174 coupled to one another into the form of letter T in plan view with a primary constituent unit U174 used in common between adjacent ones of them. Each of the secondary constituent units M174 is a modification of the secondary constituent unit of type 4 noted above and based on a solid having quadrangular base and top. Specifically, the secondary constituent unit M174 comprises four primary constituent units U174 coupled to one another such that the large and the small parts of the division ratios μ are disposed in the reverse orientation vertically alternately. Thus, like the seventh embodiment, the structure 17 can be basically developed into an arch-like form.

Figure 70:
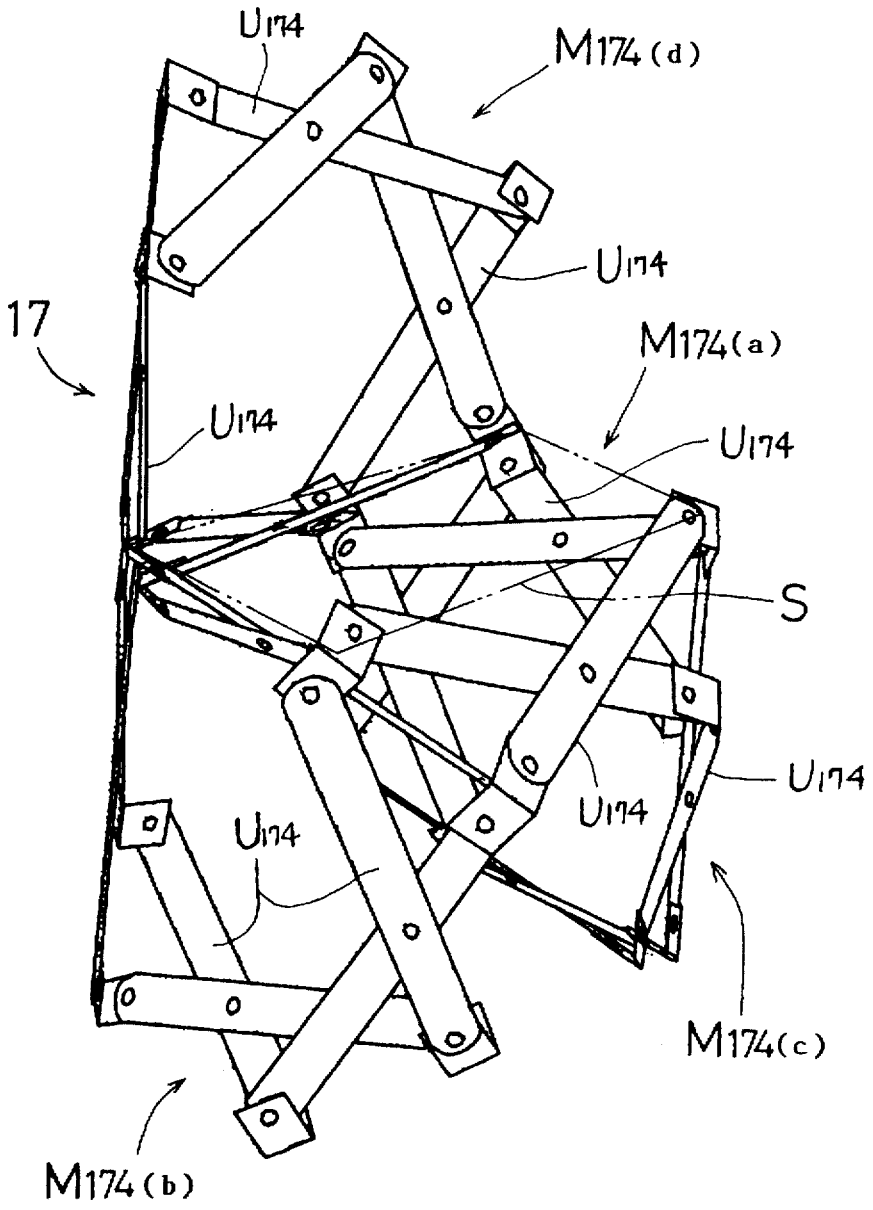
FIG. 70 is a perspective view showing the structure of the 17th embodiment in the most expanded form.

By applying a force in a direction to reduce the intersection angle θ of each primary constituent unit U174 in each secondary constituent unit M174, i.e., a vertical compressive force or lateral tensile force, the structure 17 is developed to an intermediate form as shown in FIG., 69 and eventually to a form as shown in FIG. 70. In this form, the secondary constituent units M174(*b*) and M174(*c*) which are coupled to the opposite sides of the central secondary constituent unit M174(*a*), are developed in a downwardly folded fashion, while the secondary constituent unit M174(*d*) coupled to the rear of the central secondary constituent unit M174(*a*) is developed in an upwardly folded fashion. Eventually, the structure 17 is developed into a form like a chair as shown in FIG. 70. In this developed form, the structure 17 can be used as a chair by providing a seat material S serving as a seat over the top of the central secondary constituent unit M174(*a*). The rear secondary constituent unit M174(*d*) serves as a back support, and the opposite side secondary constituent units M174(*b*) and M174(*c*) serve as legs.

18th Embodiment

Figure 71:
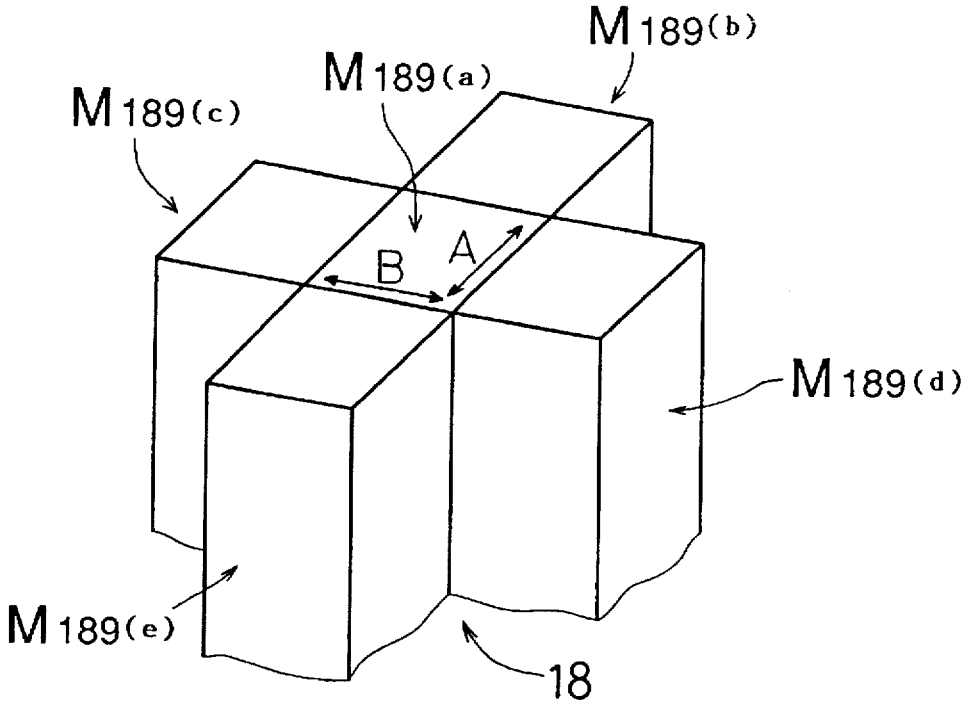
FIG. 71 is a schematic perspective view showing part of a structure according to an 18th embodiment of the invention in the most contracted form.
Figure 72:
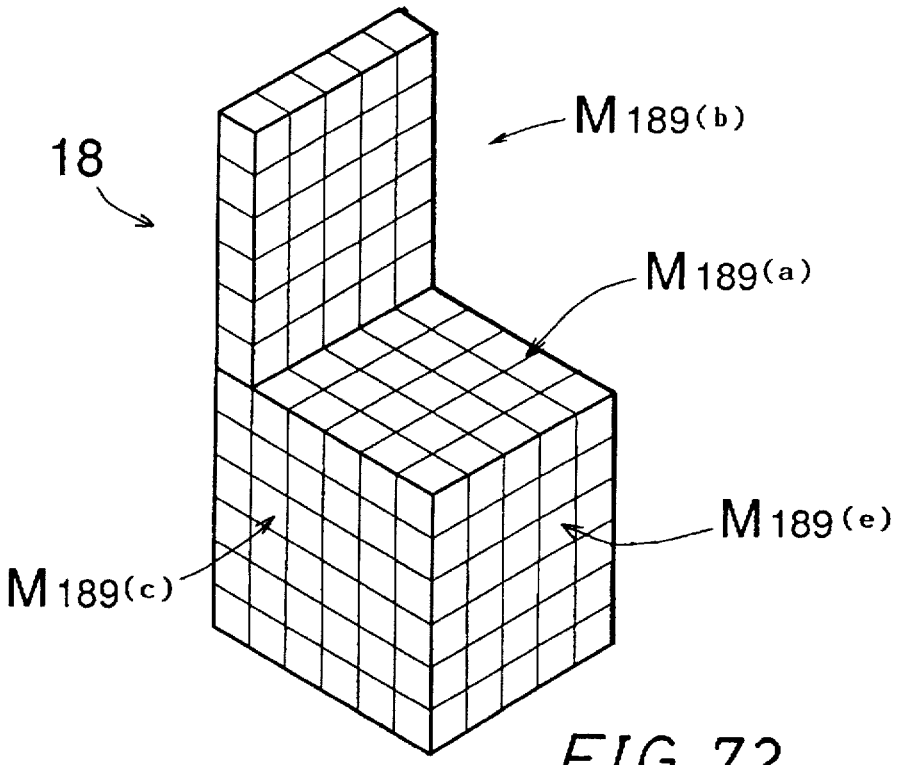
FIG. 72 is a schematic perspective view showing the structure of the 18th embodiment in the most expanded form.

An 18th embodiment will now be described with reference to FIGS. 71 and 72. The 18th embodiment is an example of the invention, and is a development of the structure 17 of the 17th embodiment. The structure 18 of this embodiment comprises a plurality of (i.e., five in this embodiment) double-layer structures capable of being spread to a plate-like form, for instance, the structures 6 described before in connection with the sixth embodiment, each as a secondary constituent unit M189 of type 9. The secondary constituent units M189 are coupled to one another with a primary constituent unit U189 used in common between adjacent ones of them.

When an external force is applied to the structure 18 having the above construction in a direction of reducing the diagonal intersection angle θ of the primary constituent unit U189 in each secondary constituent unit M189, each secondary constituent unit M189 is developed to a plate-like form. The structure 18 is thus developed to the form of a solid as shown in FIG. 72, each or some of whose faces are constituted by the plate-like double-layer structures, i.e., the secondary constituent units M189 of type 9. The chair-like form of the structure 18 shown in FIG. 72 corresponds to like developed form of the 17th embodiment.

The structure 18 has each solid face constituted by a double-layer structure (i.e., secondary constituent unit M189 of type 9), so that it has higher rigidity.

The five secondary constituent units M189 in this structure are designated by M189(*a*) to M189(*e*), respectively. When the structure assumes the form of a chair as shown, the unit M189(*a*) corresponds to a seat face, the unit M189(*b*) to a back support, the units M189(*c*) and M189(*d*) to legs, and the unit M189(*e*) to a lower front. The unit M189(*b*) as the back support has to extend upright with respect to the unit M189(*a*) as the seat face , and the unit M189(*e*) as the lower front has to extend downward from the unit M189(*a*). The secondary constituent unit M189(*a*) thus has to have an even number of primary constituent units coupled to one another in longitudinal directions (i.e., directions A in the drawing). The units M189(*c*) and M189(*d*) as the legs have to extend downward with respect to the unit M189(*a*) as the seat face. This means that the secondary constituent unit M189(*a*) has to have an odd number of primary constituent units coupled to one another in transversal directions (i.e. directions B in the drawing). This is obvious from the fact that the division ratio μ in each primary constituent unit in the structure 6 of type 6 is not 1:1, that is, the lateral face as the basis of each primary constituent unit is a trapezoid. It will thus be seen that where each lateral face of a polyhedron is constituted by a double layer structure, each structure generally has to have an odd number of transversely arranged primary constituent units.

As is seen from the 1st to 18th embodiments described above, the framework structure according to the invention is a three-dimensional development of the prior art structures (e) and (f) capable of being expanded and contracted as described before. The invention can overcome the drawbacks inherent in the prior art structures other than those utilizing fluid that they are weak to forces exerted thereto from different planes, and that an arrangement for providing reinforced rigidity in an out-of-plane direction can not be folded in that direction, so that it is impossible to satisfy both the rigidity or mechanical strength and the degree of freedom of expansion and contraction. The framework structure according to the invention can be expanded two-dimensionally or three-dimensionally from a uni-dimensional form and contracted conversely. In addition, by suitably combining tension elements or compressive elements, it is possible to provide high mechanical strength as a three-dimensional torus framework structure having high degree of freedom of development. By combining basic structural units, it is possible to provide a framework structure which can be developed uni-dimensionally or two-dimensionally to a tower-like, a vault-like or a dome-like form without loss of rigidity in intermediate forms.

In the above embodiments, the second rotation axis P2 has been described as being coincident with the intersection between adjacent lateral faces of the solid constituted by the structure. The second rotation axis P2, however, may not be coincident with the intersection.

Figure 73:
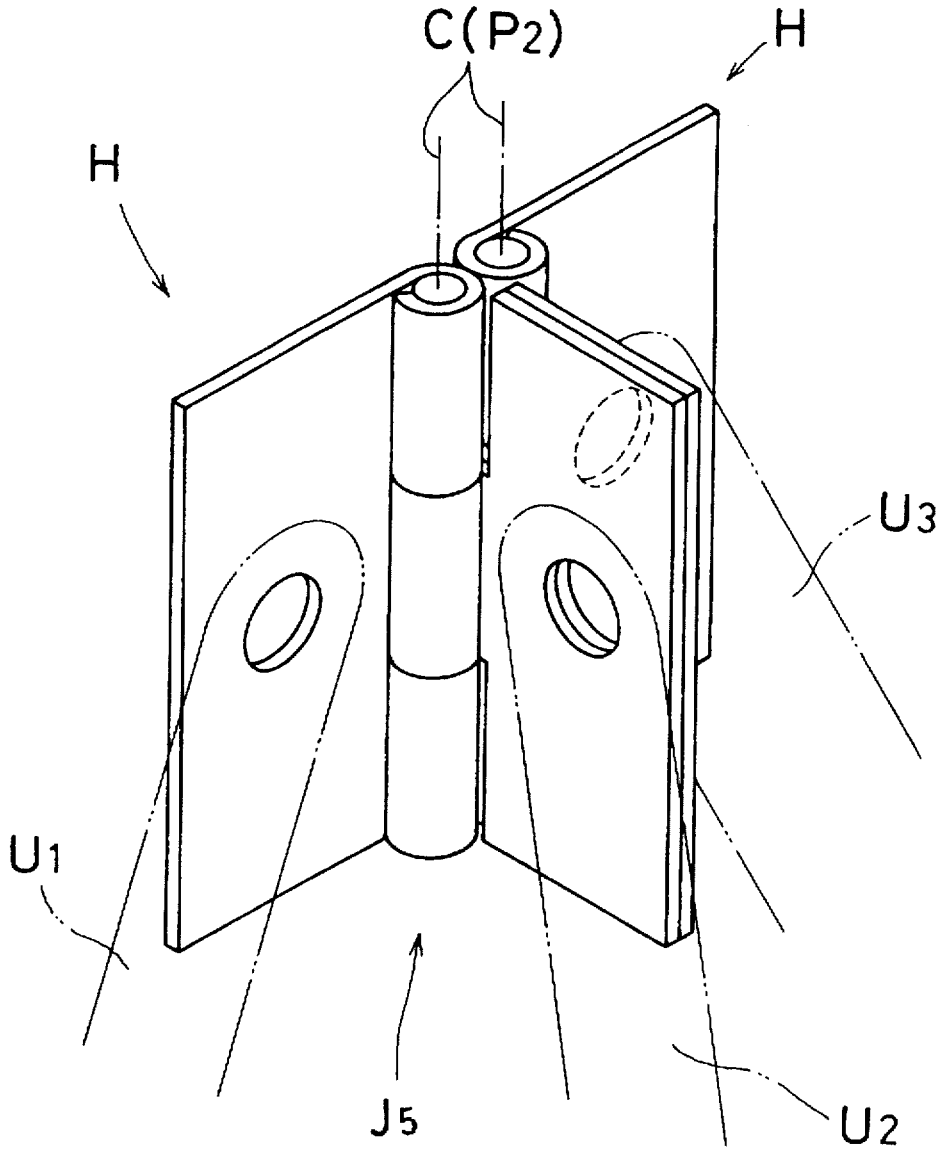
FIG. 73 is a perspective view showing a coupler of type 3 having two hinges, with the second rotation axis P2 not coincident with the adjacent lateral face intersection line of a solid.

For example, a usual hinge H as shown in FIG. 73 may be used as a coupler J. In this case, the coupler J5 of type 5 can be obtained by combining two hinges H. However, in this case, the rotation centers C of the two hinges H are not coincident, and therefore, actually two second rotation axes P2 are provided. That is, no second rotation axis P2 is coincident with the intersection of two adjacent lateral faces. Specifically, two second rotation axes P2 are present between adjacent primary constituent units U1 and U3. Even in this case, the adjacent primary constituent units P1 and P3 can be rotated relatively about either one or both of the second rotation axes P2. Actually, the structure thus can be two-dimensionally expanded and uni-dimensionally contracted without any trouble.

The couplers J1 and J2 of types 1 and 2 may each be constituted by a single hinge. In these cases, it is possible to provide a second rotation axis P2 coincident with the intersection between adjacent lateral faces. It is thus possible to provide a structure which conforms to the theory described above. In the cases where the other couplers J3, J4 and J6 to J8 are each constituted by a plurality of hinges H, the theory is the same as with the coupler J3, and the structure can be expanded and contracted as described above.

Embodiments Using tension elements

For stabilizing the rigidity of the structures described above, tension elements are used in the following embodiments.

Figure 48B:
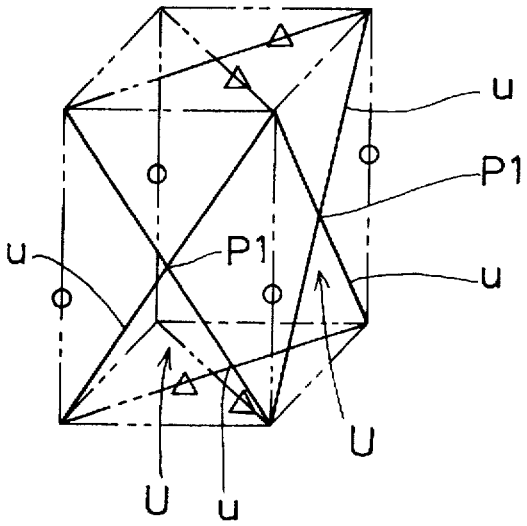
Figure 48C:
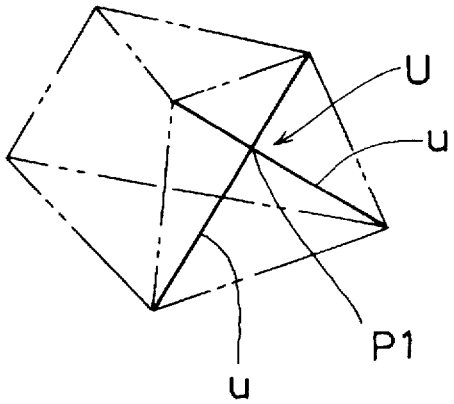
Figure 48D:
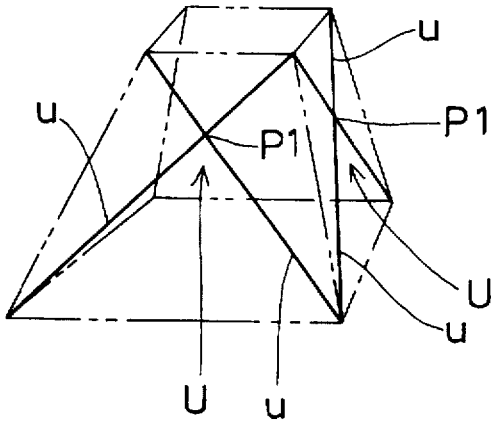
Figure 49:
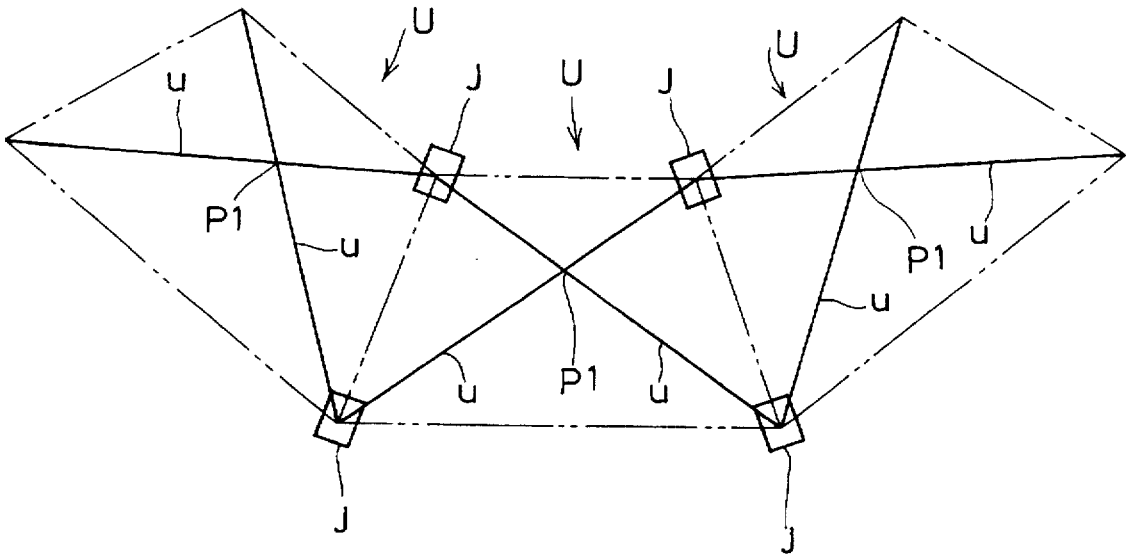
FIG. 49 is a development view showing a structure comprising primary constituent units coupled together and each constituting triangular pyramid frustum and including diagonal members constituting diagonals of isosceles trapezoids.
Figure 50:
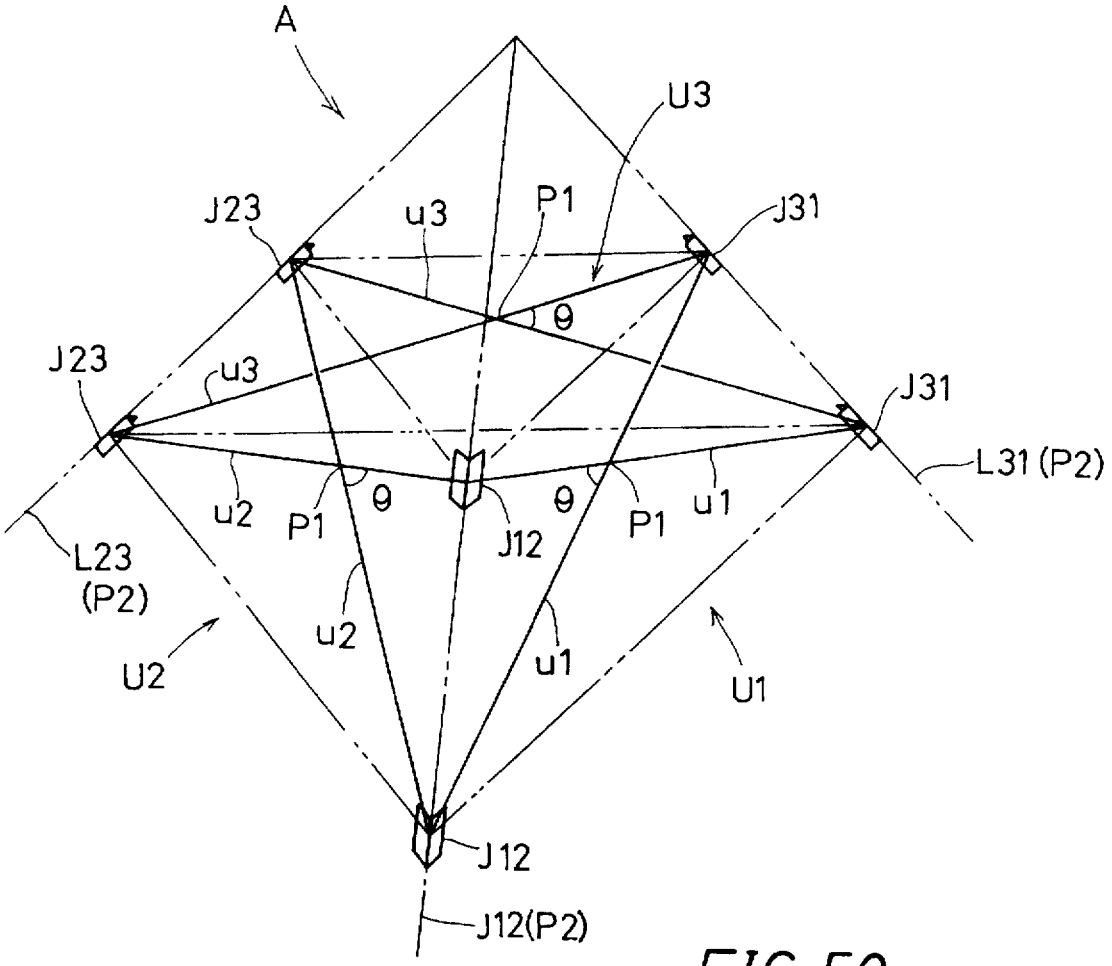
FIG. 50 is a view for describing how to obtain conditions of diagonal intersection angle θ in a structure constituting isosceles trapezoidal lateral faces of a triangular pyramid frustum.
Figure 51:
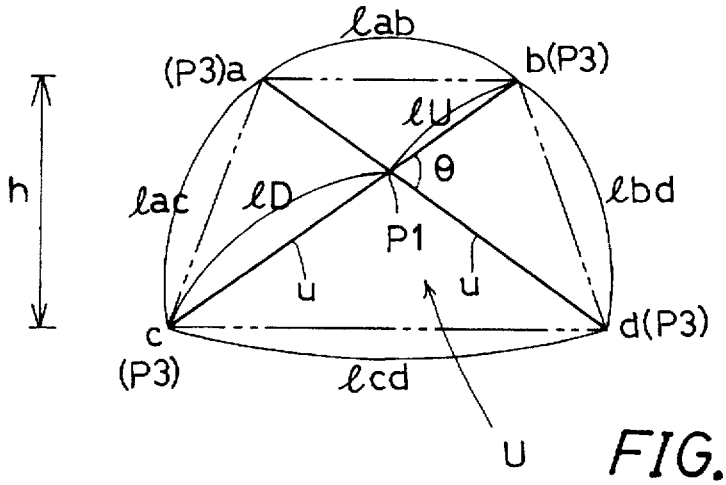
FIG. 51 is a view for describing how to obtain conditions of the length of each side and diagonal intersection angle θ of an isosceles trapezoidal lateral face of a triangular frustum.
Figure 52:
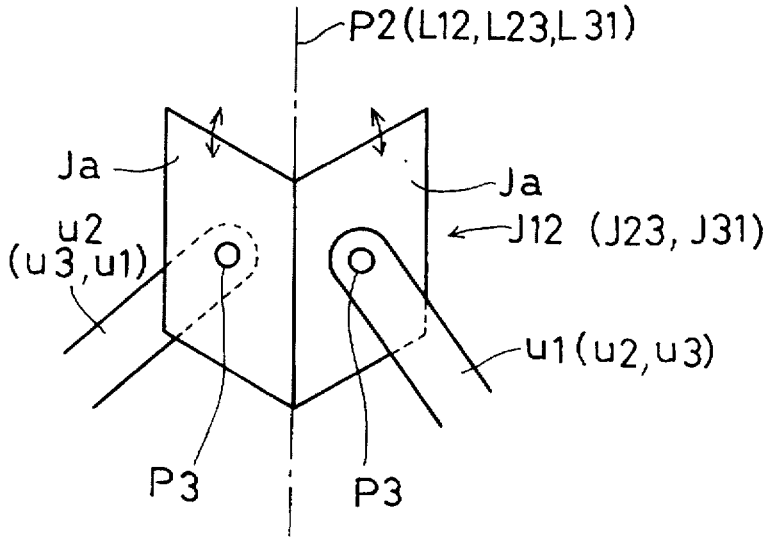
FIG. 52 is a perspective view showing a coupler (coupler of type 1)
Figure 53A:
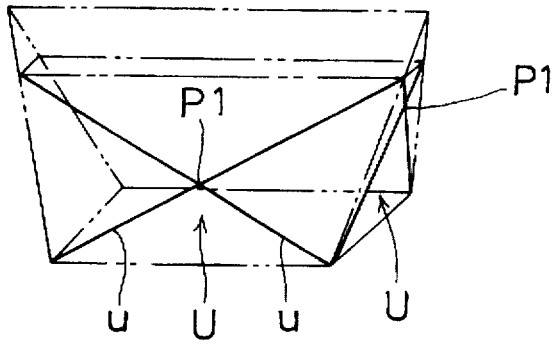
FIG. 53(A) shows a solid obtained by cutting off an end portion of a wedge-like solid.
Figure 53C:
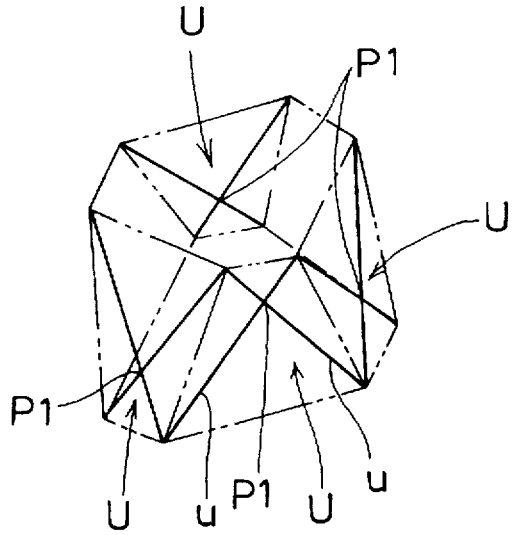
FIG. 53(C) shows a solid having a hexagonal base and six isosceles trapezoidal lateral faces providing the long and the short sides at the top and the bottom alternately.
Figure 53B:
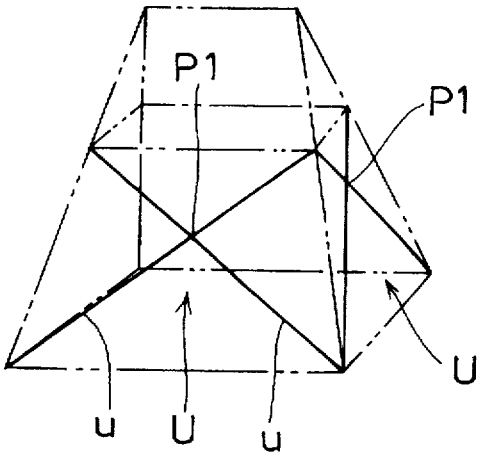
FIG. 53(B) shows a solid obtained by cutting off an end portion of an obelisk.
Figure 53D:
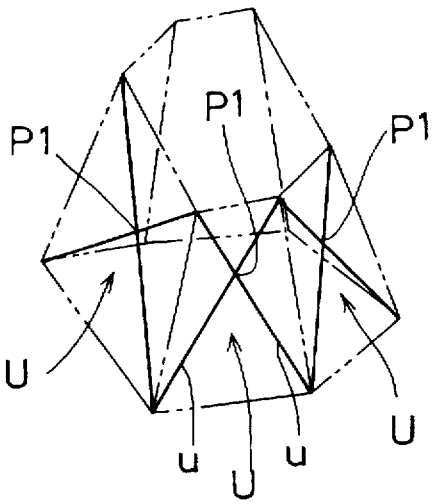
FIG. 53(D) shows a solid having a hexagonal base and providing a diagonal segment division ratio and the inverse thereof alternately.

FIGS. 48(A) and 48(B) show embodiments which are examples of the invention. In these embodiments, tension elements, such as wires, are provided between ends of adjacent diagonal members u at localities indicated by triangle marks and/or circle marks. These structures can be secured in their desired forms between their most expanded form and most contracted form such that they are rigid with respect to external forces exerted thereto, such as gravitational force (or their own weight). The tension elements may not be provided at all the pairs of ends of adjacent diagonal members u, but tension elements having necessary mechanical strength may be provided at localities such as to provide necessary and sufficient rigidity with respect to the weight of the structure or external forces exerted thereto.

Figure 74:
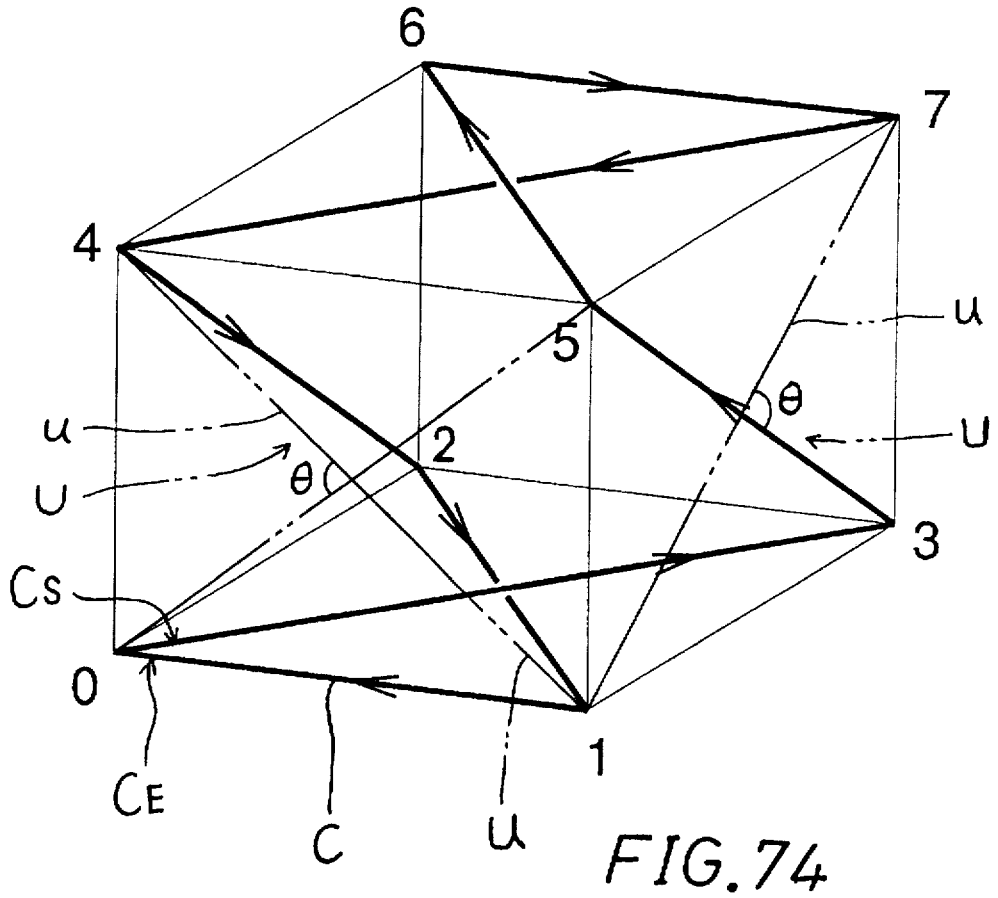
FIG. 74 is a schematic view showing an embodiment using a tension element, the tension element being passed along a route that its tensility causes contraction of the structure.
Figure 76:
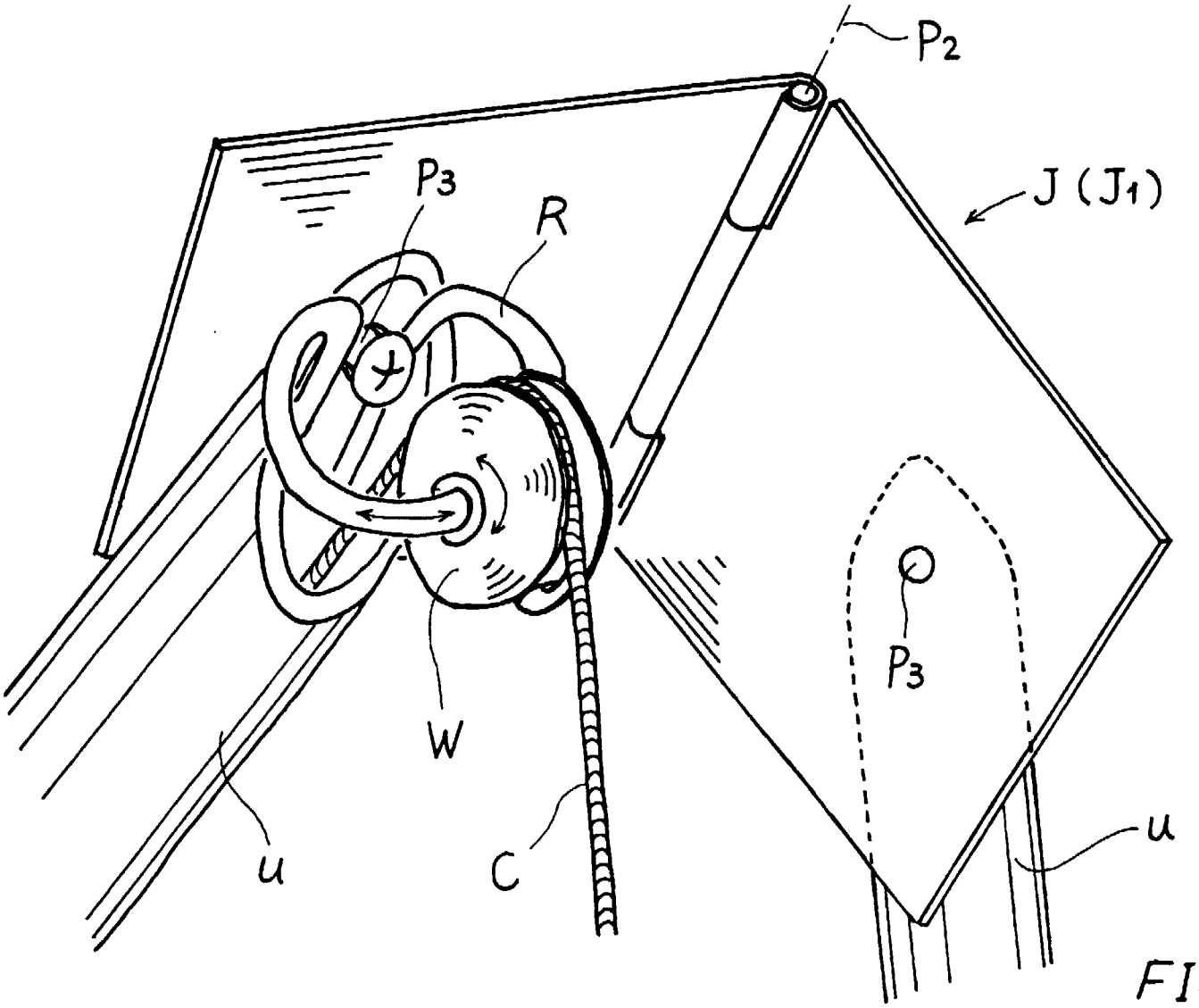
FIG. 76 is a perspective view showing an example of wire passing member.

FIG. 74 shows an example of the invention. In this embodiment, a wire C is provided for a structure constituting a quadrangular prism, i.e., a secondary constituent unit of type 2 (see FIG. 43). In FIG. 76, the structure itself is not shown, but only the route which the wire C is passed along is shown schematically.

Specifically, the wire C is passed around eight corners 0 to 7 of the quadrangular prism structure along the route of "0→3→5→6→7→4→2→1→0". At each of the corners 0 to 7, a wire passing member as shown in FIG. 76 is provided. The illustrated wire passing member is a pulley W which is supported via a ring-like rail R secured to an end of the diagonal member u. The diagonal member u is made from a pipe. Each end of the pipe is cut obliquely. The wire C is led through the pipe and out of each end thereof to be passed around the pulley W. The pulley W is rotatable and is also movable along the rail R. The wire C is passed along the route noted above past the pulleys W provided as the wire passing members at the corners 0 to 7. Its trailing ends CE is directly secured at the corner 0 to the end of the diagonal member u or to the wire passing member.

By pulling the leading end CS of the wire C passed in this way, the diagonal members u in each primary constituent unit U are rotated relatively in a direction of increasing their intersection angle θ, thus causing uni-dimensional contraction of the structure toward the most contracted form. In other words, the structure can be folded by pulling the wire C. By securing the leading end CS of the wire C against returning after bringing the structure to a desired form by pulling the wire C to a predetermined extent, the structure can be secured in the desired form such that it is rigid with respect to vertically exerted external forces such as its own weight.

Figure 75:
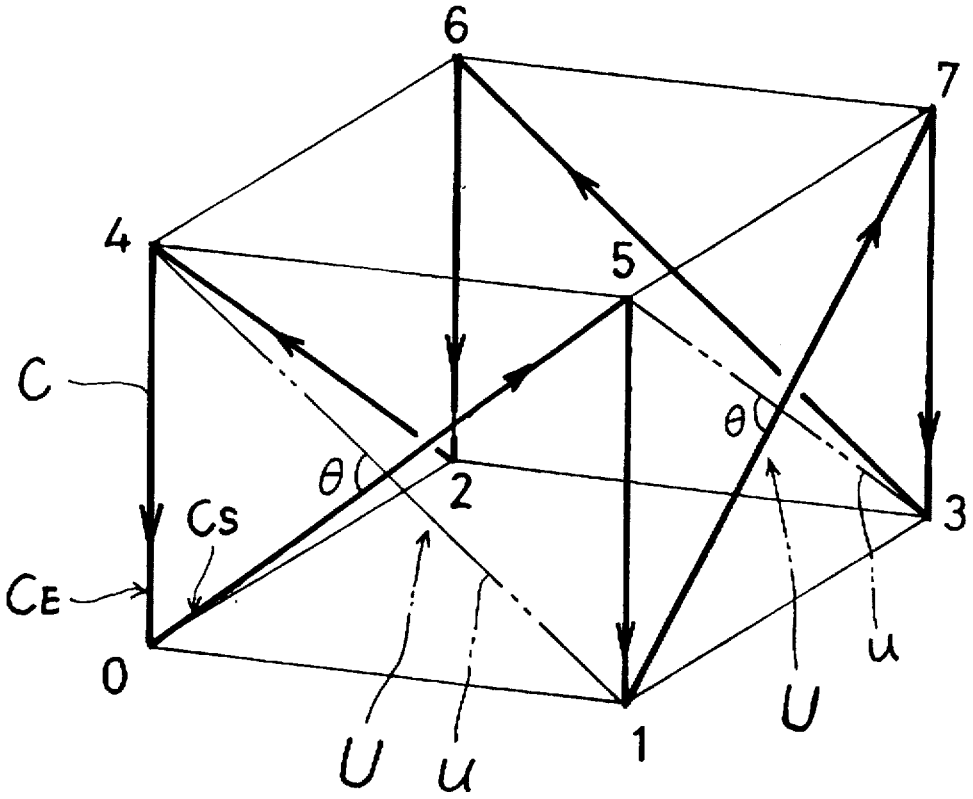
FIG. 75 is a schematic view showing a different embodiment using a tension element, the tension element passed along a route that its tensility causes contraction of the structure.

FIG. 75 shows another example in which a wire C is passed along a different route. Specifically, the wire C is passed around eight corners 0 to 7 of a solid (i.e., a quadrangular prism) constituting the structure along a route "0→5→1→7→3→6→2→4→0". Like the above case, the trailing end CE of the wire C is secured to the end of the diagonal member u or a wire passing member at the corner 0. A pulley W is supported in the manner as described above on a wire passing member at each of the corners 0 to 7.

By pulling the leading end CS of the wire C passed along the above route, the diagonal members u in each primary constituent unit U are rotated relatively in a direction of reducing their intersection angle θ. The structure is thus expanded two-dimensionally toward the most expanded form. By securing the leading end CS of the wire C against returning after pulling the wire C to a predetermined extent, the structure can be secured in a desired form. The structure thus is now rigid with respect to vertically exerted tensile forces or transversely exerted compressive forces. This wire passing route is thus effective when the transversal directions are gravitational directions.

As has been explained, by passing a single wire C along a suitable route selected from the considerations of the gravitational force directions or directions of other external forces, the structure can be changed to a desired form by pulling the leading end CS of the wire C to a predetermined extent. In addition, by securing the leading end CS of the wire C against returning after pulling the end CS to a predetermined extent, the structure can be secured to be in a form which is rigid with respect to externally exerted forces.

While the pulleys W are used as the wire passing members in the above embodiments, this is by no means limitative; for example, it is possible to pass the wire C directly round the ring-like rails R noted above. In addition, while in the above embodiments, the most basic structures have been described for the brevity of the description, this is by no means limitative, and the invention is applicable as well to various complicated structures as described above, in which basic structures are coupled together as secondary constituent units in their axial direction and/or a direction perpendicular thereto. Moreover, while a single wire C is used in the above embodiments, this is by no means limitative, and it is possible to pass a suitable number of wires C in a sharing fashion along the overall route.

Although not shown, a further embodiment is a combination of the embodiments described above in connection with FIGS. 74 and 75. Specifically, in this embodiment, two wires C are passed along the routes described before with reference to FIGS. 74 and 75, respectively. By pulling the wire C passed along the route shown in FIG. 74, the diagonal members u in each primary constituent unit U are rotated relatively in a direction of increasing their intersection angle θ. The structure is thus contracted toward the most contracted form. By pulling the other wire C passed along the route described with reference to FIG. 75, the diagonal members u in each primary constituent unit U conversely rotated relatively on a direction of reducing their intersection angle θ. The structure is thus expanded toward the most expanded form. Thus, with the two wires C passed along their predetermined routes, the structure is contracted by pulling one of these wires C and expanded by pulling the other wire C, so that it can be readily changed in its contracted form (or expanded form). The structure may further be made rigid against external force exerted in every direction by securing the two wires C against returning after pulling these wires to predetermined extents. This means that it is possible to obtain the same status as obtainable by providing tension elements at localities indicated by circle marks and triangle marks in FIGS. 48(A) and 48(B). Again in this embodiment, it is possible to pass wires C directly around the rails R shown above as well as around the pulleys W as the wire passing members, and it is further possible to pass a plurality of wires C in a sharing fashion along each of the routes.

In this embodiment, a wire for expanding the structure and a wire for contracting the same are passed around each corner. In such a case, a wire passing member for passing a plurality of wires C may be constructed by mounting a necessary number of pulleys W on a rail R. It is further possible to mount the necessary number of wires C directly on the rail R instead of pulleys W. In either case, the necessary number of wires C may be passed through the pipes as diagonal members u. In a further embodiment, each diagonal member u in each primary constituent unit U is a pipe as described before in connection with FIG. 76, and wires C are passed through pipes. This arrangement provides a structure having neat appearance and prevents such trouble as catching of wires C at other localities of the structure than those where the wires C are passed, thus providing enhanced reliability of motion and durability.

While in the above embodiments, the pulleys W as the wire passing members are provided at the ends of the diagonal members u, it is also possible to provide wire passing members on couplers J.

As has been described in the foregoing, the invention provides a structure changeable in form which is constructed in consideration of the diagonals of lateral faces of a solid. The structure can be developed from a plate-like or mass-like highly densely contracted form to a tower-like form in the former case or a plate-like or polyhedral form in the latter case without spoiling its rigidity as a solid framework in its intermediate stages of development. It is thus possible to readily obtain high building structures, space structures and various other structures.

(1) Basic Form

Basically, the structure comprises a plurality of primary constituent units, which each have isosceles trapezoidal lateral faces with diagonals thereof constituted by diagonal members coupled together for relative rotation at the intersection thereof, and which are coupled to one another at the pieces of the solid via couplers having three or more rotation axes into a ring-like form. When the structure constitutes a pyramid frustum only with congruent isosceles trapezoidal lateral faces, it can be changed in form from a two-dimensional form (most expanded form) through an intermediate solid form to a uni-dimensional form (most contracted form). The first embodiment concerns a triangular pyramid frustum, and the second embodiment concerns a quadrangular pyramid frustum. Similar changes in form are obtainable in cases where other faces than isosceles trapezoids are involved.

(2) Application to Tower-Like Structures

The third to fifth embodiments illustrate that it is possible to obtain multiple layer structures while using in common the second and the third rotation axes P2 and P3 of the couplers J. In the structure, similar pyramid frustums with a geometrical series of primary constituent unit division ratios μ successively appear infinitely in a finite space. By utilizing this structure, it is possible to build a tower without need of any high locality operation by assembling the tower in a two-dimensional form, then bringing the tower to the site of building, and then building the tower by suitably pushing opposite corners in each base toward each other. The structure is also applicable to bridge construction or like processes by balancing it horizontally.

When the division ratios μ are not in a geometrical series, it is possible to develop the structure to a single layer dome-like or funnel-like form by coupling together pyramid frustums vertically by providing a further rotation axis (fourth rotation axis P4) to the coupling member. The tenth embodiment exemplifies a structure which can be developed to a dome-like form.

(3) Application to Double Layer Panel Structures

Among solids only with congruent isosceles pyramid trapezoidal lateral faces, there is one which is obtained by alternately coupling the tops and bases of the lateral faces to one another into a ring-like form. This holds only in the case of an even base corner number. A quadrangle has the least base corner number. Solids of this type may be combined with quadrangular pyramid frustums to fill space. The sixth embodiment exemplifies this solid pattern.

Solids with six base corners may be combined with triangular pyramid frustums to fill space. Either of these patterns is obtained by taking out the diagonals of trapezoidal faces obtained by slicing a three-dimensional torus which fills space with regular tetrahedrons and regular octahedrons, along two parallel planes which are parallel to a rectangular face in the former pattern and to a triangular face in the latter one. It is further possible to obtain a form change from a folded form to a form having a vault-like or wavy curved configuration by providing different primary constituent unit division ratios μ of adjacent secondary constituent units. This is exemplified in the seventh to ninth embodiments.

In either of these cases, the structures can be developed without spoiling rigidity in their intermediate stages of development and form a three-dimensional torus by providing action of tension elements. The Structures are thus applicable to foundations, space structures, etc.

(4) Application to Double Layer Polygons

The structure 15 of the 15th embodiment, when developed, constitutes a solid in which six quadrangular pyramid frutum structure (i e, t structure 2 of the second embodiment) are oriented toward the center of a cube. This is thought to be obtained by applying the structure 2 to three-dimensional center projection of a four-dimensional cube (i.e., regular octatope). This structure is thought to undergo form change as 3-D←→4-D←→1-D in four-dimensional space. While the structure is stable in three-dimensional space, its form changes in three-dimensional space may be realized by developing a polytope.

Similar processes are possible with polyhedrons other than cubes when three-dimensional center projection of a four-dimensional prism obtained as a result of extension in four-dimensional directions is considered. Concerning polyhedrons having rectangular, triangular and hexagonal lateral faces, uni-dimensional contraction of a large variety of solids is obtainable by utilizing a double layer panel structure (for instance, the structure 14 of the 14th embodiment).

The 13th, 16th, 17th and 18th embodiments as well as the 15th embodiment concern double layer polyhedrons.

(5) Application to Single Layer Domes

A different process of three-dimensional development of a four-dimensional prism is the case with a star-like solid which comprises a plurality of basic structures (for instance, structures of the first or the second embodiment) each disposed on each face of a polyhedron. The structure 11 of the 11th embodiment is an example of this structure. In the structure 11, a star-like structure with five tower-like projections can be changed in form to a single layer dome. It is possible to increase the number of tower-like projections, and this process can be utilized as a new process of constructing dome-like structures.

I claim:

1. A framework structure comprising a plurality of primary constituent units each including two rigid diagonal members constituting the diagonals of a quadrangular lateral face of a solid, at least one of two opposed side pairs of the quadrangular lateral face being parallel, the two diagonal members being coupled together for relative rotation about a first rotation axis passing through the intersection of the diagonals, the primary constituent units being coupled to one another in a ring-like fashion by coupling an end of each diagonal member in each primary constituent unit by a coupler to an associated end of a diagonal member of an adjacent primary constituent unit, wherein the coupler has a plurality of coupling members coupled together for rotation relative to one another about a second rotation axis, an end of one of the diagonal members being coupled to each of the coupling members for rotation about a third rotation axis parallel to first rotation axis, adjacent ones of the primary constituent units being thereby coupled together for relative rotation about the second rotation axis.

2. The framework structure according to claim 1, wherein each of the primary constituent units includes two diagonal members constituting the diagonals of a square or rectangular lateral face of a solid, and wherein the first rotation axis of each primary constituent unit divides the segment of each of its diagonal members between the two third rotation axes with a ratio of 1:1.

3. The framework structure according to claim 1, wherein each of the primary constituent units includes two diagonal members constituting the diagonals of an isosceles trapezoidal lateral face of a solid, and wherein the first rotation axis of each primary constituent unit divides the segment of each of its diagonal members between the two third rotation axes with an equal ratio, the large and the small parts of the division ratio being disposed in the same orientation.

4. The framework structure according to claim 1, wherein each of the primary constituent units includes two diagonal members constituting the diagonals of an isosceles trapezoidal lateral face of a solid, and wherein the first rotation axis of each primary constituent unit divides the segment of each of its diagonal members between the two third rotation axes with an equal ratio, the large and the small parts of the division ratio being disposed in the reverse orientation, alternately.

5. The framework structure according to claim 1, wherein each of the primary constituent units includes two diagonal members constituting the diagonals of an isosceles trapezoidal lateral face of a solid, and wherein the first rotation axis of each primary constituent unit divides the segment of each of its diagonal members between the two third rotation axes with two different ratios, the primary constituent unit with the two different ratios of division being coupled together alternately.

6. A framework structure comprising a plurality of secondary constituent units each constituted by the framework structure according to claim 2, the secondary constituent units being coupled to one another in the direction of an axis passing through the center thereof with couplers used in common between adjacent ones of the secondary constituent units.

7. A framework structure comprising a plurality of secondary constituent units each constituted by the framework structure according to claim 3, the secondary constituent units being coupled to one another in the direction of an axis passing through the center thereof with couplers used in common between adjacent ones of the secondary constituent units.

8. A framework structure comprising a plurality of secondary constituent units each constituted by the framework structure according to claim 4, the secondary constituent units being coupled to one another in the direction of an axis passing through the center thereof with couplers used in common between adjacent ones of the secondary constituent units.

9. A framework structure comprising a plurality of secondary constituent units each constituted by the framework structure according to claim 5, the secondary constituent units being coupled to one another in the direction of an axis passing through the center thereof with couplers used in common between adjacent ones of the secondary constituent units.

10. A framework structure comprising a plurality of secondary constituent units each constituted by the framework structure according to claim 2, the secondary constituent units being coupled to one another in the direction perpendicular to an axis passing through the center thereof with a primary constituent unit used in common between adjacent ones of the secondary constituent units.

11. A framework structure comprising a plurality of secondary constituent units each constituted by the framework structure according to claim 3, the secondary constituent units being coupled to one another in the direction perpendicular to an axis passing through the center thereof with a primary constituent unit used in common between adjacent ones of the secondary constituent units.

12. A framework structure comprising a plurality of secondary constituent units each constituted by the framework structure according to claim 4, the secondary constituent units being coupled to one another in the direction perpendicular to an axis passing through the center thereof with a primary constituent unit used in common between adjacent ones of the secondary constituent units.

13. A framework structure comprising a plurality of secondary constituent units each constituted by the framework structure according to claim 5, the secondary constituent units being coupled to one another in the direction perpendicular to an axis passing through the center thereof with a primary constituent unit used in common between adjacent ones of the secondary constituent units.

14. A framework structure comprising a plurality of secondary constituent units each constituted by the framework structure according to claim 2, adjacent ones of the secondary constituent units in the direction of an axis passing through the center thereof being coupled together with couplers used in common, and adjacent ones of the secondary constituent units in the direction perpendicular to an axis passing through the center thereof being coupled together with a primary constituent unit used in common.

15. A framework structure comprising a plurality of secondary constituent units each constituted by one framework structure according to claim 3, adjacent ones of the secondary constituent units in the direction of an axis passing through the center thereof being coupled together with couplers used in common, and adjacent ones of the secondary constituent units in the direction perpendicular to an axis passing through the center thereof being coupled together with a primary constituent unit used in common.

16. A framework structure comprising a plurality of secondary constituent units each constituted by one framework structure according to claim 4, adjacent ones of the secondary constituent units in the direction of an axis passing through the center thereof being coupled together with couplers used in common, and adjacent ones of the secondary constituent units in the direction perpendicular to an axis passing through the center thereof being coupled together with a primary constituent unit used in common.

17. A framework structure comprising a plurality of secondary constituent units each constituted by one framework structure according to claim 5, adjacent ones of the secondary constituent units in the direction of an axis passing through the center thereof being coupled together with couplers used in common, and adjacent ones of the secondary constituent units in the direction perpendicular to an axis passing through the center thereof being coupled together with a primary constituent unit used in common.

18. A framework structure comprising four different kinds of secondary constituent units constituted by respective framework structures according to claim 2, the secondary constituent units of a selected kind among the four different kinds being coupled to one another in the direction of an axis passing through the center thereof with couplers used in common between adjacent ones of the secondary constituent units.

19. A framework structure comprising four different kinds of secondary constituent units constituted by respective framework structures according to claim 2, the secondary constituent units of a plurality of selected kinds among the four different kinds being coupled to one another in the direction perpendicular to an axis passing through the center thereof with a primary constituent unit used in common between adjacent ones of the secondary constituent units.

20. A framework structure comprising four different kinds of secondary constituent units constituted by respective framework structures according to claim 2, the secondary constituent units of a plurality of selected kinds among the four different kinds being coupled to one another in the direction of an axis passing through the center thereof and in the direction perpendicular to an axis passing through the center thereof with couplers or a primary constituent unit used in common between adjacent ones of the secondary constituent units.

21. A framework structure comprising four different kinds of secondary constituent units constituted by respective framework structures according to claim 2, adjacent ones of the secondary constituent units of a selected kind or a plurality of selected kinds among the four different kinds being coupled together via a pair of couplers coupled together for relative rotation about a fourth rotation axis perpendicular to second rotation axes of the pair couplers, adjacent primary constituent units being disposed between the two adjacent secondary constituent units and coupled together for relative rotation about the fourth rotation axis.

22. A framework structure comprising a polyhedron with all or some of lateral faces thereof each constituted by the framework structure according to claim 1, the framework structures being disposed with their bases aligned with each other, adjacent ones of the framework structures being coupled together via adjacent couplers coupled together for relative rotation about a fifth rotation axis.

23. A framework structure comprising a plurality of primary constituent units each including two rigid diagonal members constituting the diagonals of a quadrangular lateral face of a solid, the quadrangular lateral face having at least one of two opposed side pairs lying in parallel planes, the two diagonal members being coupled together for relative rotation about a first rotation axis passing through the intersection of the diagonals, the primary constituent units being coupled to one another in a ring-like fashion by coupling an end of each diagonal member in each primary constituent unit by a coupler to an associated end of a diagonal member of an adjacent primary constituent unit, wherein some of the couplers each include a first coupling member coupled to the associated diagonal member for relative rotation about a second rotation axis extending in the axial direction of the first rotation axis of the associated diagonal member and a second coupling member coupled to the first coupling member for rotation about a third rotation axis perpendicular to the second rotation axis.

24. A framework structure comprising a plurality of secondary constituent units of type 9 each constituted by the framework structure according to claim 19, the secondary constituent units being coupled together with a plurality of primary constituent units used in common between adjacent ones of them, the secondary constituent units each disposed on each or some lateral faces of a polyhedron in a developed form of the framework structure.

25. A framework structure according to claim 1, wherein a tension element is passed between mated ends of the two diagonal members of each primary constituent units such as to prevent relative rotation of the two diagonal members when an external force is exerted to the structure, thus making the structure rigid.

26. A framework structure according to claim 1, wherein a wire is passed as a tension element around wire passing members provided on mated ends of the two diagonal members of a primary constituent unit or on two coupling members, the wire being capable of being secured at its trailing end to a diagonal member or to a coupling member while its leading end is secured in a pulled state to prevent relative rotation of the two diagonal members or the two coupling members when an external force is exerted to the structure, thus making the structure rigid.

27. A framework structure according to claim 1, wherein at least two wires are passed as tension elements around wire passing members provided on mated ends of the two diagonal members of a primary constituent unit or on two couplers such that one of the wires is led along a route for expansion and that another one of the wires is led along a route for contraction, the structure being expanded into a two-dimensional form by pulling the wire led along the route for expansion, the structure being contracted into a uni-dimensional form by pulling the wire led along the route for contraction.

28. A framework structure according to claim 26, wherein the diagonal members in each primary constituent unit are made from pipes, the wire or wires being led through the pipes.

29. A framework structure according to claim 27, wherein the diagonal members in each primary constituent unit are made from pipes, the wire or wires being led through the pipes.

* * * * *

UNITED STATES PATENT AND TRADEMARK OFFICE

CERTIFICATE OF CORRECTION

PATENT NO. : 5,761,871

DATED : June 9, 1998

INVENTOR(S) : Katsuhito ATAKE

It is certified that error appears in the above-indentified patent and that said Letters Patent is hereby corrected as shown below:

Column 37, line 25, change "2" to --1--.

Column 37, line 33, change "2" to --1--.

Column 37, line 41, change "2" to --1--.

Column 37, line 51, change "2" to --1--.

Signed and Sealed this

Twenty-second Day of September, 1998

*Attest:*

*Attesting Officer*

Bruce Lehman

BRUCE LEHMAN

*Commissioner of Patents and Trademarks*